US008387693B2

(12) United States Patent
Tunget

(10) Patent No.: US 8,387,693 B2
(45) Date of Patent: Mar. 5, 2013

(54) SYSTEMS AND METHODS FOR USING A PASSAGEWAY THROUGH SUBTERRANEAN STRATA

(76) Inventor: Bruce A. Tunget, Westhill (GB)

( * ) Notice: Subject to any disclaimer, the term of this patent is extended or adjusted under 35 U.S.C. 154(b) by 578 days.

(21) Appl. No.: 12/653,784

(22) Filed: Dec. 18, 2009

(65) Prior Publication Data

US 2010/0155067 A1 Jun. 24, 2010

(51) Int. Cl.
*E21B 33/13* (2006.01)

(52) U.S. Cl. ..... 166/292; 166/285; 175/320

(58) Field of Classification Search ..... 166/292, 166/250.1, 285, 242.1; 175/327, 320; 384/92; 241/275
See application file for complete search history.

(56) References Cited

U.S. PATENT DOCUMENTS 3,871,450 A 3/1975 Jett et al.
4,044,829 A 8/1977 Jessup et al.
4,474,242 A 10/1984 Upchurch
5,769,162 A 6/1998 Bartlett et al.
5,890,537 A 4/1999 Lavaure et al.
6,152,228 A 11/2000 Carmichael
6,186,239 B1 2/2001 Monjure et al.
6,279,657 B1 8/2001 Carmichael et al.
7,216,727 B2 5/2007 Wardley
7,322,419 B2 1/2008 Carmichael
7,407,011 B2 8/2008 Kent
7,568,535 B2 8/2009 Larson et al.
2002/0189863 A1 12/2002 Wardley
2005/0173119 A1 8/2005 Hay et al.
2007/0068704 A1 3/2007 Krueger et al.
2007/0068705 A1 3/2007 Hosie et al.
2008/0060846 A1 3/2008 Belcher et al.
2008/0128140 A1 6/2008 Giroux et al.
2009/0145664 A1 6/2009 Larson et al.

*Primary Examiner* — Daniel P Stephenson
(74) *Attorney, Agent, or Firm* — The Matthews Firm

(57) ABSTRACT

Systems and methods usable to urge a passageway through subterranean strata, place protective lining conduit strings between the subterranean strata and the wall of said passageway without removing the urging apparatus from said passageway, and target deeper subterranean strata formations than is normally the practice for placement of said protective lining conduit strings by providing apparatuses for reducing the particle size of rock debris to generate lost circulation material to inhibit the initiation or propagation of subterranean strata fractures.

45 Claims, 27 Drawing Sheets

Fig. 1 Prior Art
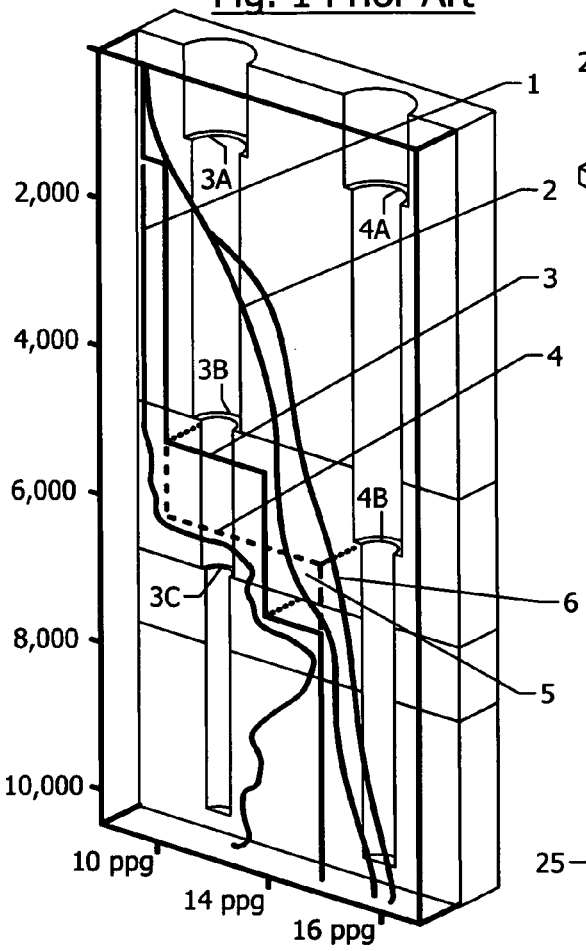
Fig 3 Prior Art
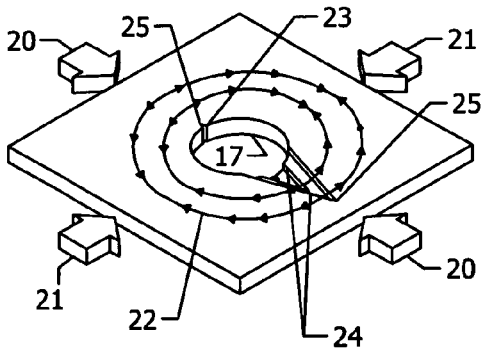
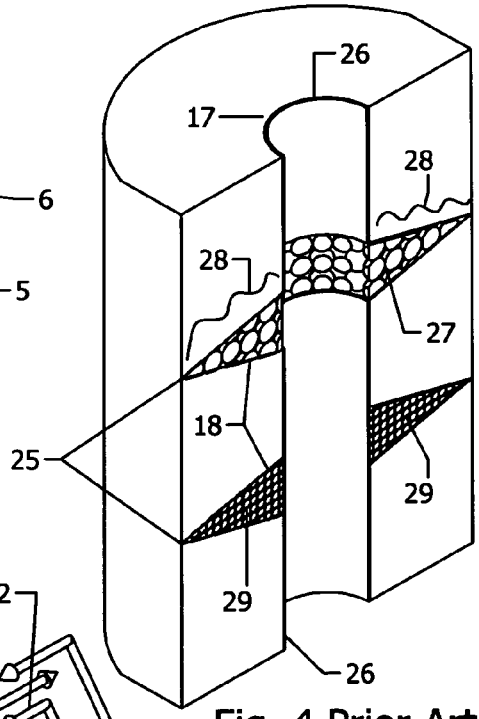
Fig. 4 Prior Art
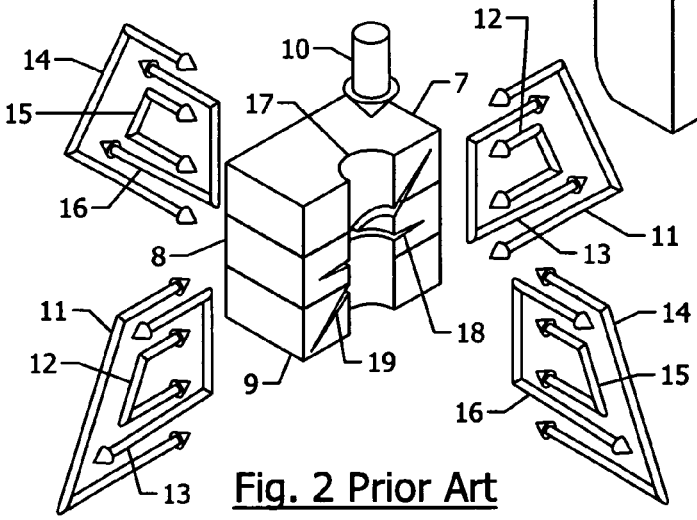
Fig. 2 Prior Art Section AA-AA Fig. 15
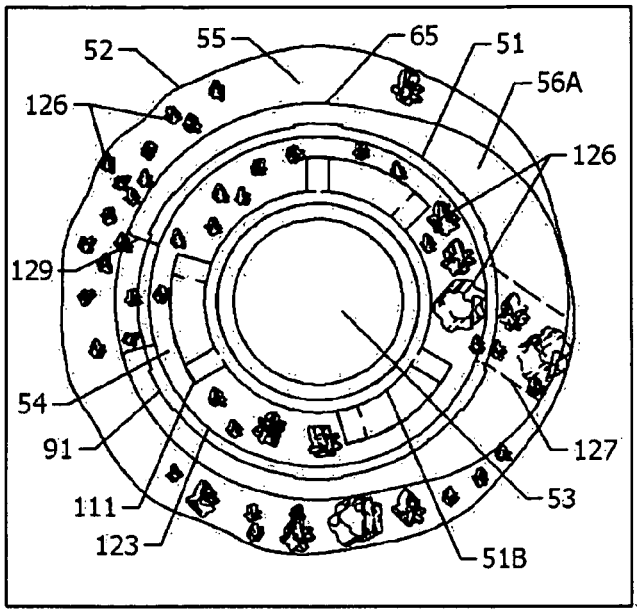
Fig. 19
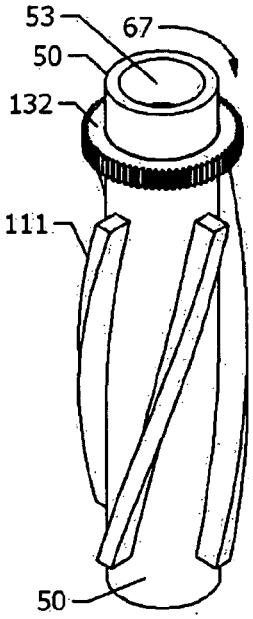
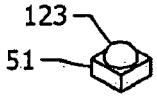
Fig. 16
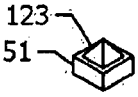
Fig. 17
Fig. 18
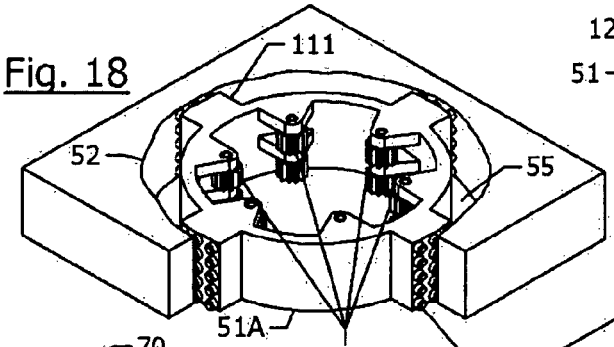
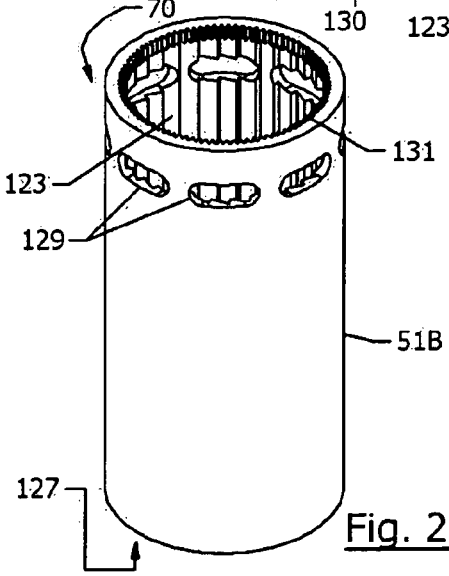
Fig. 20
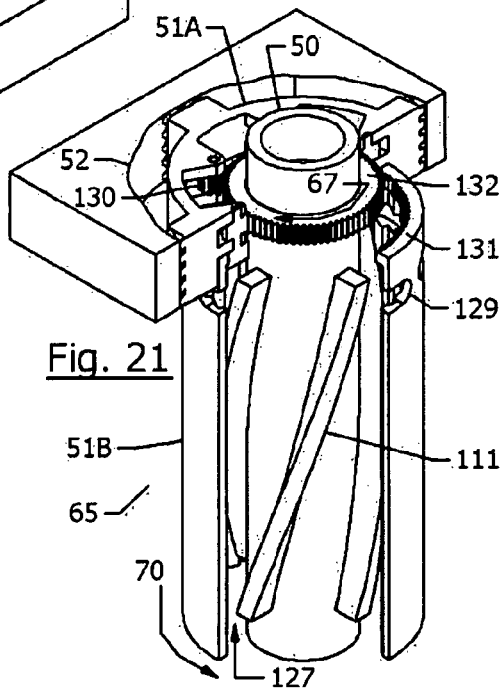
Fig. 21

65
AC
111
AC 70
130
51A
70
67
69
51B
131
132
50
AD
56A
AD 65
72
65
111
129
129
132
129A
130
131
111
51A
51B
111A
127
127
127A
72
111A
133
125
50
72
51
69
127A
69
127
54
51C
69

Detail AE
72
51
56A
111
123
132
69
130
129
51A
129A
51B
131
111
51
69
111
AE
50
127A
127
51
72
69

132
50
132

129
50
134
132
111
132

72
50
125
111
129
65

129
111
125
127
51A 132
131
111
51B
131
132
50

129
51
111
127
125

125
111
129
51A
111
127

132
130
132
111
51B
131
130
123
51

Section X-X

Detail Y

Section X-X

Detail Z

Prior
Art

Prior
Art

Detail A

Detail B

Detail A

Detail B

Detail A

Detail B
A
B
68
69
33
34
35
36
37
47
49
50
50A
51
58
60

72
50
91
114
50
72

58
112
114
113
51D
59
59
120

72
58
50
59
91
114
50
72

117A
88

117

91
59
59
76
88
59
120
59
59
58
51

72
58
50
59
59

72

58
50
59
51
114
58
51
59
59
91
63
72
61
59
117A
72

72
50
58
114
50
51
51
59
121
76
89

Section T-T
61
63
58
50
51
50
72

58
L
59
L

Section L-L
58

58
M
M
59
58
119
50
118
117
51
114
113
75
Blocked
Open
94

Section L-L

Section M-M

Section F-F

Section G-G

Section I-I

Section J-J

Section K-K

H
H
112

119
51C
116
115
114

114
114
51C
116
114
119
114

Section H-H
117

118
117

115
117
117
119
116

118

Section T-T

Detail U

Section T-T

Detail V

Detail W 52
58
N
N 55
53
52
72
112
50
58
91
P
58
88
76
75
O
52
59
50
72
51

Section N-N 75
117A
112
88
76
75
117
54B
51A
120
59
120

Detail O
58
59
91
55
54A
117
75
51
88
88
52
76
75
117
54B
51A
59
51A
120
54A

Detail P

52
Q
Q
58

72
58
R
S
52
51

Section Q-Q
50
72
75
117A
88
59
94
99
99
76
117
54B
51A

Detail R
51
59
94
99
120
59
120
51A
51
52
55

Detail S
94
99
99

120
76
67
117
54B
51F
59
120
59
51A
50
120
51
55

Detail S

AF
AF
AG
72
58
50
59
75
51
76
59
75
59
91
95
90
92
91
77
51
51C
72
69
68
51B
58
75
76
75D
75
69
Fig. 106 Detail AG
50
69
68
58
75
51D
76
96
96
51
51C
94
75D
75
95
50
68
69

Detail AG
91
58
53
51
59
75

76
50
59
51D
58
51D
59
59
59
59
51
50

Section
D-D
52
72
72
50
E
58
111
52
D
D 59
58
59
50
51
50
51
52
59
53
52
55
68
58
76
75
59
75
54
69

Detail E
76
76
76
96

51D
59
51D
58
59

69
68
75A
75B
59
51D
P1
Block
75B
59
Open
75A
P2
Block
75A
59
Open
75B
P3
Block
75B
53
Open
75A
59
P3
Block
P4
Not
Blocked
94
51
50
53
72
95
54
AK
AL

AN
AN
AO
AO
AP
AP
AM
AM
58
72
59
68
69
51
54
53
50
51C
94
99
51D
75
103
97

AQ
AQ
112A 50
72
112A
104
AR
AS
104

Detail AR
112A
105
104
107C
105
110
107A
111
106
91
107B
105
109A
108
114
117A
109
107A
108

110
109
107A
107A
109A
110

107C
107B
107B
105
107C
104

72

72
50
104
91
105
106
117A
91
106
105
111
104

AT
AT 76A
97

Detail AS
105
109A
112A
117A
50
109
107A
107B
91
105
110
111
106
107C
C
C
58

87
75
117A
54
50
51
50
87
117A
87
89
54
53
72
75
117A
50
72
50
50
76A

Section
AU-AU
AU
AU
98

50
76A
99
117B
51
94
99
50
51
117B
AV

Detail AV

Section C-C

Fig. 140
Prior Art
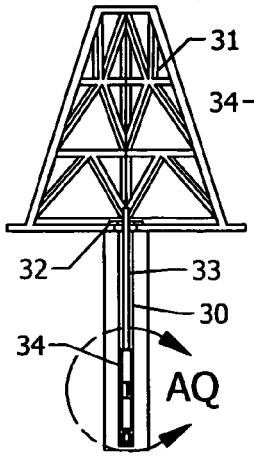
Fig. 141
Detail AQ
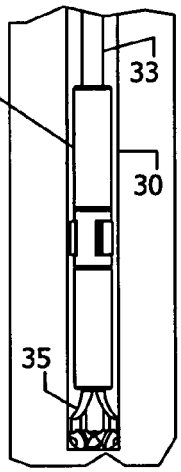
Fig 142
Prior Art
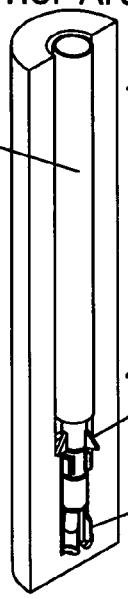
Fig. 143
Prior Art
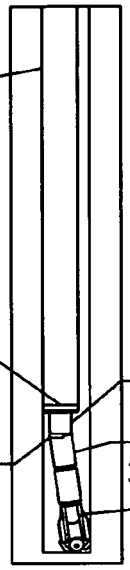
Fig. 144
Prior Art
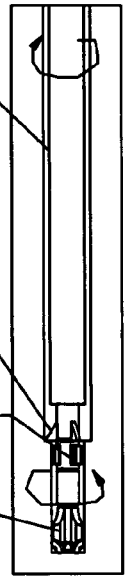
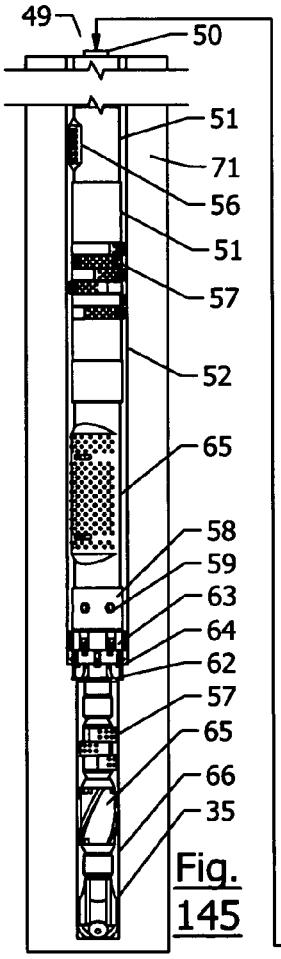
Fig. 145
Fig. 146
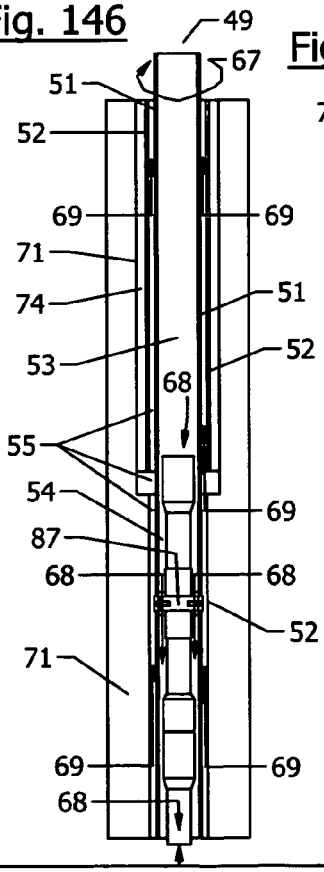
Fig. 147
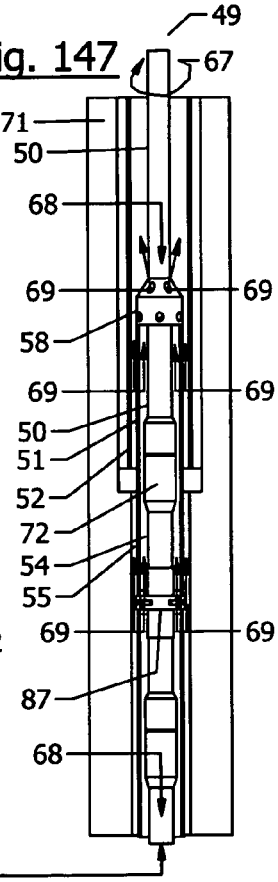

AW
AW
49
50
51
52
53
54
58
59
63
65
67
72
74
76
87
88
117A
35
18

AX
AX
49
65
35
69
58
88
76
59
51
52
18
54A
67
56
57
63
50
47
25
68
90
77

67
49
52

52
77
50
59
49
76
88
59

51
81
78
79
52
80

49
88
50
76
59
59

51
52
49
58
77
76
88
59
50
54A
51

49
51
50
83

35
57
63
57
65
49
51
50
52

83
35
49
47
82

49
49
54A
51
52
83
35

SYSTEMS AND METHODS FOR USING A PASSAGEWAY THROUGH SUBTERRANEAN STRATA

CROSS-REFERENCE TO RELATED APPLICATIONS

The present application claims priority to the United Kingdom patent application having Patent Application Number 0921954.4, filed Dec. 16, 2009, and the United Kingdom patent application having Patent Application Number 0823194.6, filed Dec. 19, 2008. The aforementioned patent applications are incorporated herein in their entirety by reference.

FIELD

Aspects of present invention relate, generally, to systems and methods usable to perform operations within a passageway through subterranean strata, including limiting fracture initiation and propagation within subterranean strata, liner placement and cementation, drilling, casing drilling, liner drilling, completions, and combinations thereof.

BACKGROUND

Embodiments of a first aspect of the present invention relate to the subterranean creation of lost circulation material (LCM) from the rock debris inventory within a bored passageway, used to inhibit fracture initiation or propagation within the walls of the passageway through subterranean strata. Apparatuses for employing this first aspect, may be engaged to drill strings to generate LCM in close proximity to newly exposed fracturable strata walls of the bored portion of the passageway through subterranean strata, for timely application of said subterranean generated LCM to said walls.

Embodiments of rock breaking tools incorporating this first aspect can include: passageway enlargement tools (63 of FIGS. 5 to 7), eccentric milling tools (56 of FIGS. 8 to 9), bushing milling tools (57 of FIGS. 10 to 12) and rock slurrification tools (65 of FIGS. 15 to 39). Usable embodiments of passageway enlargement tools and eccentric milling tools are dependent upon embodiments of managed pressure conduit assemblies (49 of FIGS. 145 to 166) selected for use. The embodiments of said bushing milling tools represent significant improvements to similar conventional tools described in U.S. Pat. No. 3,982,594, the entirety of which is incorporated herein by reference. Embodiments relating to rock slurrification tools (65 of FIGS. 15 to 39) represent significant improvements to conventional above ground technology, described in U.S. Pat. No. 4,090,673, the entirety of which is incorporated herein by reference, placed within a drill string to generate LCM from rock debris in a subterranean environment. The embodiments relating to said rock slurrification tools break rock debris or other breakable materials placed in a slurry through impact with a rotating impellor, or through centrifugally accelerating said rock debris or added material to impact a relatively stationary or opposite rotational surface.

Embodiments of the rock breaking tools further use rock slurrification and milling of a rock debris inventory generated from a drill bit or bore hole opener to generate LCM, while conventional methods rely on surface addition of LCM with an inherent time lag between detection of subterranean fractures through loss of circulated fluid slurry and subsequent addition of LCM. Embodiments of the present invention inhibit the initiation or propagation of strata fractures by generating LCM from a rock debris inventory urged through a bored passageway by circulated slurry coating the strata wall of said passageway, before initiation or significant propagation of fractures occur.

Due to its relatively inelastic nature, rock has a high propensity to fracture during boring and pressurized slurry circulation. With the timely application of LCM, embodiments of the present invention may be used to target deeper subterranean formations prior to lining a strata passageway with protective casing, by improving the differential pressure barrier, known as filter cake, between subterranean strata and circulated slurry, by urging lost circulation material into pore spaces, fractures or small cracks in said wall coated with circulated slurry in a timely manner to reduce the propensity of fracture initiation and propagation. Packing LCM within the filter cake, covering the pore spaces of whole rock, inhibits the initiation of fractures by improving the differential pressure bearing nature of said filter cake. Various methods for limiting initiation and propagation of fractures within strata exist and are described in U.S. Pat. No. 5,207,282, the entirety of which is incorporated herein by reference.

Embodiments of the present invention, including rock breaking tools (56, 57, 63, 65), slurry passageway tools (58 of FIGS. 42 to 70, 88 to 118 and 121 to 124) and managed pressure conduit assemblies (49 of FIGS. 145 to 166), use mechanical and pressurized application of subterranean generated LCM to supplement and/or replace surface added LCM to strata pore and fracture spaces, further re-enforcing said filter cake's differential pressure bearing capability to further inhibit the initiation or propagation of fractures with the timely application and packing of said LCM, referred to by experts in the art as well bore stress cage strengthening. Conventional methods, generally, require that boring be stopped to perform stress cage strengthening of the well bores, while embodiments of the present invention may be used to continuously vary pressure exerted on the well bore, strengthening the well bore during boring, circulation and/or rotation of a conduit string carrying said embodiments.

Embodiments of a second aspect of the present invention relate to the ability to emulate casing drilling and liner drilling placement of a protective lining within subterranean strata without requiring removal of the drill string. Additionally this second aspect may be used to place sand screens, perforating guns, production packers and other completion equipment within the subterranean strata. Once a desired subterranean strata bore depth is achieved, embodiments of the slurry passageway tool (58 of FIGS. 42 to 70, 88 to 118 and 121 to 124) or managed pressure conduit assembly (49 of FIGS. 145 to 166) detach one or more outer concentric strings and engage said strings to the passageway through subterranean strata. This second aspect of the present invention can be combined with embodiments of rock breaking tools (56, 57, 63, 65) employing the first aspect of the present invention to reduce the propensity of fracture initiation and propagation until the second aspect of the present invention isolates subterranean strata with a protective lining. This undertaking removes the risks of first extracting a drilling string and subsequently urging a liner, casing, completion or other protective lining string axially downward within the passageway through subterranean strata, during which time the ability to address subterranean hazards is limited.

Embodiments of a third aspect of the present invention relate to the ability to urge cement slurry axially downward or axially upward through a first annular passageway between the subterranean strata and a protective lining, engaging said lining with the walls of a passageway through subterranean strata using embodiments of the slurry passageway tool (58 of FIGS. 42 to 70, 88 to 118 and 121 to 124).

Conventional methods of cementation rely on pushing cement slurry axially upward through a first annular passageway, while the third aspect of the present invention may use the higher specific gravity of said cement slurry to aid its urging axially downward through said first annular passageway, effectively permitting the slurry to fall into place with minimum applied pressure. As cementation at the upward end of said protective lining is the most crucial for creating a differential pressure barrier isolating weaker shallow strata formations, gravity assisted placement of the third aspect of the present invention significantly increases the likelihood of placing cement slurry at the upward end without incurring losses to the strata compared to conventional methods.

Embodiments of said slurry passageway tool may also be provided with a flexible membrane (76 of FIGS. 58 to 59, and 88 to 93) functioning as a drill-in casing or liner shoe, preventing axially upward or downwardly placed cement from u-tubing once placed, without removing the internal drill string or forcing cement through sensitive apparatus such as motors and logging tools or drilling equipment in said internal drill string.

After cementation occurs and said inflatable membrane prevents u-tubing, the internal drill string of a dual conduit string application (49 of FIGS. 145 to 166), may be used to continue boring a subterranean passageway while the placed cement is hardening.

While cementation is the prevalent application for the third aspect of the present invention, any fluid slurry, including drilling or completion fluids, may be diverted axially downward or upward through the first annular passageway with embodiments of the slurry passageway tool (58 of FIGS. 42 to 70, 88 to 118 and 121 to 124). In instances of high annular frictional factors, circulation of drilling or completion fluids, including placing gravel packs or drilling ahead with losses, the friction of a limited clearance of a first annular passageway may be used to slow the loss of slurry while maintaining a hydrostatic head and/or gravity assisted flow when circulating any fluid.

Embodiments of a fourth aspect of the present invention remove the need to select between the annular slurry velocities and associated annular pressure regimes of conventional methods of drilling, liner drilling and casing drilling. Using this fourth aspect, the more significant annular velocity and associated annular pressure benefits may be emulated with a large diameter string (49 of FIGS. 145 to 166) used to carry a protective lining with the drilling assembly.

Conventional methods for performing operations within a passageway through subterranean strata require the exclusive selection of liner drilling or casing drilling high annular velocities and associated annular pressures if a protective lining is to be used as a drill string. Embodiments of the present invention (49 of FIGS. 145 to 166) carry a protective lining with a drill string allowing the selection of a lower annular velocity and annular pressure of a traditional drill string until said lining is engaged with the strata wall, after which a drill string may continue to drill ahead having never been removed from the passageway through subterranean strata as described in the third aspect of the present invention. If a plurality of protective linings are carried with the internal drill string, a succession of protective linings may be placed without removing the internal drill string as described in the liner drilling embodiment of FIG. 159.

Liner drilling is similar to casing drilling with the distinction of having a cross over apparatus to a drilling string at its upper end. As said cross over apparatus is generally not disposed within the subterranean strata and has little effect on annular velocities and pressures experienced by the strata bore, liner drilling and casing drilling are referred to synonymously throughout the remainder of the description.

Additionally, where the large diameter of prior casing drilling apparatus provide the benefit of a slurry smear effect, generally inapplicable to smaller diameter drilling strings, embodiments of the managed pressure conduit assembly (49 of FIGS. 145 to 166) also emulate said smear effect without requiring higher annular velocities and frictional losses associated with conventional casing drilling by directing an internal annular passageway flow in the same axial direction as circulated fluid in the annular passageway between strata and the drill string, thus increasing flow capacity and decreasing velocity and associated pressure loss in the direction of annular flow.

Embodiments incorporating the fourth aspect of the present invention may emulate smear effects, annular velocity and associated pressures of drilling or casing drilling. Contrary to conventional methods of casing drilling, embodiments of the managed pressure conduit assembly (49 of FIGS. 145 to 166) have a plurality of internal circulating passageways that may be directed in a plurality of directions by a slurry passageway tool (58 of FIGS. 42 to 70, 88 to 118 and 121 to 124) to emulate the annular velocity and frictional losses of either conventional drilling or conventional casing drilling apparatus in the first annular passageway between a tool string and the passageway through subterranean strata.

Embodiments of a fifth aspect of the present invention relate to the ability repeatedly select and reselect fluid slurry circulation velocity and associated pressure emulations in a plurality of directions, through use of the third and fourth aspects of the present invention, described above, with embodiments of a multi-function tool (FIGS. 73 to 87, and 125 to 131) used to control the connection of passageway by embodiments of a slurry passageway tool (58 of FIGS. 42 to 70, 88 to 118 and 121 to 124).

Embodiments of a sixth aspect of the present invention relate to the ability to incorporate various selected embodiments of the present invention into a single tool (49 of FIGS. 145 to 166) having a plurality of conduit strings with slurry passageway tools (58 of FIGS. 42 to 70, 88 to 118 and 121 to 124), multi-function tools (FIGS. 73 to 87, and 125 to 131) controlling said slurry passageway tools, and subterranean LCM generation tools (56, 57, 63, 65 of FIGS. 5 to 39) to realize benefits of the first five aspects and target subterranean depths deeper than those currently possible using conventional technology.

A need exists for systems and methods for increasing available amounts of LCM for timely application to subterranean strata to subsequently reduce the propensity of strata fracture initiation or propagation.

A need exits for systems and methods for engaging protective liners, casings and completion equipment with subterranean strata without the need to remove a drill string.

A need exists for systems and methods to gravity assist the circulation slurry and cement slurry axially downward or axially upward between liners, casings, completions, other protective linings and the subterranean strata without affecting slurry sensitive internal drilling and completion equipment, such as mud motors, logging while drilling equipment, perforating guns and sand screens.

A need exits for drilling-in sensitive completion components, after which the drill string may be used as a production or injection string.

A need exists for methods and systems emulating the annular velocities and associated pressures of prior art drilling or completion strings in sensitive strata formations susceptible to fracture without losing smear effects, carriage of a protective linings or adversely affecting sensitive equipment within said strings.

A further need exists for systems and methods where the selection of said annular velocities, associated pressures and smear effects are not exclusive, but repeatable during the repeated urging of a passage through subterranean strata and engaging a protective lining to said passageway, without the need to remove the internal drill string exposing well operations to the risks of exiting and re-entering said passageway.

Significant hazards and costs exist for the exclusive selection of benefits associated with existing technology that when multiplied by the number of passageways and protective linings placed, represents a significant cost of operations.

A need also exists for systems and methods generally applicable across subterranean strata, susceptible to fracture, to reach deeper depths than is currently the practice or realistically achievable with existing technology prior to placement of protective drilling and completion linings.

The present invention meets these needs.

BRIEF DESCRIPTION OF THE DRAWINGS

In the detailed description of various embodiments of the present invention presented below, reference is made to the accompanying drawings, in which:

FIGS. 1 to 4 illustrate prior art methods for determining the depth at which a protective casing must be placed in the subterranean strata, explained in terms of the fracture gradient of subterranean strata and required slurry density to prevent fracture initiation and propagation, including prior art methods by which said fracture initiation and propagation may be explained and controlled.

FIG. 15 and FIGS. 18 to 22 illustrate an embodiment of a rock slurrification tool wherein the wall of the passageway through subterranean strata is engaged with a wall of said tool, having various embodiments, wherein an internal additional wall, disposed within said wall engaged with strata, is rotated relative to an internal impeller secured to the internal rotating conduit string, and arranged in use to accelerate, impact and break rock debris pumped through the internal cavity of said tool after which broken rock debris is pumped out of said internal cavity.

FIGS. 16 to 17 show two examples of impact surfaces that may be engaged to an impacting surface to aid breaking or cutting of rock.

FIGS. 23 to 25 illustrate two embodiments of rock slurrification tools that may be engaged with a single wall conduit string or dual walled conduit string respectively to create LCM by pumping rock debris contained in slurry through the central cavity of said tools which impact and centrifugally accelerate denser rock debris via an impeller to aid breakage of said rock debris.

FIGS. 73 to 78 depict member parts of FIGS. 60 to 64, usable as internal multi-function tool for repeatedly selecting the internal passageway arrangements of FIGS. 60 to 64 when an actuation tool engages mandrel projections within said member parts moving them axially downward before exiting said member parts.

FIGS. 88 to 93 illustrate the tool of FIG. 59 disposed within the passageway through subterranean strata, with cross sectional views depicting operational cooperation between member parts.

FIGS. 105 to 107 illustrate an embodiment of a slurry passageway tool, wherein the axial length of the tool may be varied, and the protective lining may be detached and engaged to the wall of a passageway through subterranean strata with an actuation tool diverting flow through radially-extending passageways.

FIG. 108 illustrates a plan view of an embodiment of vertical and outward radially extending passageways through a slurry passageway tool, having a spline arrangement between the tool and large diameter outer conduit, wherein the cross over of axially downward and axially upward slurry flow above and below said slurry passageway tool may occur.

FIGS. 140 to 144 depict prior art examples of drilling and casing drilling.

FIGS. 145 to 147 illustrate two embodiments of a nested conduit string, wherein the lower portion of the string shown in FIG. 145 can be combined with either of the two upper portions of the string shown in FIGS. 146 and 147.

DETAILED DESCRIPTION OF THE EMBODIMENTS

Figure 5:
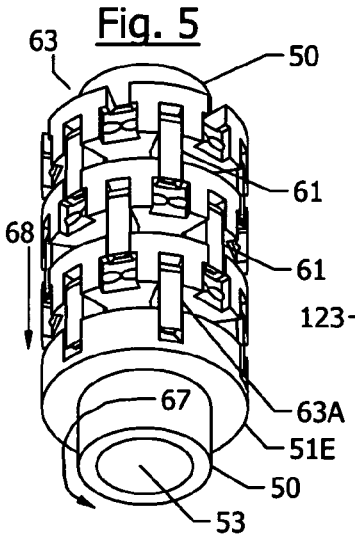
FIGS. 5 to 7 depict an embodiment of a bore enlargement tool for enlarging a subterranean bore with two or more stages of extendable and retractable cutters.

Before explaining selected embodiments of the present invention in detail, it is to be understood that the present invention is not limited to the particular embodiments described herein and that the present invention can be practiced or carried out in various ways.

A first aspect of the present invention relates, generally, to timely generation and application of lost circulation material (LCM) from rock debris for deposition within a fracture and/or barrier known as filter cake, that can be engaged to the strata wall to differentially pressure seal strata pore spaces and fractures, thus inhibiting initiation or propagation of fractures within strata.

Referring now to FIG. 1, an isometric view of generally accepted prior art graphs, which are superimposed over a subterranean strata column with two bore arrangements relating subterranean depths to slurry densities and equivalent pore and fracture gradient pressures of subterranean strata are shown. The graphs show that fluid density (3), increasable with the effective circulating fluid slurry density in excess of the subterranean strata pore pressure (1), must be maintained to prevent ingress of unwanted subterranean substances into said circulated fluid slurry and/or pressured caving of rock from the walls of the strata passageway.

FIG. 1 further shows that drilling fluid density (3) must be between the subterranean strata fracture gradient pressure (2) and the subterranean pore pressure (1) to prevent initiating fractures or losing circulated fluid slurry, respectively, including influxes of formation fluids or gases and/or caving of rock from the strata wall.

In many prior art applications the drilling fluid density (3) must be maintained within acceptable bounds (1 and 2), until a protective lining (3A) is set, to allow a subsequent increase in slurry density (3) once the protective lining is set, to prevent influxes or fluid slurry losses if the density (3) is less than the subterranean strata pore pressure or greater than the fracture gradient (2), where initiation of influxes or initiation and propagation of strata fractures occurs, respectively. After which, the process can be repeated and additional protective linings (3B and 3C) can be set until reaching a final depth.

The first aspect of the present invention uses embodiments (56A-56C, 57A-57B, 63A-63C, 65A-65J) of rock breaking tools (56, 57, 63, 65 of FIGS. 5 to 39), to increase the fracture gradient pressure (2) to a higher gradient (6) by imbedding LCM in the filter cake and existing fractures, known as well bore stress cage strengthening. The packing of fractures and filter cake increases the fracture gradient and differentially pressure seals pore and facture spaces, within the strata, allowing the effective circulating density to vary between new boundaries (1 and 6) before protective linings are set (4B), to prevent strata fracture initiation and propagation to potentially remove the need for a protective lining (3B or 3C).

As the LCM carrying capacity of fluid slurries is limited, subterranean generation of LCM can replace or supplement surface additions of LCM. This allows additional smaller particle size LCM to be added at the surface and increases the total amount of LCM available for well bore stress cage strengthening.

By increasing the fracture gradient pressure (from 2 to 6) with well bore stress cage strengthening, it is possible to target a new depth by increasing fluid slurry density (4) used within the subterranean strata without initiating or propagating fractures prior to placement of a deeper protective lining (4B), which potentially saves time and expense. In the example of FIG. 1, at the increased fracture gradient pressure (6), one fewer protective lining or casing string (4A, 4B) was used to reach final depth, rather than the lining or casing strings (3A, 3B, 3C) used at the lower fracture gradient pressure (2), thus saving the time and cost of casing strings or unacceptable fluid slurry losses.

If the new target depth were attempted using conventional drilling methods and apparatus, drilling fluid slurry would fracture strata and be lost to said fractures when the drilling fluid effective circulating density (4) exceeds the fracture gradient (2), with various combinations of density and depth comprising the lost circulation area (5) of FIG. 1.

Referring now to FIG. 2 an isometric view of a cube of subterranean strata is shown. The Figure illustrates a prior art model of the relationship between subterranean fractures between a stronger subterranean strata formation (7), overlying a weaker and fractured subterranean strata formation (8); overlying a stronger subterranean strata formation (9), wherein a wall of a fracturable passageway (17) exists through the subterranean strata formations.

Referring now to FIGS. 2 and 3, forces acting on the model of FIG. 2 and the weaker fractured formation (8), shown as an isometric view in FIG. 3, includes significant overburden pressure (10 of FIG. 2) caused by the weight of rock above, and include forces acting in the maximum horizontal stress plane (11, 12 and 13 of FIGS. 2 and 20 of FIG. 3), and forces acting in the minimum horizontal stress plane (14, 15 and 16 of FIGS. 2 and 21 of FIG. 3).

Resistance to fracture in the maximum horizontal stress plane increases with depth, but is reduced by weaker formations. In this example, the drilling fluid effective circulating density (ECD), shown as an opposing force (13), is less than the stronger formations (7 and 9) resisting force (11), but in excess of the resisting force (12) of the weaker formation (8) to resist said force, and a fracture (18) initiates and/or propagates as a result.

Resistance to fracture in the minimum horizontal stress plane also increases with depth, but can be reduced by weaker formations with the drilling fluid effective circulating density (ECD) equal to that in the maximum horizontal stress plane (13), and is shown as an opposing force (16), that is less than the stronger formations (7 and 9), but in excess of the resisting force (15) of the weaker formation (8), and a fracture (18) initiates and/or propagates to the maximum stress plane as a result.

Referring now to FIG. 3, due to the relatively inelastic nature of most subterranean rock, small subterranean horizontal fractures (23) generally form in the maximum horizontal stress plane. This may be visualized as hoop stresses (22) propagating from the maximum (20) to minimum (21) horizontal stress planes, creating a small fracture (23) on a wall of the fracturable passageway (17) (i.e. a bore).

If the horizontal stress forces resisting fracture propagation (12 and 15 of FIG. 2) are less than the pressure exerted (13 and 16 of FIG. 2) by the effective or equivalent circulating density (ECD) of circulated fluid slurry or static hydrostatic pressure of static fluid slurry (3 of FIG. 1), the fracture (23) will propagate (24), with the maximum horizontal stress plane hoop stresses (22) aiding said propagation (24) as they seek the minimum horizontal stress plane (21), shown as dashed convex arrows acting at the edges of said fracture and point of fracture propagation (25).

Referring now to FIG. 4, an isometric view of two horizontal fractures across a wall of a fracturable passageway (17) through subterranean strata coated with a filter cake (26) is shown. Rock debris (27) of sizes greater than that of an LCM particle size distribution cannot be sufficiently packed within a fracture and create large pore spaces through which pressure may pass (28) to the point of fracture propagation (25), allowing further propagation of fractures. Fracture propagation can be inhibited by packing LCM sized particles (29) within a fracture (18) and allowing the filter cake (26) to bridge and seal between the LCM particles, to differentially pressure seal the point of facture propagation (25) from hydrostatic pressure or higher ECD pressures and further propagation.

Embodiments (56A-56E, 57A-57E, 63A-63C, 65A-65L) of rock breaking tools (56, 57, 63, 65 of FIGS. 5 to 39) may be used to generate LCM proximate to strata pore spaces and fractures (18) to replace or supplement surface added LCM, while embodiments (58A-58Z) of slurry passageway tools (58 of FIGS. 42 to 70, 88 to 118 and 121 to 124) may be used to reduce ECD and associated fluid slurry loses until sufficient LCM is placed in a fracture, and/or to pressure inject or pressure compact said LCM with higher ECD by selectively switching between lower and higher pressures using said slurry passageway tool, which can be performed using embodiments (112A-112B) of multi-function tools (112 of FIGS. 73 to 87 and FIGS. 125 to 131). Embodiments (49A-49Z) of a managed pressure conduit assembly (49 of FIGS. 145 to 166) may also be used to mechanically smear and/or compact filter cake and LCM against strata wall pore and fracture spaces to inhibit strata fracture initiation or propagation.

Embodiments of the present invention treat fractures in the horizontal plane (18 of FIGS. 2 to 4) and those not in the horizontal plane (19 of FIG. 2) equally, filling the fractures either with LCM generated downhole, surface added LCM, or combinations thereof, with mechanical application through rock breaking tool engagement with the strata wall and/or selective manipulation of the effective circulating density, to manage horizontal fracture initiation and seal strata pore spaces and fractures with filter cake and LCM in a timely manner to prevent further initiation or propagation.

Referring now to FIGS. 5 to 39, embodiments of rock breaking tools usable to generate LCM downhole are depicted, and include: milling bore enlargement tools (63 of FIGS. 5 to 7), eccentric milling tools (56 of FIGS. 8 to 9), eccentric bushing milling tools (57 of FIGS. 10 to 12), rock slurrification tools (65 of FIGS. 15 to 39) and combinations of said enlargement, milling and slurrification tools in FIGS. 145 to 161.

Prevalent practice regards LCM to include particles ranging in size from 250 microns to 600 microns, or visually between the size of fine and coarse sand, supplied in sufficient amounts to inhibit fracture initiation and fracture propagation. For example, if PDC cutter technology is used to produce relatively consistent particle sizes for a majority of rock types, and the probability of breaking rock particles is relative to the size of rock debris generated by said PDC technology, then approximately 4 to 5 breakages of rock debris will result in more than half of the rock debris particle inventory urged out of a bored strata passageway by circulated fluid slurry to be converted into particles of LCM size. Gravity and slip velocities through circulated slurry in vertical and inclined bores combined with rotating tortuous pathways and increased difficulty of larger particles passing rock breaking embodiments of the present invention provide sufficient residence time for larger particles within the rock debris inventory to be broken approximately 4 to 5 times before becoming efficiently sized for use by circulated slurry.

Rock breaking tools (56, 57, 63 or 65), used for subterranean LCM generation can improve the frictional nature of the wall of the passageway through subterranean strata with a polishing-like action, for reducing frictional resistance, torque and drag while impacting filter cake and LCM into strata pore spaces and fractures.

When rock debris from boring is broken into LCM size particles and applied to the filter cake, strata pore spaces and fractures of the strata passageway, the fracture initiation and propagation can be inhibited and the amount of rock debris that must be extracted from the bore is reduced, such that the debris is easier to carry and place due to its reduced particle size and associated density.

While conventional methods include the surface addition of larger particles of LCM, such as crushed nut shells and other hard particles, these particles are generally lost during processing when returned drilling slurry passes over shale shakers. Conversely, embodiments of the present invention continually replace said larger particles, allowing smaller particles, which are more easily carried and less likely to be lost during processing to remain within the drilling slurry for reducing costs of operation by eliminating the need for continual surface addition of larger particles.

The mix of particle sizes of varying quantities is usable for packing subterranean fractures to create an effective differential pressure seal when combined with a filter cake. Where large particles are lost during processing of slurry, smaller particles are generally retained if drilling centrifuges are avoided. The combination of smaller particle size LCM added at surface with larger particle size LCM generated down hole can be used to increase levels of available LCM and to decrease the number of breakages and/or rock breaking tools needed to generate sufficient LCM levels.

Embodiments of the present invention thereby reduce the need to continually add LCM particles and reduce the time between fracture propagation and treatment due to the continual downhole creation of LCM in the vicinity of fractures while urging the passageway through subterranean strata axially downwards. The combination of filter cake and LCM strengthens the well bore by sealing the point of fracture propagation. Conventional drilling apparatuses do not address the issue of creation or timely application of LCM, or only incidentally and significantly after the point of fracture propagation, with a large fraction of smaller sized rock debris seen at the shale shakers generated through incidental impacts within the protective conduit string lining (51V of FIGS. 146-147) where it is no longer needed.

Generally, rock breaking tools (56, 57, 63 or 65) can have an upper end engaged with the lower end of a passageway from the discharge of one or more slurry pumps, and a lower end engaged with the upper end of one or more passageways for discharging pumped slurry through one or more rotary boring apparatuses.

The depicted embodiments of rock breaking tools are shown having one or more surrounding or additional walls (51U), including eccentric surfaces of the blades (56A-56C) and/or bushing (124) and/or thrust bearing (125), which can surround a wall of a first conduit (50) with upper and lower ends engaging conduits of a conduit drilling string having an internal passageway (53) that urges slurry in an axially downward direction to said boring apparatus. Said one or more surrounding walls can engage rock debris and/or the wall of the bored passageway where a blade (56A-56E, 61, 61A-61C, 111A-111H) or impeller (111), protrusion, or similar member of the rock breaking tool crushes rock debris against an impact wall for subsequent pressurized application or impacts the strata wall to polish said strata wall and to impact LCM sized particles into strata pore and facture spaces.

The surrounding wall of said rock breaking tools can urge slurry against a wall and/or through a smaller passage upward, creating a tortuous path and pressure change across said tool, inhibiting the passage of larger rock debris for further crushing, milling and/or pressure injecting LCM against a fracturable region with said pressure change.

Embodiments of the rock slurrification tool (65) can include an inner cavity between walls of the conduit strings (50, 51, 51A-51U) wherein an impeller or blade is used to pump slurry from the annular passageway, located between said tool and the strata bore wall, into the internal cavity, where larger particles are impacted and broken centrifugally. Then pumped out of the internal cavity into the annular passageway.

Figure 6:
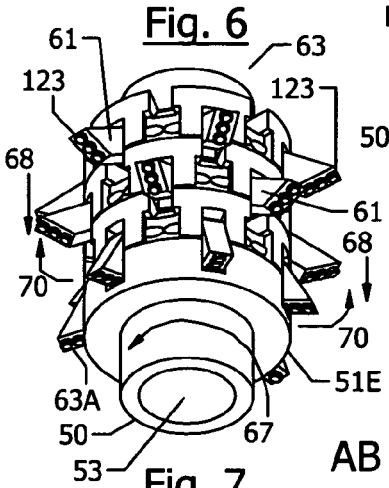

Referring now to FIG. 5 and FIG. 6, an isometric view of an embodiment (63A) of a rock breaking tool and a milling bore hole enlargement tool (63), for enlarging bores within a subterranean rock formation in two or more stages is shown. FIG. 5 depicts a telescopically elongated subassembly with cutters retracted. FIG. 6 depicts telescopically deployed (68) cutter stages that are extended (71 of FIG. 6) as a result of said deployment. Blades (61) comprising first stage cutters (61A), second stage cutters (61B) and third stage cutters (61C) with an impact surfaces (123) embodiment (123D), which can include PDC technology, are shown telescopically deployed (68) in an outward orientation (71 of FIG. 6). The first conduit string (50) carries slurry within its internal passageway (53) and actuates said cutters, secured to a wall (51E) that can be engaged with and through the wall (51D of FIG. 7) of an additional conduit string (51 of FIG. 7). Rotation around the tool's axial centerline (67) engages said first and subsequent staged cutters with the strata wall to cut rock and enlarge the passageway through subterranean strata. Having two or more stages of cutters reduces the particle size of rock debris and creates a step wise tortuous path, increasing the propensity to generate LCM and reducing the number of additional breakages required to generate LCM within the passageway through subterranean strata.

Figure 7:
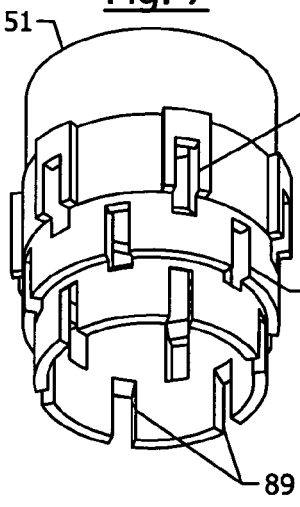

Referring now to FIG. 7, an isometric view of an embodiment of the wall (51D) of the additional conduit string (51) of a milling bore enlargement tool with orifices (59) and receptacles (89), through which staged (61A, 61B, 61C of FIGS. 5 and 6) blade (61) cutters can be extended and retracted, is shown. The orifices or receptacles provide lateral support for the staged cutters when rotated. The upper end of the wall of the additional conduit string (51) can be engaged with an additional wall of a slurry passageway tool (58 of FIGS. 42, 56 to 59, 88 to 93, 121 to 124 and 145 to 166) or managed pressure conduit assembly (49 of FIGS. 145 to 166) to enlarge the bore for passage of additional tools.

Figure 8:
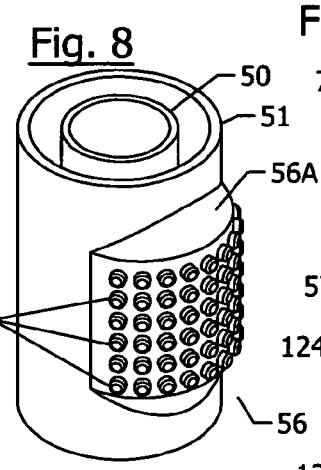
FIGS. 8 to 9 show an embodiment of a rock milling tool having a fixed structure for milling protrusions from the wall of a strata passageway and crushing rock particles carried with the fluid slurry against a strata passageway wall.

Referring now to FIG. 8, an isometric view of an embodiment (56B) of an eccentric rock milling tool (56) is shown. The tool (56) includes an eccentric blade (56B) and an impact surfaces (123) embodiment (123E), such as hard metal inserts or PDC cutters, which form an integral part or wall (51F) of an additional conduit string (51) disposed about a first conduit string (50). The upper and lower ends of the rock milling tool can be placed between conduits of a dual walled string or managed pressure conduit assembly (49 of FIGS. 145 to 166) for urging the breakage of a rock inventory by trapping and crushing rock against the wall of the passageway, or by engaging rock projections from the strata wall and urging the creation of LCM sized particles from rock debris.

Figure 9:
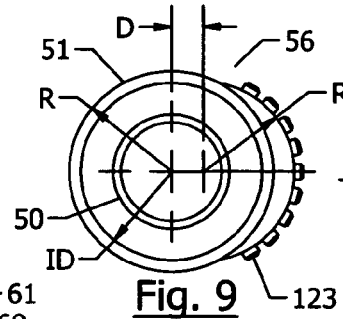

Referring now to FIG. 9, a plan cross sectional view of the rock breaking tool of FIG. 8 is shown. The Figure illustrates the eccentric blade (56B) having a radius (R2) and offset (D) from the central axis of the tool and relative to the internal diameter (ID) and radius (R) of the nested additional wall (51), with impact surfaces (123), such as PDC cutters or hard metal inserts engaged to said blade. In use, the tool can be disposed between conduits of a dual walled string or managed pressure conduit assembly embodiment (49 of FIGS. 145 to 166).

Figure 10:
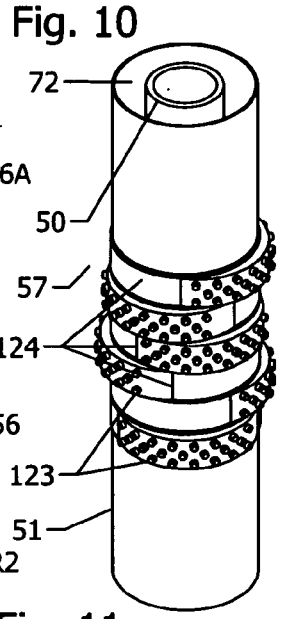
FIGS. 10 to 12 illustrate an embodiment of a bushing milling tool having a plurality of eccentric rotatable structures for milling protrusions from the wall of a strata passageway trapping and crushing rock particles carried with the fluid slurry against the wall of said strata passageway.

Referring now to FIG. 10, an isometric view of an embodiment (57A) of a bushing milling tool (57) is depicted. The tool (57) includes a plurality of stacked additional rotating walls or bushings (124) having eccentric surfaces engaged with hard freewheeling (1231) impact surfaces (123) and intermediate thrust bearings (125 of FIG. 12). The depicted bushing milling tool has milling bushings with eccentric surfaces (124) disposed about a nested wall (51G) of an additional conduit string (51) and the first conduit string (50) for use with a managed pressure conduit assembly (49 of FIGS. 145 to 166). The plurality of rotating eccentric milling bushings (124), rotate freely and are disposed about a dual wall string (49 of FIGS. 146 to 147) having connections (72) to conduit string disposed within the passageway to urge breakage of rock debris into LCM sized particles.

Figure 11:
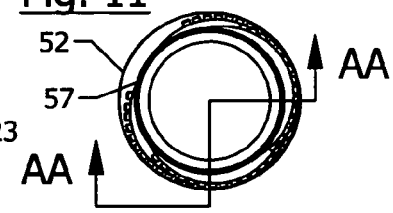
Figure 12:
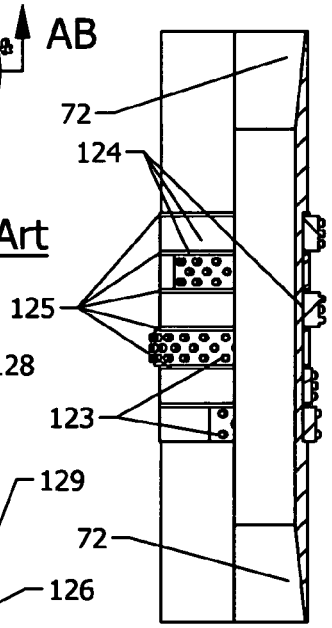

Referring now to FIG. 11, a plan view of an embodiment (57B) of a bushing milling tool (57), disposed within the passageway through subterranean strata (52), with section line AA-AA associated with FIG. 12, is shown. The free rotating surfaces of the eccentric milling bushings (124) create a tortuous slurry path within the passageway through subterranean strata (52), such that rock debris in the first annular passage (55 of FIG. 15) is trapped and crushed between said bushing milling tool (57) and wall of the passageway through subterranean strata (52), urging rotation of individual bushings and further urging the breakage of rock into LCM sized particles.

Referring now to FIG. 12, a cross sectional elevation view of the bushing milling tool (57) of FIG. 11 is shown as Section AA-AA, taken along line AA-AA of FIG. 11, with the passageway through subterranean strata removed to show the tortuous slurry path created by the tool. Frictional string rotation on rock debris trapped next to the bushing's non-eccentric surface urges the eccentric surface to rotate, and the rock debris can be further trapped by eccentric bushings (124) axially above, which catch and crush larger particles while smaller particles travel around said bushings tortuous path and are carried, by circulated slurry, about a single wall drill string (33 of FIGS. 40 to 41 and 40 of FIG. 42). A thrust bearing arrangement (125) is also shown separating the eccentric bushings (124) of the bushing milling tool (57).

Figure 13:
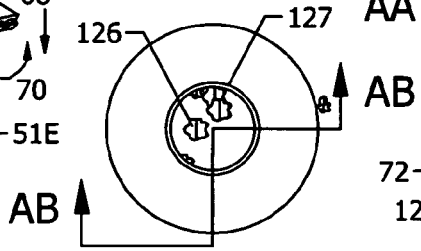
Fig. 13 Prior Art
FIGS. 13 to 14 show a prior art apparatus for centrifugally breaking rock particles.
Figure 14:
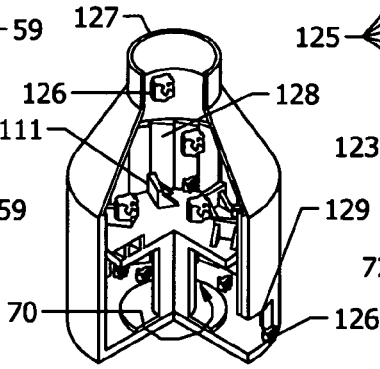
Fig. 14 Prior Art

Referring now to FIG. 13, a plan view of a prior art centrifugal rock crusher with a section line AB-AB associated with FIG. 14 is shown. The rock crusher hurls rocks (126) against an impact surface by supplying said rock through a central feed or intake passageway (127) and engaging said rock with a rotating impellor.

Referring now to FIG. 14, a cross-sectional isometric view of the prior art centrifugal rock crusher taken along line AB-AB of FIG. 13 is shown. FIG. 14 depicts a central passageway (127) that feeds rock (126) to an impellor (111), which rotates in the depicted direction (71A). The impellor (111) hurls rock against an impact surface (128), such that the engagement with the impellor (111) and/or surface (128) breaks the rock, which is then expelled through an exit passageway (129).

Referring now to FIGS. 15 to 39, various embodiments (65A-65F) of rock slurrification tools (65), that urge one or more impeller blades (111A-111H) and/or eccentric blades (56A, 56C), which can be secured to the first wall (50) or additional walls (51A-51U) and engaged with the strata wall (52), are shown. The first wall (50) is rotated for urging one or more additional impeller blades (111A-111C), wall engagement blades (111D-111H) and/or eccentric blades (56A, 56C), which are secured to either said first wall (50) or an additional wall (51B, 51K, 51M) disposed about said first wall and driven by a gearing arrangement between said first wall (50) and an additional wall (51A, 51C-51J, 51N-51U) engaged to the strata wall with wall securing blades (111D-111H). The additional wall (51B, 51K, 51M), that is disposed between the first wall (50) and additional wall (51A, 51C-51J, 51N-51U) engaged with the strata wall can rotate via a geared arrangement in the same or opposite rotational sense and can have secured blades (56A, 56C, 111, 111A-111C) for impelling rock debris, or to act as an impact surface for impelled rock debris. Engagement of higher density rock debris particles with impeller blades (111, 111A-111C) or eccentric blades (56A) impacts and breaks and/or centrifugally accelerates said higher density elements toward impact walls and impeller blades.

Relative rotational speeds and directional senses between impeller blades (111A-111C), wall engagement blades (111D-111H), eccentric blades (56A-56C) and/or impact walls (50, 51, 51A-51U, 52) can be varied to increase breakage rates and/or to prevent fouling of tools with compacted rock debris.

Referring now to FIG. 15, a cross sectional plan slice view, with dashed lines showing hidden surfaces, of an embodiment (65A) of the rock slurrification tool (65) is shown. The Figure depicts slurry being pumped axially downward through the internal passageway (53) and returned through the first annular passageway (55) between the rock slurrification tool (65) and the passageway through subterranean strata (52). The rock slurrification tool (65) acts as a centrifugal pump taking slurry from said first annular passageway (55), through an intake passageway (127), and into an additional annular passageway (54) where a blade of the impeller (111) impacts and urges the breakage and/or acceleration of dense rock debris particles (126) toward an impact wall (51H) having impact surfaces (123) for breaking said accelerated dense rock debris particles (126). Engagements between the blades of the impeller (111), rock debris particles (126) and impact walls (51H) continue until said slurry is expelled through an exit passageway (129). The impact wall (51H) has a spline arrangement (91) for rotating the eccentric bladed wall (56A) and may be removed if the eccentric wall forms part of the protective lining of a dual wall string (51) or managed pressure conduit assembly (49 of FIGS. 145-166).

Figures 22, 23, 24, 25:
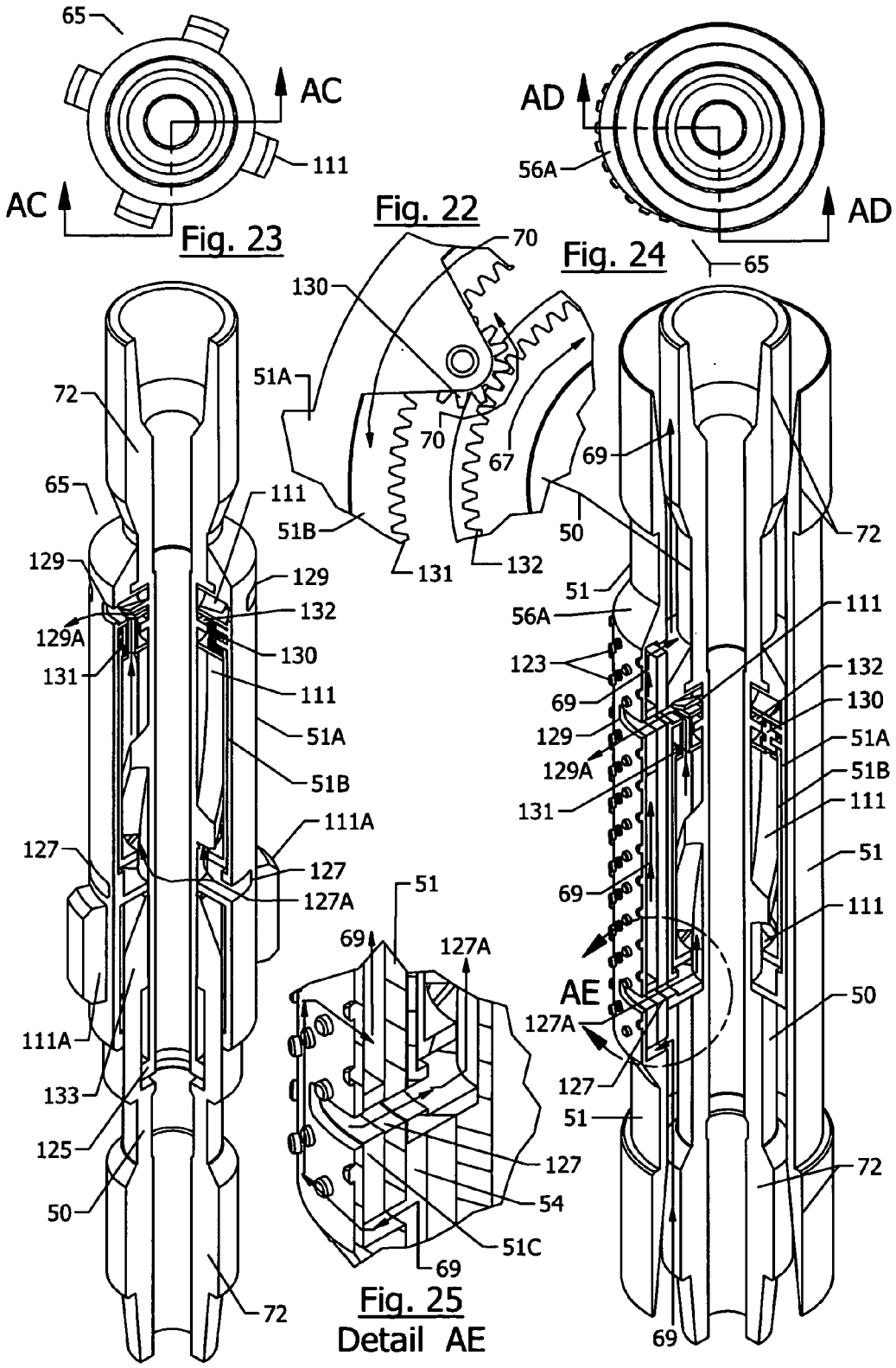

In various embodiments of the invention, the additional inner wall (51B) of FIGS. 15 and 21-22, 51K of FIG. 23, 51M of FIGS. 24-25), secured blades of an impellor (111), adjustable diameter blades (e.g., 111H of FIG. 23) and/or expulsion impellor blades (111A, 111B and 111C of FIGS. 23-24 and 32), can be rotated through a connection to the rotated first conduit string (50), to a positive displacement fluid motor that can be disposed axially above or below and secured to said additional wall, to a gearing arrangement between a blade of impellor (111) or an additional wall (51A of FIGS. 18 and 21-22, 51J of FIG. 23, 51M of FIGS. 24-25, 51U of FIGS. 27-29) and another wall engaged to the strata wall with a wall engagement blade (111D of FIGS. 18 and 21, 111G of FIG. 22, 111H of FIGS. 23 and 111E of FIGS. 33-39) or eccentric blade (56A of FIG. 15, 56C of FIGS. 24-25), or combinations thereof. The impact surface (123) may comprise or be engaged to the additional wall (51H) as shown in FIG. 15, (51R) of FIGS. 33 and 35-39, and (51T) of FIG. 34, that is shown secured to the strata wall (52). A blade of the impellor (111) and/or the additional wall (51B, 51K and 51M) can be rotated within another additional wall (51A, 51J, 51N) or the lining (51V) that is engaged to the strata wall (52) with a wall engagement blade (11D, 111G, 111H and 111E), using a conduit string (50, 51), a motor, and/or a gearing arrangement, for example, as shown in FIGS. 18 to 25, in the same or opposite directional sense relative to the first conduit string (50).

Referring now to FIGS. 16 and 17, isometric views of embodiments (123A, 123B, respectively) of usable shapes of impact surfaces (123) are shown, which can be engaged to various embodiments of an impact wall (51, 51A-51T), a blade and/or a bushing, such as that of FIG. 15, or cutters of FIGS. 5 to 12. The impact surfaces may be constructed from any generally rigid material usable within a downhole environment, such as hardened steel or PDC technology. FIG. 16 depicts an impact surface (123) having a rounded shape (123A), while FIG. 17 depicts an impact surface (123) having a pyramid shape (123B). However, it should be noted that impact surfaces (123) having any shape (e.g. 123A-123H) are usable depending upon the nature of the strata being bored or broken.

Referring now to FIG. 18, an isometric view, with a quarter of the strata wall removed, showing a slice of a member part of an embodiment (65B) of the rock slurrification tool (65) of FIG. 21 is depicted. The Figure shows the engagement of vertical blades (111D) having an impact surfaces (123) embodiment (123G) with the wall of the passageway through subterranean strata (52). The depicted engagement serves to urge the gearing arrangement (130), that can be secured to the additional wall (51A), to a near stationary state while slurry can be urged through the first annular passageway (55) between the rock slurrification tool member part and the strata wall (52). The slurry is urged at a higher ECD from the fluid friction of the passageway (55) restriction, caused by the blade (111D) engagements with the strata wall (52), to pressure compact LCM from the slurrification pump discharge exit passageways (129 of FIGS. 20-21).

Referring now to FIG. 19, an isometric view of a member part of an embodiment (65B) of the rock slurrification tool (65) of FIG. 21 is shown. In FIG. 21, a first wall (50), with an internal passageway (53) used for urging slurry, is rotated (67), and a secured gear (132) and an engaged impeller (111) are also rotated (67) in opposition to an additional wall (51B of FIG. 20).

Referring now to FIG. 20, an isometric view of a member part of an embodiment (65B) of the rock slurrification tool (65) of FIG. 21 is depicted. The Figure shows an additional wall (51B) with stepwise (123C) impact surface (123) and a gearing arrangement (131), having an intake passageway (127) at its lower end and discharge orifices or discharge exit passageway (129) within its walls. The additional wall (51B) can be rotatable (71A) to prevent fouling and to improve the relative speed of impact between a blade of an impeller (111 of FIG. 19), rock debris and the additional wall (51B), further urging the breakage of rock and increasing the propensity to create LCM sized particles.

Referring now to FIG. 21, an isometric view of an embodiment (65B) of a rock slurrification tool (65) constructed by engaged member parts of FIGS. 18 to 20 is shown. The Figure includes a one-half section of the gearing arrangements (130) of FIG. 18 and a three-quarter section of the additional wall (51B of FIG. 20), illustrating that the relative rotational speed between the blade of the impeller (111) and the additional impact wall (51B) may be increased by use of gearing arrangements (130, 131 and 132) to cause an opposite directional rotation (67 and 71A) of the blade of the impeller (111) and additional wall (51B), thereby increasing the relative impact speed of rock debris engaging the blade of the impeller (111) and an impact surface (123) embodiment (123C) of the additional wall (51B), further urging the breakage of rock and increasing the propensity to create LCM sized particles.

Referring now to FIG. 22, a partial plan view of a gearing rotational arrangement of an embodiment (65G) of the rock slurrification tool (65) is depicted, showing gearing arrangements (130, 131 and 132) for driving a gear arrangement (132) with a first wall (50) that is rotating (67) another gear arrangement (130), which is secured to an additional wall (51A) that is engaged with a blade (111G) to the wall of the passageway through subterranean strata. Rotation (71B) of the second gear arrangement (130) causes rotation of a third gear arrangement (131), which is secured to an additional wall (51B) rotated within the surrounding additional wall (51A) in a different direction (71A) to the first wall rotation (67).

Referring now to FIG. 23, a plan view of an embodiment (65C) of a rock slurrification tool (65), having associated line AC-AC, is shown above a cross sectional isometric view of an embodiment of the rock slurrification tool (65). Connectors (72) are shown for engagement of conduits of a single walled drill string at its upper and lower ends. An adjustable diameter blade (e.g., 111H), extending through a surrounding additional wall (51J), may be expanded or retracted by axially moving a wedging sleeve (133), thereby causing engagement and disengagement of the blade (111H) from strata walls when conduit string (50) compression is applied and removed, respectively. In use, engagement to the strata wall by the blade (111H) holds the surrounding additional wall (51J) to operate gears (130) for rotating the surrounding additional wall (51K) opposite to the conduit string (50) rotated impellor (111), and slurry containing rock debris is taken (127A) from the first annular passageway between the rock slurrification tool and the strata through an intake passageway (127) and slurrified with the opposing blade of the impellor (111) and surrounding additional wall (51K) rotation and internal (123F) impact surface (123). Then, the slurry is expelled (129A), from a discharge exit passageway (129), back to the first annular passageway, after having urged the breakage of said rock debris into LCM size particles within. A telescoping splined thrust bearing arrangement (125) is also shown within the rock slurrification tool for enabling the wedging sleeve (133) to be engaged to the first wall (50) with the spline driving the lower rotary connection (72) and associated apparatus, for example a strata boring bit. An additional expulsion impellor (111A) is included above gearing (130, 131) driving the rotated inner additional wall (51K) to aid passage of and prevent fouling of the expulsion passageway.

Referring now to FIG. 24, a plan view of an embodiment (65D) of a rock slurrification tool having associated line AD-AD is shown above a cross sectional isometric view. Connectors (72) are depicted for engagement with conduits of a dual walled drill string at its upper and lower ends. An eccentric blade (56C) with internal (123F) and external (123H) impact surfaces (123), can be engaged with walls within the strata. In use, slurry containing rock debris is taken (127A) from the first annular passageway between the rock slurrification tool and the strata through an intake passageway (127) and expelled (129A), from a discharge exit passageway (129), back to the first annular passageway, after having urged the breakage of said rock debris into LCM size particles within. The depicted embodiment also has intake (127) and expelling (129) passageways within the eccentric blade (56C) isolated by additional partial wall (51C) from slurry passing axially upward (69) through said eccentric blade and between the inner wall of said eccentric blade and the additional adjacent wall (51N) around the additional partial wall (51C) to fluidly communicate between the additional annular passageways above and below the tool. The internal slurrification member part may also be removed, leaving the eccentric blade (56A) and containing wall as a part of the outer dual string wall (51).

Referring now to FIG. 25, a magnified detail view of a portion of the rock slurrification tool within line AE of FIG. 24 is depicted. The Figure shows the intake passageway (127) and flowing arrangement about said intake passageway of the axially upward flow (69) in the intermediate additional annular passageway (54) and through the passageway in the eccentric blade (56C). The additional wall (51C) can be moved axially upward during retrieval of the internal slurrification member part of the additional wall (51M) leaving the wall (51M) and the eccentric blade (56C) secured to the additional lining, thereby covering and closing the intake (127) and expulsion (129) passageways within said eccentric blade.

Figures 26, 27, 28, 29, 30, 31, 32, 33, 34:
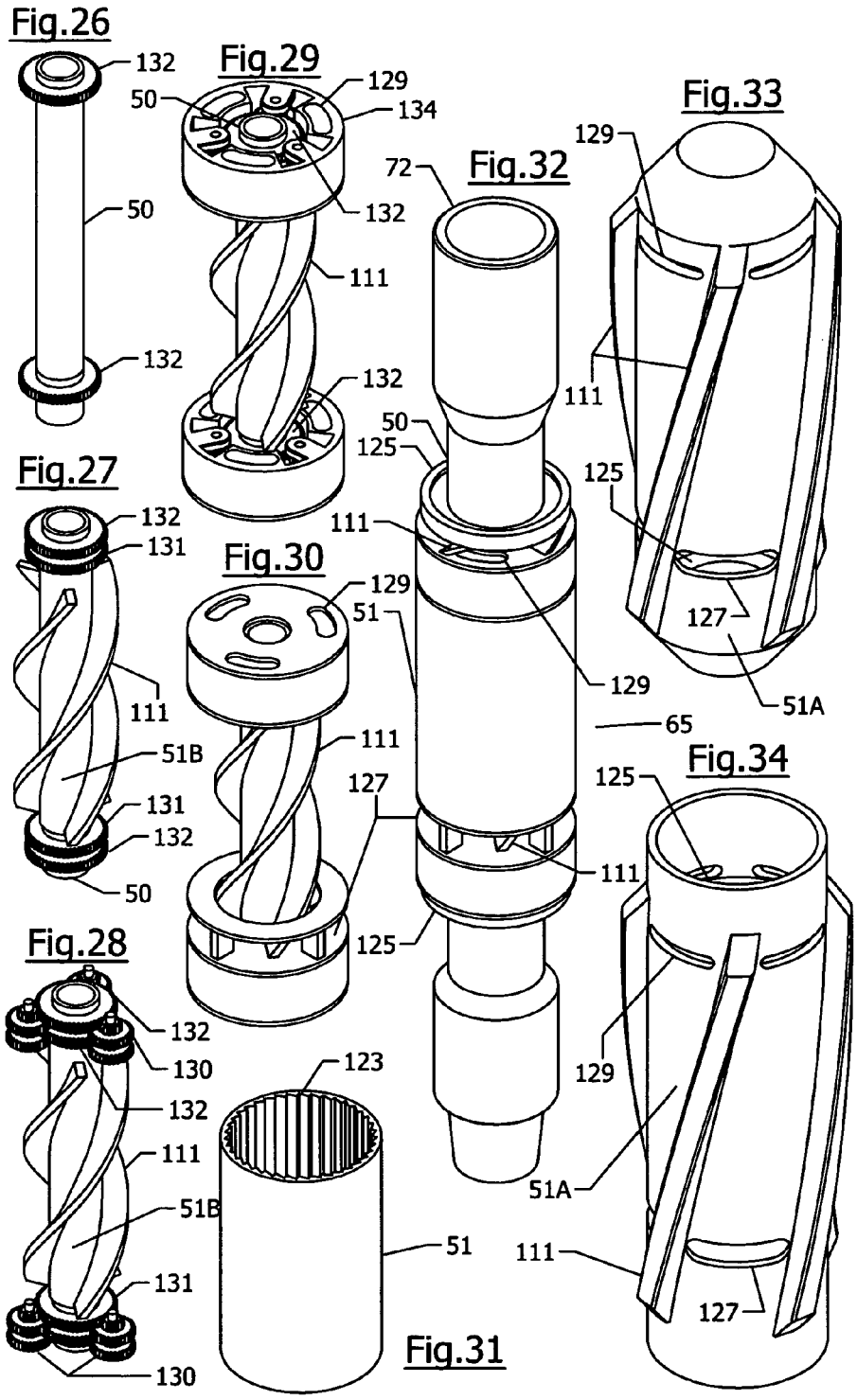
FIGS. 26 to 31 depict member parts of an embodiment of a rock slurrification tool in stages of engaging said member parts of said tool, wherein parts are engaged sequentially from FIG. 26 to FIG. 30, with the resulting assembly show in FIG. 30 sized for engagement within the impact wall of FIG. 31.
FIG. 32 illustrates an embodiment of the present invention rock slurrification tool comprised of the member parts of FIGS. 26 to 31 wherein the impact wall of FIG. 31 is disposed about the internal member parts of FIG. 30 with rotary conduit connections and thrust bearing surfaces engaged to both ends for engagement to a conduit drill string disposed within subterranean strata.
FIGS. 33 to 34 depict embodiments of member parts of a rock slurrification tool that can be combined with the rock slurrification tool of FIG. 32, wherein the tool of FIG. 33 may be engaged with a single wall conduit drill string and the tool of FIG. 34 may be engaged with a dual walled conduit string having an outer conduit string engaged to the ends of the member of FIG. 34, and wherein the tool of FIG. 32 can be retrieved with the internal string.

Referring now to FIG. 26, an isometric view of a member part of the wall of the first conduit string (50) subassembly of the rock slurrification tool shown in FIGS. 35 to 39 is depicted, wherein a gear assembly (132A) is engaged to the first conduit string (50).

Referring now to FIG. 27, an isometric view of an additional wall (51U), having a blade of an impeller (111) and gear assembly (131A) thereon, is shown disposed about the first conduit string (50) subassembly shown in FIG. 26. The depicted additional walls (50, 51U) are member parts of the rock slurrification tool (65) shown in FIGS. 35 to 39. The additional wall (51U) and gear assembly (131A) may rotate independently of the first wall (50) and gear assembly (132A).

Referring now to FIG. 28, an isometric view of a member gear arrangement (130A), engaged with the additional wall (51U) gears (131A) and first conduit string (50 of FIG. 27) gears (123A), subassembly shown in FIG. 27 is depicted. In the Figure, said subassemblies are member parts of the embodiment (65F) of the rock slurrification tool (65) shown in FIGS. 35 to 39. The gear assembly (132A) engaged to the first conduit string (50), is engaged with and turns the gearing arrangement (130A), which in turn is engaged with and turns the gear assembly (131A), which is secured to the additional wall (51U) disposed about the first conduit string (50), to increase the speed at which said additional wall and blades of the impeller are rotated.

Referring now to FIG. 29, an isometric view of a gear housing (134) member part, that is engaged with the gear arrangement (132A), additional wall (51U) and first conduit string (50) subassembly shown in FIG. 28 is shown. In said Figure, said subassemblies are member parts of the embodiment of the rock slurrification tool (65) shown in FIGS. 35 to 39, and the gear housing secures the gearing arrangement (132A).

Referring now to FIG. 30, an isometric view of the intake passageway (127) and expulsion passageway (129) member parts are shown engaged to the gear housing (134), additional wall (51U) and first conduit string (50) subassembly shown in FIGS. 28 and 29. In the FIG. 29, said subassemblies are member parts of the embodiment of the rock slurrification tool (65), shown in FIGS. 35 to 39. The intake passageway (127) is usable to urge slurry containing rock debris to impact with the blade of the impellor (111) after which slurry and broken rock debris are expelled through the expulsion passageway (129) and returned to the passageway from which they were taken.

Referring now to FIG. 31, an isometric view of an embodiment of an additional wall (51Q) having impact surfaces (123) embodiment (123C) for engagement with the subassembly of FIG. 30 is depicted, wherein said stepwise impact surfaces (123) are used for engaging dense rock debris particles impelled within slurry.

Referring now to FIG. 32, an isometric view of an embodiment (65E) of a rock slurrification tool (65) is shown, having the external impeller or eccentric blades removed. The depicted embodiment includes the member part of FIG. 31 disposed about the member parts shown in FIG. 30 with conduit connectors (72) at distal ends of a first conduit wall (50). The addition of the external impeller bladed arrangement shown in FIG. 33 to the depicted embodiment creates the rock slurrification tool (65) shown in FIGS. 35 to 39. The rock slurrification tool (65) can also include thrust bearings (125) and additional impeller blades (111C) to further urge slurry from the expulsion passageway (129) and prevent fouling of said passageway.

Referring now to FIG. 33, an isometric view of an additional wall (51R) with an intake passageway (127) for suction and a discharge exit passageway (129) is shown, having external wall engagement blades (111E) disposed thereon and associated thrust bearings (125). When assembled with the member part of FIG. 32, the rock slurrification tool (65) of FIGS. 35 to 39 is created.

Referring now to FIG. 34, an isometric view of an alternate embodiment of an additional wall (51T) having intake passageways (127) for suction and discharge exit passageways (129), that can be engaged with associated thrust bearings (125), as depicted in FIG. 32 for engagement with dual walled drill strings, is depicted. The distal ends of said additional wall (51T) can be engaged with the walls of a dual wall string, such as shown in an embodiment of the managed pressure conduit assembly (49 of FIGS. 145 to 166), with the first walls (50) of FIG. 32 engaged to the first conduit string walls of the depicted managed pressure conduit assembly. If an intermediate passageway is required, by-pass passageways through orifices in the blade (111F) may be present to route an intermediate annular passageway around the rock slurrification (58) internal components shown in FIG. 32, which can be retrieved with the inner string after placement of the outer string of said dual wall string.

Figures 35, 36, 37, 38, 39:
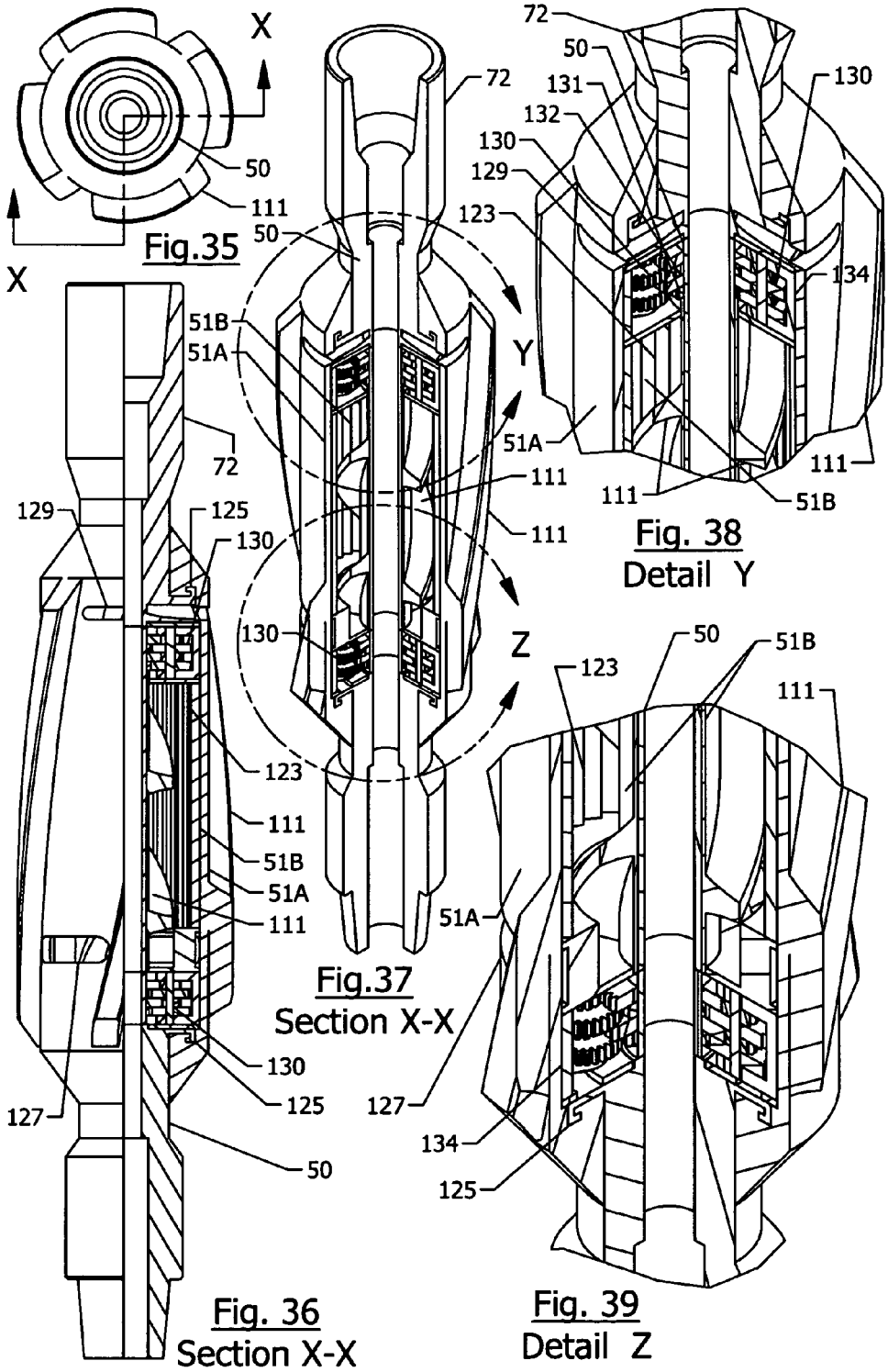
FIGS. 35 to 39 illustrate of the tool of FIG. 32 engaged with the member part of FIG. 34 to create a rock slurrification tool for a rotary single walled conduit string.

Referring now to FIG. 35, a plan view of an embodiment (65F) of the rock slurrification tool (65) constructed from the member parts shown in FIGS. 32 and 33, is shown, wherein a section line X-X is included for defining views depicted in FIGS. 36 to 39.

Referring now to FIG. 36, a cross sectional elevation view of the rock slurrification tool shown in FIG. 35 is depicted along line X-X. In the Figure, a wall of the first conduit string (50) having thrust bearings (125), is engaged to an outermost nested additional wall (51R) having larger intake passageways (127) and smaller expulsion passageways (129) for slurry and rock debris intake and pumped pressurized fluid expulsion, respectively. In addition, a gearing arrangement (130A) is shown engaged with a gear housing (134 of FIG. 38) that is secured to said outermost additional wall (51R), having wall engagement blades (111E) for engagement with the strata wall. The depicted upper and lower connectors (72) can be engaged with a single walled drill string for pumping slurry through its internal passageway to be returned between the rock slurrification tool and the strata wall, carrying rock debris that is urged to LCM sized particles by impact of the blades of the impeller (111) and additional wall (51Q), after which it is expelled through an expulsion passageway (129) for immediate pressurized fluid application against the strata wall to reduce the propensity of initiating or propagating fractures.

Referring now to FIG. 37, an isometric view of the rock slurrification tool shown in FIG. 36 is depicted, with the inclusion of detail lines Y and Z. FIG. 37 depicts the internal members of the rock slurrification tool, including the gearing arrangement (130A) secured to the additional wall (51R) and used to rotate the internal blades of the impeller (111) about the first wall (50).

Referring now to FIG. 38, a magnified isometric view of the region of the tool of FIG. 37 within detail line Y, is shown. The Figure depicts the upper gear transmission comprising a gear assembly (132A) secured to the rotated wall of the first conduit string (50), which transmits rotation to a gearing arrangement (130A) within a housing (134), that is shown secured to an outermost additional wall (51R) engaged to the strata via external blades of the impeller (111). Freewheeling gears, disposed about the first conduit wall (50), and gearing ratios are used to increase the speed of rotation of said gearing arrangement (130A) to transmit a significantly increased rotational speed to the gear (131A), which is secured to an internal impeller blade (111) and additional wall (51U) disposed and rotating about said internal wall (50). The significantly increased rotational speed of the internal impeller blade and its subsequent contact with rock debris against near stationary stepped profile impact surfaces (123) of the additional wall (51Q), which are engagable to the passageway through subterranean strata through the outermost wall engagement blades (111E), significantly increases the creation of LCM sized particles expelled from an expulsion passageway (129) for engagement with strata wall.

Referring now to FIG. 39, a magnified isometric view of the region of the tool of FIG. 37 within detail line Z is shown. The Figure depicts the lower gear transmission housing (134) and suction orifice or intake passageway (127) arranged to urge slurry to a centralized initial engagement with the blade of the impeller (111) to increase the efficiency of centrifugally accelerating rock debris toward stepwise (123C) impact surfaces (123).

Figures 40, 41, 42, 43, 44, 45, 46, 47, 48:
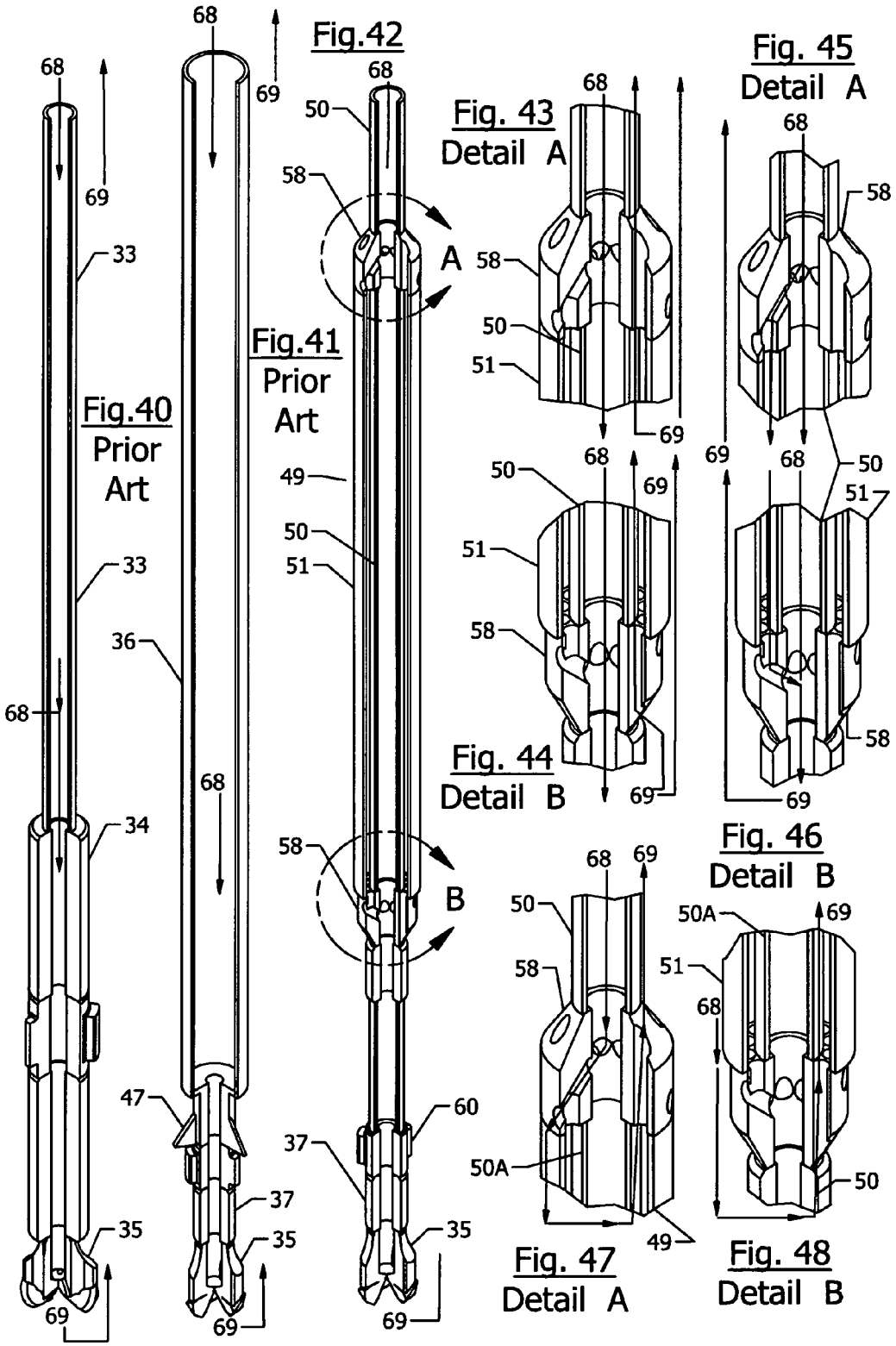
FIGS. 40 to 41 depict single walled drilling and casing drilling strings respectively illustrating the conventional urging of slurry axially downward and axially upward.
FIG. 42 illustrates an embodiment of two slurry passageway tools engaged at distal ends of a dual walled conduit string having a Detail Line A and B identifying upper and lower slurry passageway tools respectively.
FIGS. 43 to 48 illustrate magnified Detail A and B views of the upper and lower slurry passageway tools of FIG. 42 respectively, wherein the urging of slurry axially downward and axially upward is identified with FIGS. 43 and 44 depicting conventional drill string slurry flow emulation, FIGS. 45 and 46 depicting casing drill string flow emulation, and FIGS. 47 and 48 depicting circulation axially downward between the tools and the passageway within which it is disposed with axially upward flow through an internal passageway.

Referring now to FIG. 40, a three quarters sectional isometric view of a prior art drilling string (33), with bottom hole assembly (34) and drilling bit (35) at its distal end, is depicted, showing its internal passageway with a one quarter section removed identifying the normal circulation of slurry in an axially downward direction (68) and axially upward direction (69).

Referring now to FIG. 41, a three quarters isometric sectional elevation view of a prior art casing drilling string (36), with bottom hole assembly (37) and hole opener (47), is shown, with a drilling bit (35) at its distal end. The internal passageway of the casing drilling string is shown with a one quarter section removed, such that the normal circulation of slurry in an axially downward direction (68) and axially upward direction (69) is visible.

Referring now to FIGS. 42 to 72, FIGS. 88 to 118 and FIGS. 121 to 124, embodiments of a slurry passageway tools (58) are shown, which are usable to control connections between conduits and passageways of a single or dual wall string to provide a selectively controllable managed pressure conduit assembly (49).

Referring now to FIG. 42, a three quarters isometric sectional elevation view, which includes detail lines A and B, is shown, depicting an embodiment of a managed pressure conduit assembly (49) including an upper slurry passageway tool (58, 58A) and a lower slurry passageway tool (58, 58B) at distal ends, with an intermediate dual wall string comprising an intermediate annular passageway (54), between an outer string (51) surrounding an inner string (50), with an internal passageway (53). The inner string or first conduit string (50) can comprise a bore and can extend longitudinally through a proximal region of a subterranean passage (52) for defining the internal passageway (53) through the bore. The outer string or larger diameter additional conduit string (51) can extend longitudinally through said proximal region of said passageway and can protrude axially downward, from an outermost protective conduit string lining and said proximal region, thereby defining a first annular passageway member (55 of FIG. 15) between a wall thereof and a surrounding subterranean passageway wall (52).

Referring now to FIGS. 43 and 44, magnified detail views of the regions of FIG. 42 enclosed by detail lines A and B, respectively, depict the slurry passageway tools (58) of FIG. 42, showing slurry flow in an axially downward direction (68), with slurry returned in an axially upward direction (69) using radial extending passageways (75). The dual wall string or managed pressure conduit assembly (49) is usable to emulate the annular velocity and associated pressure of a conventional drilling string by circulating slurry axially downward through the internal passageway (53) and, then, axially upward through the additional annular passageway (54) and annular passageway surrounding the managed pressure conduit string, when extending or enlarging a passageway through subterranean strata.

Referring now to FIGS. 45 and 46, magnified detail views of the regions of FIG. 42 enclosed by detail lines A and B, respectively, depict the slurry passageway tools (58) of FIG. 42, showing slurry flow in an axially downward direction (68), with slurry returned in an axially upward direction (69)

using radial extending passageways (75). The depicted dual wall string or managed pressure conduit assembly (49) is usable to emulate the annular velocity and associated pressure of a conventional casing drilling string by circulating slurry axially downward through the internal passageway (53) and additional annular passageway (54) and, then, axially upward through the annular passageway surrounding the managed pressure conduit string, when extending or enlarging a passageway through subterranean strata.

Referring now to FIGS. 47 and 48, magnified detail views of the regions of FIG. 42 enclosed by detail lines A and B, respectively, depict the slurry passageway tools (58) of FIG. 42, showing slurry flowing in an axially downward direction (68), with slurry returning in an axially upward direction (69) using radial extending passageways (75). A single wall with the internal conduit (50A) can be removed, with the use of the upper (58A) and lower (58B) slurry passageway tools, from the dual walled string or managed pressure conduit assembly (49). This removal of the single wall of the internal conduit (50A) can leave the outer conduit (51), when, for example, it is used to cross-over the flow direction of circulated slurry at a slurry passageway tool to circulate slurry axially downward, first, through the internal passageway (53) and, then, axially downward through the first annular passageway, between the managed pressure conduit string and the passageway through subterranean strata, with axially upward flowing slurry returned through the additional annular passageway (54).

Referring now to FIGS. 49 to 55, isometric views of member parts of embodiments (58C, 58D, 58E, 58F and 58G) of a slurry passageway tool (58) are shown. The depicted embodiments are usable at the upper end of a string in a similar manner to that shown in FIG. 42. In the depicted embodiments, both conduit strings can be usable in dual walled string applications, or the lower rotary connection (72) can be a non-continuous internal string with the continuous larger outer string arrangement used in a single walled string application.

Figures 49, 50, 51, 52, 53, 54, 55:
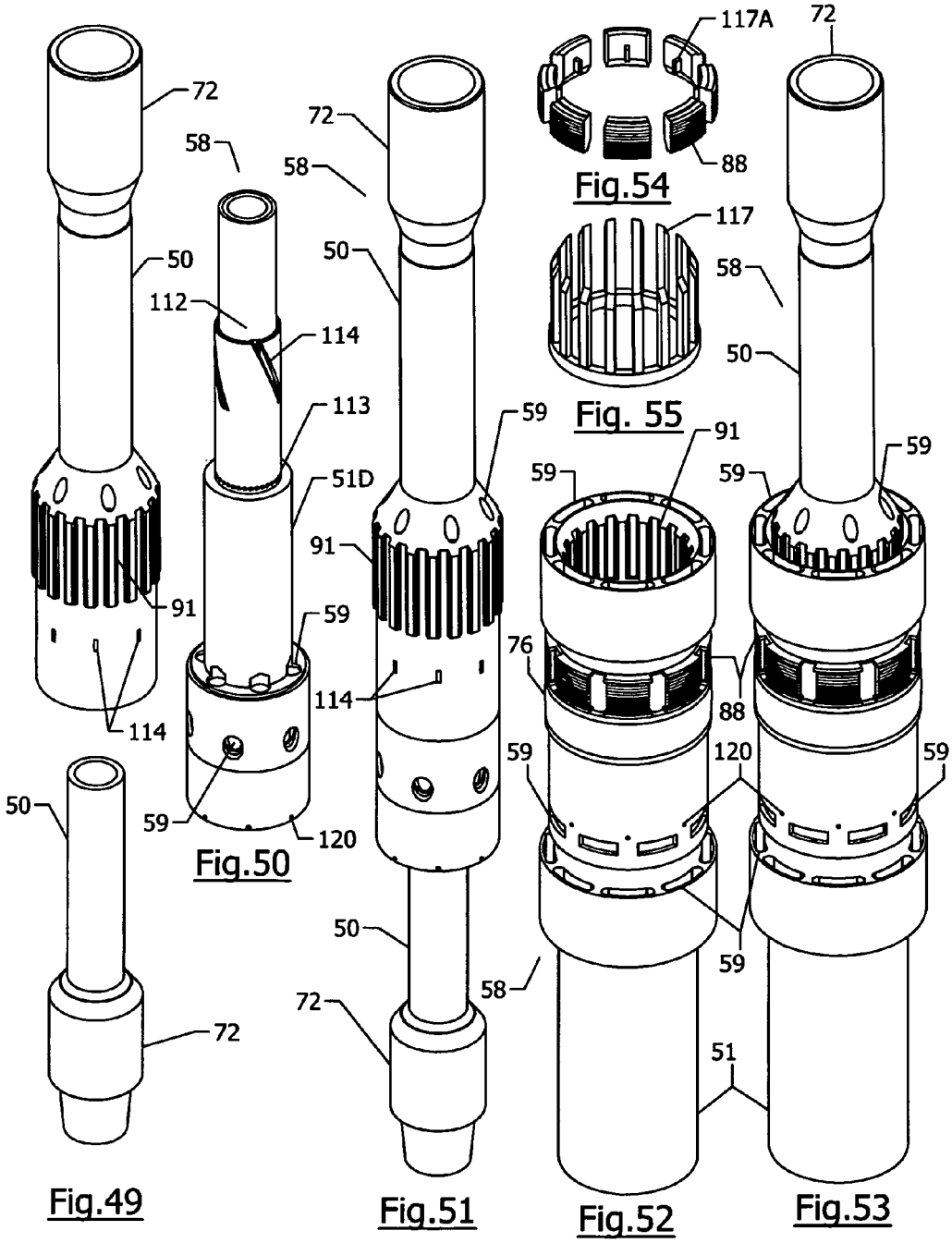
FIGS. 49 to 53 depict member parts of an embodiment of a slurry passageway tool assembly illustrating the stages of engaging said member parts, wherein members are engaged sequentially from FIG. 49 to FIG. 53, with the resulting assembly of FIG. 53 usable as a drill-in protective liner hanger or drill-in completion production packer disposed within and engaged to the wall of the passageway through subterranean strata.
FIGS. 54 to 55 illustrate member parts of the tool shown in FIGS. 52 to 53 used for engaging and differential pressure sealing the protective lining of FIG. 52 to the walls of the passageway through subterranean strata.

Referring now to FIG. 49, an isometric view of upper and lower member parts of an embodiment (58C) of a slurry passageway tool (58) are shown, having upper and lower connectors (72), an engagement receptacle (114A) and a spline engagement surface (91).

Referring now to FIG. 50, an isometric view of an embodiment (58D) of a slurry passageway tool (58), also shown in FIGS. 60 to 64, is depicted. The tool (58D) can include a lower extension with a shear pin arrangement (120) and orifices (59) engaged to additional walls (51D, also shown in FIGS. 68 and 70), which rotate and can include ratchet teeth (113, also shown in FIGS. 67 to 70) and receptacles (114, also shown in FIGS. 67 and 69), engaged with mandrels of a multi-function tool (112B of FIGS. 73 to 87).

Referring now to FIG. 51, an isometric view of an embodiment (58E) of a slurry passageway tool (58) is shown, having the member parts of FIG. 49 engaged with the internal slurry passageway tool (58D) of FIG. 50. The embodiment depicted in FIG. 51 creates a slurry passageway tool (58) having orifices (59), rotary drive couplings or rotary connections (72) for a single walled drill string, a spline engagement surface (91) for engagement to an another conduit wall, such as that depicted in FIG. 52 and engagement receptacles (114A) also usable for engagement with the conduit wall.

Referring now to FIG. 52, an isometric view of an embodiment (58F) of a slurry passageway tool (58) is shown, having a lower end additional wall (51) for engagement with a liner, casing or protective lining to be placed in a subterranean passageway. The depicted slurry passageway tool (58) has orifices (59) for passage of slurry and a flexible membrane (76) for choking the first annular. The depicted tool includes a securing apparatus (88) for engagement with the subterranean passageway. The securing apparatus (88) can be used to secure at least one an additional wall (51) of a larger diameter additional conduit string to the passageway through the subterranean strata (52), to extend the outermost protective conduit string lining of said passageway. An associated spline surface (91) can be engaged with a spline surface (91 of FIG. 51) of another slurry passageway tool (58E of FIG. 51) to create the slurry passageway tool assembly shown in FIG. 53.

Referring now to FIG. 53, an isometric view of an embodiment (58G) of a slurry passageway tool (58) constructed by disposing a slurry passageway tool (58E of FIG. 51) spline surface (91 of FIG. 51) within a spline surface (91 of FIG. 52) of another slurry passageway tool (58 of FIG. 52). The resulting tool (58) may be used with a single conduit string if the low connector (72 of FIG. 51) is not needed for connection to an internal conduit string, or the internal string is not continuous. Alternatively, the tool (58) may be used with a dual walled string if the lower ends of said tool (58) are engaged to the associated inner and outer walls of a dual walled string. The embodiment of FIG. 53 can also be used or adapted to function as a production packer of a completion when the internal passageways are arranged to suit the application.

Referring now to FIG. 54, an isometric view of a set of securing apparatuses (88) of the slurry passageway tool (58), shown in FIGS. 52 and 53, is shown. The depicted embodiment is usable for engagement with a passageway through subterranean strata, the slurry passageway tool (58) having mandrels (117A1) for engagement (117A) with associated receptacles (114A of FIG. 51) to secure one slurry passageway tool (58E of FIG. 51) with a second slurry passageway tool (58F of FIG. 52) to form a third slurry passageway tool (58G of FIG. 53). The internal slurry passageway tool (58E of FIG. 51) can be released from the external slurry passageway tool (58F of FIG. 52) using a sliding (117) engagement mandrel (117W of FIG. 55) to engage the securing apparatus (88) to a passage through the subterranean strata, which retracts the mandrels (117A1) from the associated receptacles (114A of FIG. 51).

Referring now to FIG. 55, an isometric view of a set of sliding (117) mandrels (117W) for actuation of securing apparatus (88 of FIG. 54) is shown. Pressure can be applied to the ring at the lower end of said sliding mandrels (117) for engaging behind an associated securing apparatus (88 of FIG. 54), which can cause engagement of the securing apparatus with the passageway through subterranean strata and disengagement of the secondary sliding engagement mandrels (117A of FIG. 54) from a receptacle (114A of FIG. 51), releasing the member part of FIG. 52 from the member part of FIG. 51.

Referring now to FIGS. 56 to 59, isometric views of member parts of embodiments (58H, 58I, 58J and 58K) of a resulting slurry passageway tool (58M of FIG. 59) are shown. The depicted embodiments are usable at the lower end of single or dual walled strings in a similar manner to that shown in FIG. 42. Both conduit strings can be used in dual walled string applications, or alternatively, only the outer string could be used in single walled string applications. The embodiment of the slurry passageway tool shown in FIG. 59 can be used as a drill-in casing shoe, wherein the flexible member is inflated to prevent u-tubing of cement.

Figures 56, 57, 58, 59:
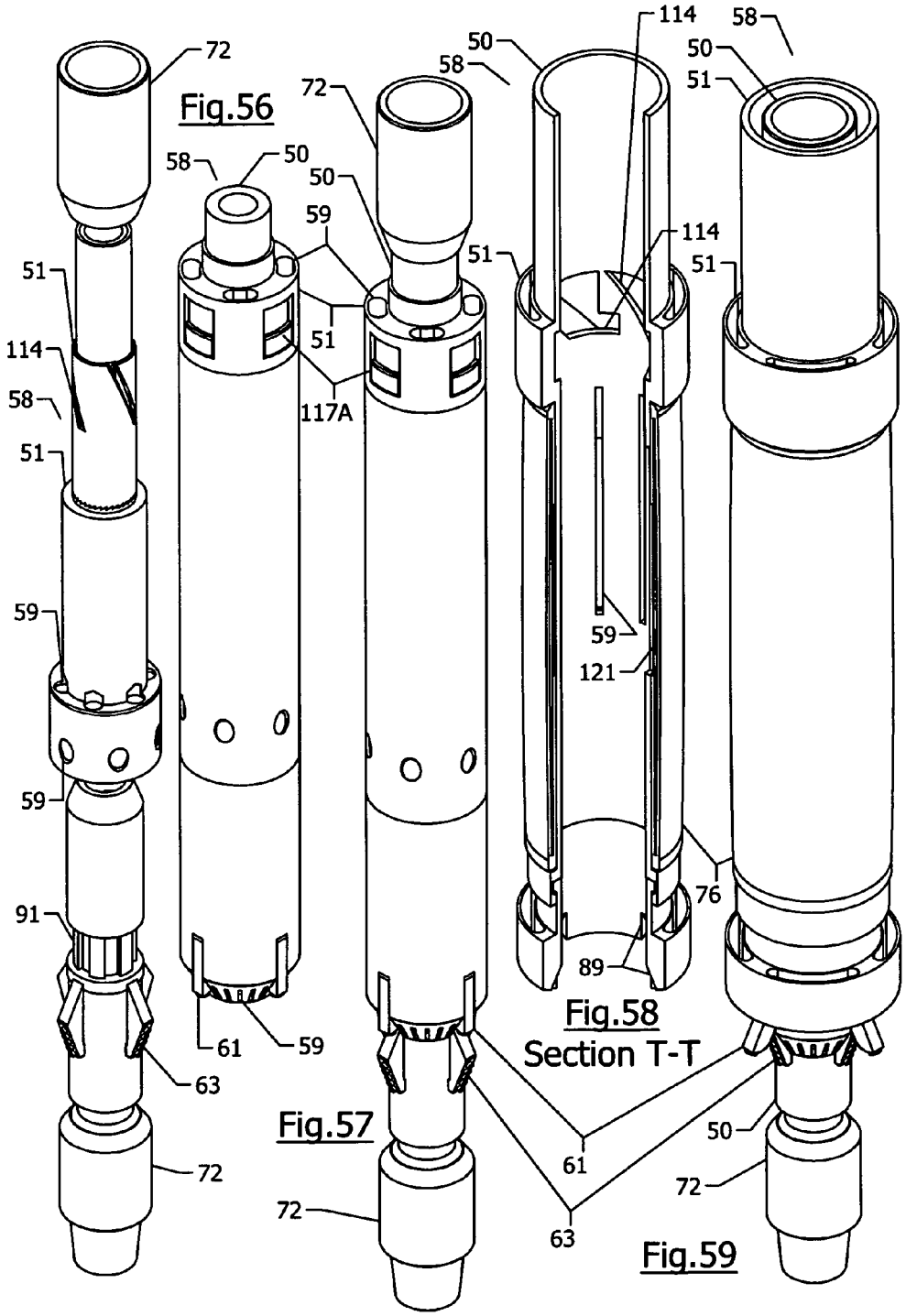
FIGS. 56 to 59 depict member parts of an embodiment of a slurry passageway tool assembly illustrating the stages of engaging said member parts, wherein members are engaged sequentially from FIG. 56 to FIG. 59, with the resulting assembly of FIG. 59 usable as a drill-in protective casing shoe preventing the u-tubing of cement and facilitating the release of the member shown in FIG. 57 for retrieval from or continued drilling of the passageway through subterranean strata.

Referring now to FIG. 56, an isometric view of member parts of an embodiment of a slurry passageway tool (58J of FIG. 57), having upper and lower rotary connectors (72) with an intermediate slurry passageway tool (58H) is shown. The Figure shows a telescoping spline surface (91) that allows a first stage (61A) bore enlargement apparatus (63, 63B) to move axially. This movement extends a second stage bore enlargement apparatus (61B), which includes a slurry passageway tool (581) having a rotatable additional wall (51D) with receptacles (114B) of an associated multi-function tool (112B), and with orifices (59) and a sliding mandrel (117A) for engagement (117A2) with another slurry passageway tool (58K of FIG. 58) receptacle (114 of FIG. 58). The second stage bore enlargement apparatus (61B) can be engageable, extendable and retractable with the first stage bore enlargement apparatus (61A).

Referring now to FIG. 57, an isometric view of an embodiment (58J) of a slurry passageway tool (58) is shown, depicting the left and right member parts of FIG. 56 assembled, wherein the spline surface (91 of FIG. 56) is extended and the second stage bore enlargement apparatus (61B) is retracted to enable passage through the passageway through subterranean strata.

Referring now to FIG. 58, an isometric ¾ section view of an embodiment (58K) of a slurry passageway tool (58), with section line T-T of FIG. 88 removed is shown. The tool (58) includes mandrel receptacles that include a locating (114C) receptacle (114) for receiving associated mandrels (117A2 of FIGS. 56 and 57) within an additional wall (51T) with vertical orifices (59A), and outward orifices (59R) for transporting fluid to a check valve (121) that can be used to inflate a flexible membrane (76) and prevent deflation of said membrane. Receptacles (89) are shown at the lower end for engagement with an associated second stage (61B of FIGS. 56 and 57) bore enlargement apparatus (63).

Referring now to FIG. 59, an isometric view of an embodiment (58M) of the slurry passageway tool (58) created by engaging the slurry passageway tool (58J) of FIG. 57 with the associated slurry passageway tool (58K) of FIG. 58, is shown. In the Figure, the lower spline surface (91 of FIG. 56) is collapsed to extend the second stage bore enlargement apparatus (61).

Referring now to FIGS. 60 to 64, plan and isometric views of an embodiment (58D) of the slurry passageway tool (58) of FIG. 50 are shown, the depicted tool being usable to direct slurry in the manner described and depicted in FIGS. 43, 45 and 47. An embodiment (58H) of the slurry passageway tool (58), such as that shown in FIG. 56, is usable to direct slurry in a manner described and depicted in FIGS. 44, 46 and 48, by directing the radial extending passageways (75B) upward, as shown in (58H) of FIG. 93, instead of the downward orientation shown in FIGS. 61, 62 and 64. Internal member parts of FIGS. 60 to 64 are illustrated in FIGS. 65 to 70 and FIGS. 73 to 87.

Figures 60, 61, 62, 63, 64:
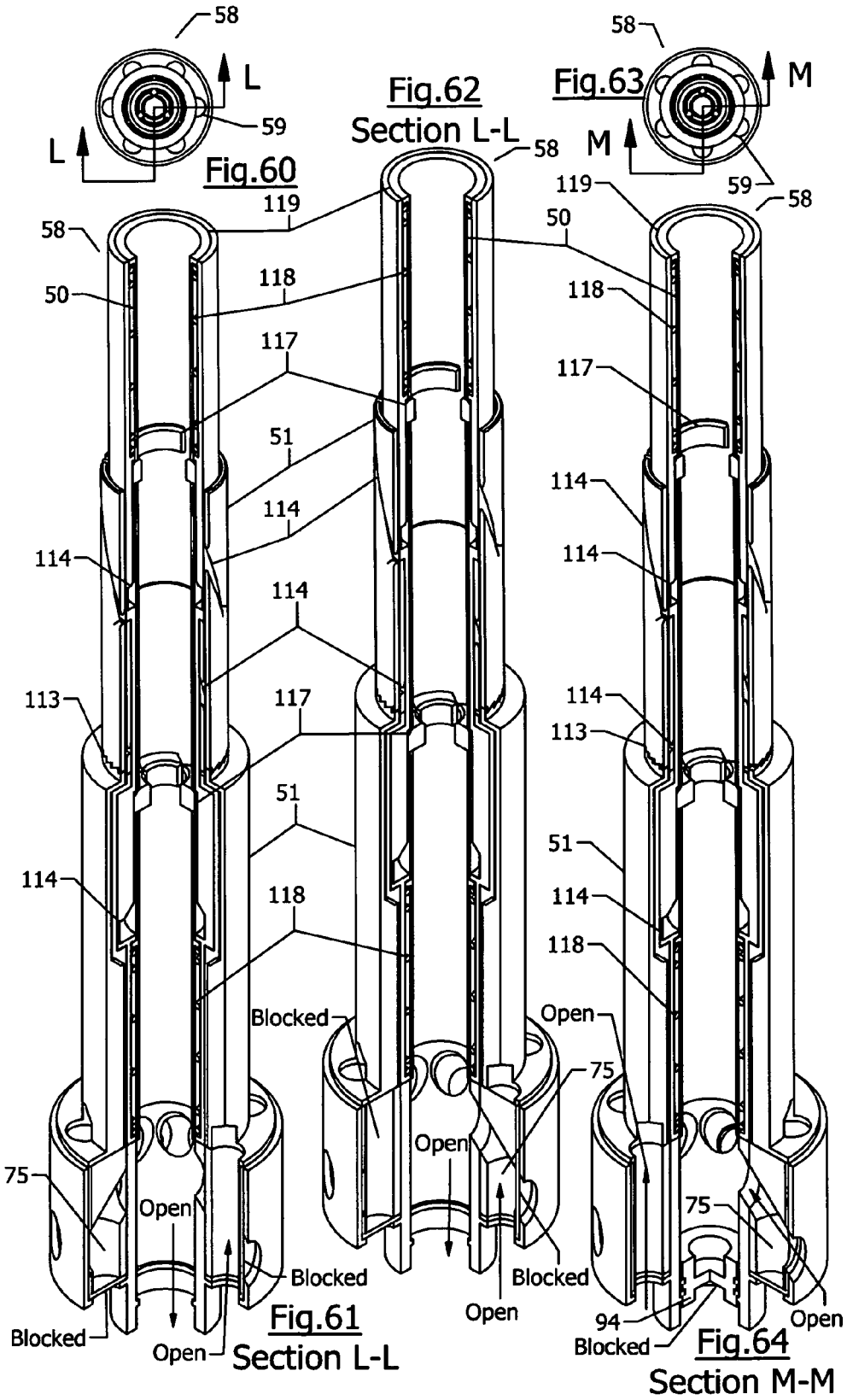
FIGS. 60 to 64 depict an embodiment of a slurry passageway tool shown as an internal member part in FIGS. 50, with FIGS. 60 and 63 depicting plan views having sections lines for the isometric sectional views shown in FIGS. 61, 62 and 64, which illustrate various arrangements of internal rotatable radially-extending passageways and walls with orifices used to divert slurry flow.

Referring now to FIG. 60, a plan view of the slurry passageway (58D) of FIG. 50 with a section line L-L is depicted.

Referring now to FIG. 61, an isometric view of the slurry passageway tool (58D) of FIG. 60 is shown, with the section defined by section line L-L removed. In FIG. 61, the internal rotatable additional walls and radially-extending passageways (75) of the tool are arranged to facilitate slurry flow through the internal passageway axially downward through the internal passageway, and axially upward through a vertical (75A) radial-extending passageway (75) connecting associated additional annular passageways, wherein radially-extending passageway (75B) is blocked. The depicted embodiment of the slurry passageway tool is thereby usable to emulate the annular velocity and associated pressure of a conventional drilling string annulus, in a manner similar to that shown in FIG. 43. The arrangements of the slurry passageway tool, depicted in FIGS. 61, 62, and 64, include sliding mandrels (117), which can engage associated receptacles (114) of the tool, and springs (118), located between a wall surface of a first conduit string (50) and a spring engagement surface (119), wherein the sliding mandrels (117) can be biased axially upward when not engaged.

Referring now to FIG. 62, an isometric view of the slurry passageway tool (58D) of FIG. 60 is shown, with the section defined by section line L-L removed. In FIG. 62, the internal rotatable additional walls and radially-extending passageways (75) are rotated from the view shown in FIG. 61 and arranged to block radial extending passageway (75A) blocked and to facilitate slurry flow through the internal and additional annular passageways axially downward in radially-extending passageway (75B), which is usable to emulate a casing drilling string's circulating pressures in a manner similar to that shown in FIGS. 45.

Referring now to FIG. 63, a plan view of the embodiment of the slurry passageway tool (58D) of FIG. 50 is shown, including a section line M-M, wherein the internal rotating walls have been rotated from the views shown in FIGS. 60 to 62.

Referring now to FIG. 64, an isometric view of the slurry passageway tool (58D) of FIG. 63 is shown, with the section defined by section line M-M removed. In FIG. 64, the internal rotatable additional walls and radially-extending passageways (75) are arranged to facilitate slurry flow from the internal passageway to the first annular passageway, the tool string, and the passageway through subterranean strata to emulate a reverse circulation arrangement similar to that shown in FIG. 47. In the reverse circulation arrangement, a blocking apparatus (94) can be used to prevent flow in the internal passageway below the depicted arrangement for diversion to radial-extending passageway (75B), and the vertical radially-extending passageway (75A) can be used to connect an associated additional annular passageway for returning circulated slurry flow to, for example, aid in the placement of cement or LCM or to manage pressure with gravity assisted axially downward flow in the first annular passageway.

Referring now to FIGS. 65 to 70, plan and isometric sectional views of the internal member parts of the slurry passageway tool of FIGS. 60 to 64 are shown, comprising walls, orifices and radially-extending passageways used to connect passageways of a conduit string and first annular space to urge fluid slurry in a desired direction.

Figure 65:
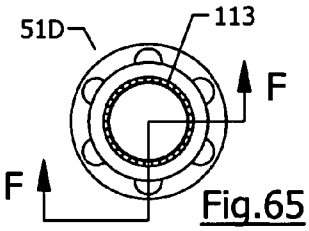
FIGS. 65 to 70 illustrate the rotatable member parts of FIGS. 60 to 64 showing radially-extending passageways and walls with orifices used to urge slurry.
Figure 66:
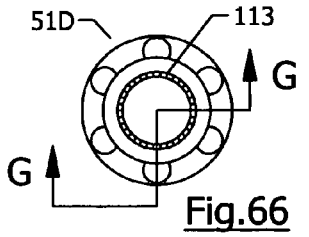

Referring now to FIGS. 65 and 66, plan views of additional walls (51D) are shown, including a larger additional wall (51DL of FIG. 65) used for enveloping a smaller additional wall (51DS of FIG. 66), having section lines F-F and G-G respectively. Orifices (59 of FIGS. 68 and 70) and radially-extending passageways (75 of FIG. 70) within the additional walls may or may not be coincident to permit fluid flow therethrough, depending on the rotational position of the smaller additional wall (51DS of FIG. 66) relative to the larger additional wall (51DL of FIG. 65).

Figure 67:
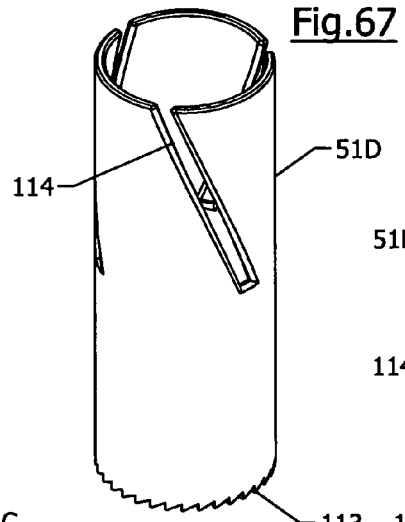
Figure 68:
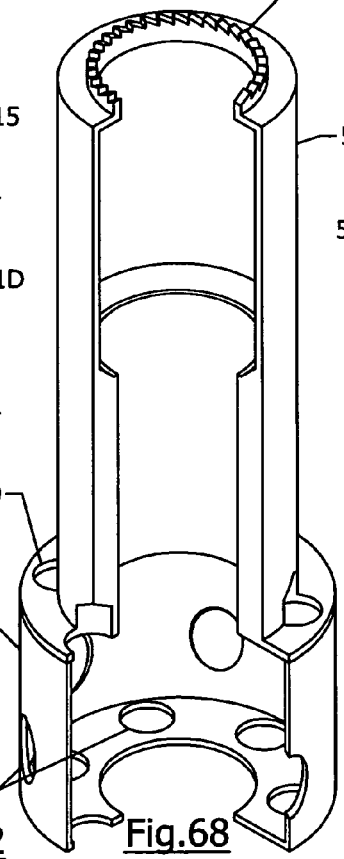

Referring now to FIG. 67, an isometric view of an embodiment (51DLU) of an upper larger additional wall (51D) engageable with an additional wall (51DL) of FIGS. 65 and 68, having a spiral receptacle (114) for receiving an associated mandrel is shown. The depicted additional wall includes ratchet teeth (113) at is lower end that can be engagable with associated ratchet teeth (113 of FIG. 68) of another additional wall.

Referring now to FIG. 68, an isometric view of the larger additional wall (51DL), as shown in FIG. 65, for surrounding a smaller associated additional wall (51DS of FIG. 70) is shown, with the section defined by section line F-F removed. The additional wall is shown having ratchet teeth (113) at its upper end for engagement with associated ratchet teeth (113 of FIG. 67) of another additional wall, and orifices (59) for communication between an internal space and surrounding external space through an associated smaller internal additional wall (51D of FIG. 70), when the depicted member parts are assembled.

Figure 69:
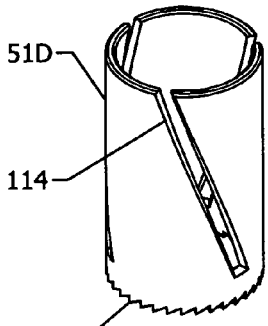

Referring now to FIG. 69, an isometric view of an upper smaller (51DSU) additional wall (51D) engageable with additional wall (51DS) of FIGS. 66 and 69, having spiral receptacles (114), is shown, usable for receiving associated mandrels. The depicted additional wall is shown having ratchet teeth (113) at its lower end engagable with associated ratchet teeth (113 of FIG. 70) for insertion within an associated larger additional wall (51D of FIG. 67), when the depicted member parts are assembled.

Figure 70:
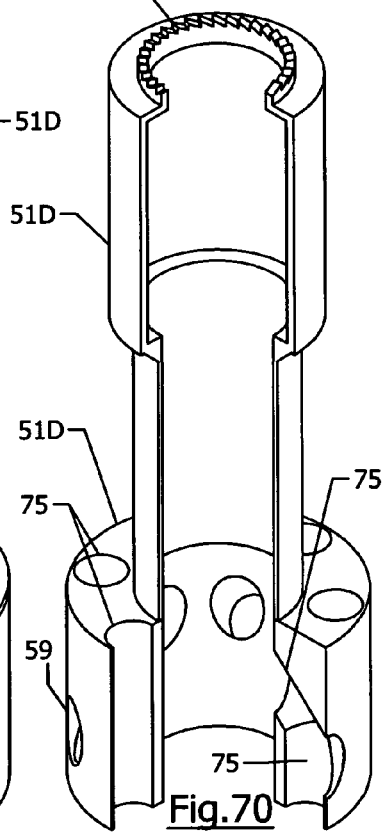

Referring now to FIG. 70, an isometric view of the smaller additional wall (51DS) of FIG. 66 is shown, with the section defined by section line G-G removed. The depicted additional wall is shown having ratchet teeth (113) at its upper end for engagement with associated ratchet teeth (113 of FIG. 69), radially-extending passageways (75) and orifices (59). When assembled, the depicted additional wall can be surrounded by an associated larger additional wall (51D of FIG. 68)

Figure 71:
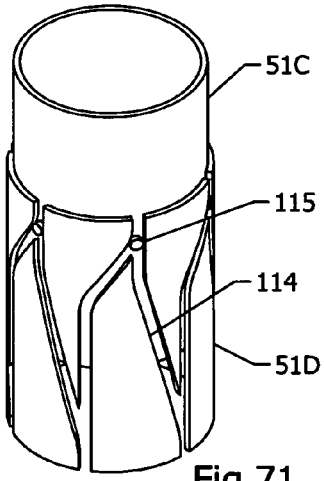
FIGS. 71 to 72 illustrate embodiments of alternative engagements to those of FIGS. 67 to 70 for rotating the lower portions of the member parts shown in FIGS. 68 and 70, wherein axially moving mandrels engaged in associated receptacles rotate the lower member parts of FIGS. 68 and 70 rather than the ratcheting teeth shown on the upper portion of said member parts.
Figure 72:
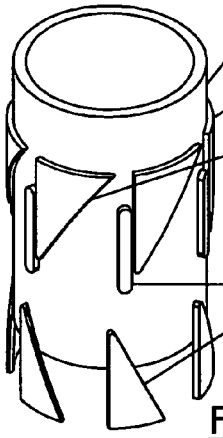

Referring now to FIGS. 71 and 72, isometric views of two embodiments (51DX, 51DY) for rotating additional walls (51D), that can rotate and include receptacles (114G, 114H, respectively), are shown. FIGS. 71 and 72 include arrangements (51CX, 51C&) with upper additional walls (51C) having secured (115) mandrels (115C, 115D, respectively) that can be moved axially downward and, then, upward to engage said mandrels with said receptacles (114) to rotate the additional walls (51D), that are associated with said receptacles around their central axis during said downward and, then, upward movement. These depicted embodiments can be secured to the upper ends of the additional walls (51D) of FIGS. 68 and 70, in place of the ratchet arrangement shown.

Referring now to FIGS. 73 to 87, an embodiment (112B) of a multi-function tool (112) and associated member parts is shown, wherein the assembled multi-function tool (112) of FIGS. 73 to 78 and FIG. 87 can be formed from the member parts shown in FIGS. 79 to 86. The embodiments shown in FIGS. 73 to 78 and FIG. 87, are also shown within the slurry passageway tool (58D) of FIGS. 61, 62 and 64, wherein engagement of an actuation tool with sliding mandrels (117) of said multi-function tool (112) can move secured mandrels (115) of the multi-function tool (112) axially downward and through engagement with associated receptacles (114, 114B of FIGS. 67 and 114C of FIG. 69), to cause rotation of internal additional walls (51D of FIGS. 68 and 70) through the ratchet teeth engagement (113 of FIGS. 67 to 70) with said additional walls (51D of FIGS. 68 and 70).

Figures 74, 76, 78:
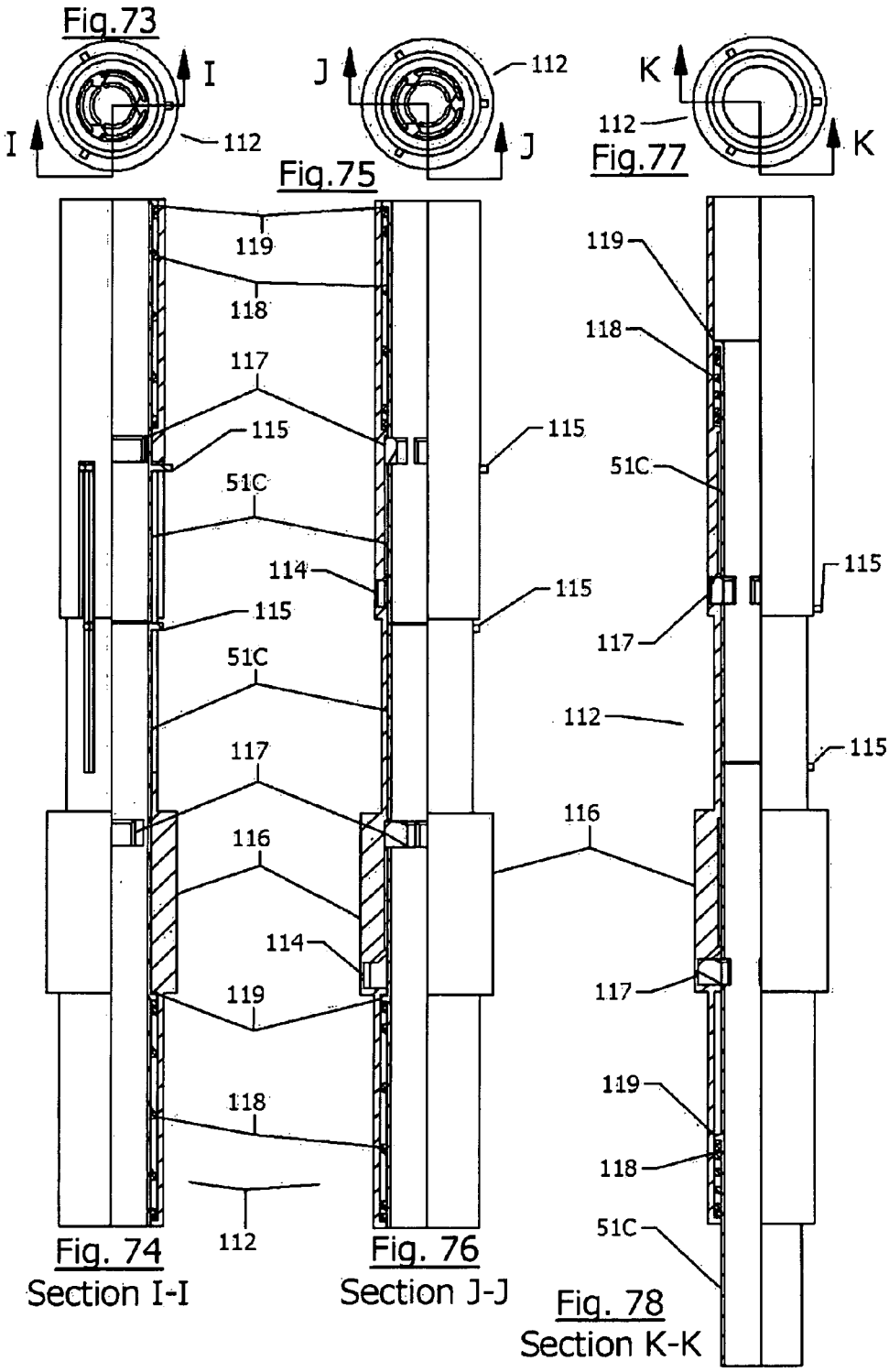

Referring now to FIGS. 73 to 76, FIGS. 73 and 75 depict plan views of an embodiment of a multi-function tool (112) in an un-actuated state with section lines I-I and J-J, respectively. FIGS. 74 and 76 depict elevation views of the multi-function tool (112) with the sections defined by section lines I-I and J-J, respectively, removed. A first upper additional wall (51C) arrangement (51CZ) and a second additional wall (51C) arrangement (51CW) are shown with secured protruding mandrels (115) extending through receptacles in a surrounding wall (116), disposed about said first and second additional walls. Sliding mandrels (117) extend through receptacles in the first upper additional wall (51C) and second additional wall (51CW) to engage associated receptacles (114) in the surrounding wall (116), and springs (118) between a surface of said surrounding wall (116) and a spring engagement surface (119) on said first and second additional walls, wherein the sliding mandrels (117) are biased axially upward when not engaged.

Referring now to FIG. 77, a plan view of the multi-function tool (112) of FIGS. 73 to 76 is shown in an actuated state, including a section line K-K.

Referring now to FIG. 78, a sectional elevation view of the multi-function tool (112) of FIG. 77 is shown with the section defined by section line K-K removed. The first upper additional wall (51CZ) is shown axially above the second additional wall (51CW), with both additional walls having moved axially downward through engagement with sliding mandrels (117), which compresses the springs (118) below the engagement surface (119) until the sliding mandrels (117) have withdrawn from extension and moved into the internal diameter of the receptacles (114D, 114E of FIG. 76, respectively) within the surrounding wall (116), moving secured protruding mandrels (115) axially downward. The mandrels (115) protruding from the surrounding wall (116) can engage associated spiral receptacles (114 of FIGS. 67 and 69), such that axially downward movement rotates an additional wall (51D of FIGS. 67 and 69) with ratchet teeth (113 of FIGS. 67 and 69), that can be engaged with associated ratchet teeth (113 of FIGS. 68 and 70) to rotate other additional walls (51D of FIGS. 68 and 70), having orifices (59 of FIGS. 68 and 70) and radially-extending passageways (75 of FIG. 70) to selectively align said orifices and radially-extending passageways of the slurry passageway tool shown in FIGS. 61, 62 and 64. Repeatedly placing the multi-function tool in an actuated state and, then, allowing the multi-function tool to return to an unactuated state by force of included springs (118), enables repeated selective alignment of desired orifices and/or radially-extending passageways.

Once an actuating tool (94 of FIG. 104) is urged through the internal passageway with pumped slurry engaging the sliding mandrels (117), moving the mandrels downward until they retract into associated receptacles and said actuating tool passes, the springs (118) can return the first upper additional wall (51CZ) and/or second additional wall (51CW) to the un-actuated state, shown in FIGS. 73 to 76, with the sliding mandrels (117) extended into the internal bore of the surrounding wall (116). The associated ratchet teeth (113 for FIGS. 67 and 69) move in a reverse direction without rotating associated additional walls (51D of FIGS. 68 and 70) due to the uni-directional nature of said ratcheting teeth. The first upper additional wall (51CZ) and second additional wall (51CW) may have equivalent or different diameters for actuating the other or sliding within the other, respectively. Sliding mandrels (117) of the first upper additional wall (51CZ) and second additional wall (51CW) can be provided with different engagement diameters to allow actuation tools to pass one set of sliding mandrels and engage the other set of mandrels, selectively, while sliding either the first upper additional wall (51CZ) or the second additional wall (51CW). Additionally, more than two sets of walls, springs and mandrels of different engagement diameters can be used to create more than two functions when used with actuation tools (94 of FIG. 104, 97 of FIG. 132, 98 of FIGS. 133 to 135) having coinciding engagement diameters.

Figures 79, 80, 81, 82, 83, 84, 85, 86, 87:
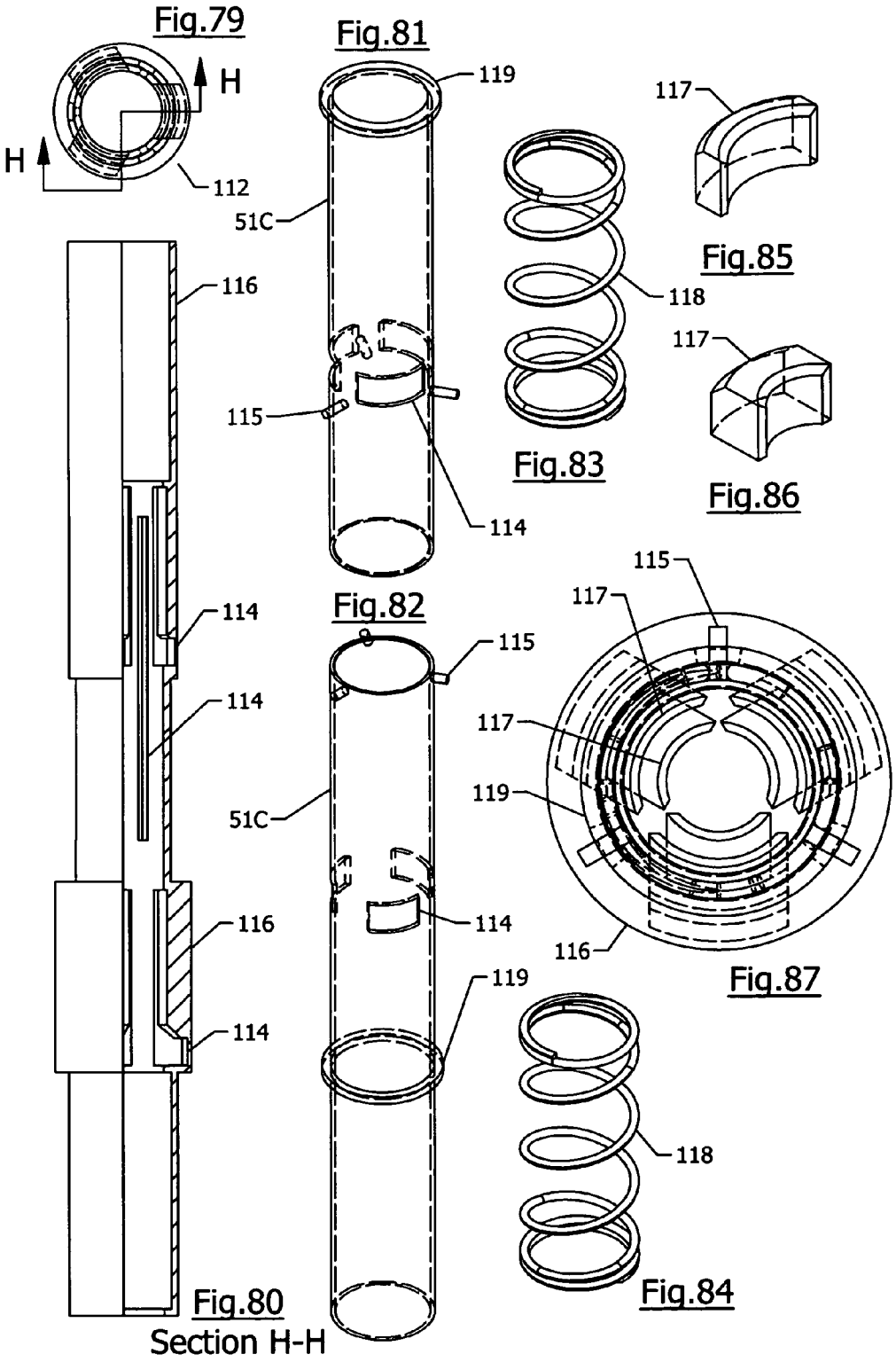
FIGS. 79 to 87 depict member parts of the multi-function tool shown in FIGS. 73 to 78, with FIG. 87 being a plan view of said member parts assembled, with dotted lines showing hidden surfaces.

Referring now to FIGS. 79 to 86, member parts of the multi-function tool (112) of FIGS. 73 to 78 are shown. FIG. 79 depicts a plan view of the multi-function tool (112), including section line H-H with dashed lines showing hidden surfaces. FIG. 80 depicts a sectional elevation view of the multi-function tool having the section defined by section line H-H removed. The depicted multi-function tool includes the surrounding wall (116) having long vertical (114F) receptacles (114) for association, with secured protruding (115) mandrels (115A of FIGS. 81 and 115B of FIG. 82) and cavity (114D, 114E) receptacles (114) for association with sliding (117) mandrels (117X of FIGS. 85 and 117Y of FIG. 86). FIGS. 81 and 82 are isometric views of the first upper (51CZ) additional wall (51C) and second (51CW) additional wall (51C), respectively, with dashed lines showing hidden surfaces. In the Figures, secured protruding mandrels (115), for engagement with associated receptacles (114B of FIGS. 67 and 114C of FIG. 69), pass through receptacles (114) for association with sliding (117) mandrels (117X of FIGS. 85 and 117Y of FIG. 86) and spring engagement surfaces (119) for engagement of associated springs (118 of FIGS. 83 and 84). FIGS. 83 and 84 are isometric views of springs (118) usable for engagement between engagement surfaces (119) of the first upper additional wall (51CZ) and second additional wall (51CW) of FIGS. 81 and 82, and the surrounding wall (116) of FIGS. 79 and 80. FIGS. 85 and 86 are isometric views with dashed lines showing hidden surfaces of sliding mandrels (117), having different engagement diameters that may be removed from engagement when inserted through receptacles (114 of FIGS. 81 and 82) into associated recessed receptacles (114 of FIGS. 79 and 80).

Referring now to FIG. 87, a plan view of the multi-function tool (112) of FIGS. 73 to 76 assembled from the member parts shown in FIGS. 79 to 86 is depicted, with dashed lines illustrating hidden surfaces and showing the engagement diameters of sliding (117) mandrels (117X, 117Y) and protruding mandrels (115) in an un-actuated state.

Having shown the internal member parts of the embodiments of FIGS. 49 to 59, section views of the assembled embodiments will be described.

Figures 89, 90, 91, 92, 93:
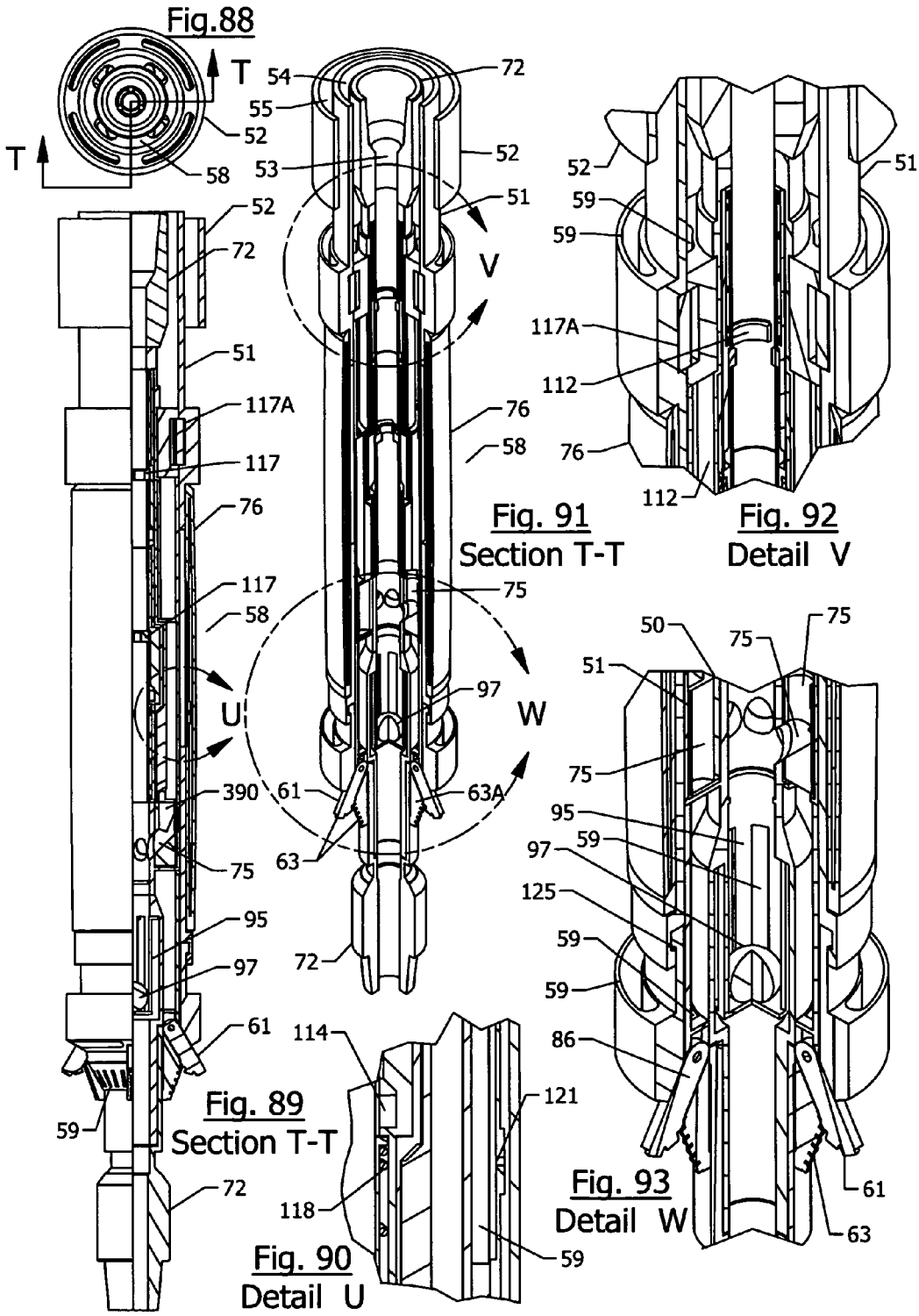

Referring now to FIGS. 88 and 89, FIG. 88 depicts a plan view of the slurry passageway tool (58M) of FIG. 59 including section line T-T, and FIG. 89 depicts a sectional elevation view of the tool with the section defined by section line T-T removed. The slurry passageway tool (58M) of FIG. 59 is shown with an associated internal multi-function tool (112) of FIGS. 73 to 76 for rotating an internal slurry passageway tool (58H) orifices and radially-extending passageways. Both tools are disposed within the passageway through subterranean strata (52) comprising a bore extending from a casing (51V), having an upper end rotary connector (72) and upper end additional wall (51) for engagement with a dual walled string, or if the upper end rotary connection (72) is used only for placement and retrieval, a single walled casing drilling string.

The internal member parts of the slurry passageway tool (58) are engaged to the external member (58K of FIG. 58) through engagement of a sliding mandrel (117A) of the internal member subassembly (58J of FIG. 57) with an external member subassembly additional wall (51T) receptacle (114 of FIG. 58). The internal member subassembly can have rotatable, radially-extending passageways (75) for urging slurry and a catch (95A) basket (95) for engaging actuation (97) tools (97A), an extended second stage bore enlargement tool (61B), and a lower rotary connector (72) to a single wall bottom hole assembly string. The external member subassembly is also shown having a flexible membrane (76), and orifices (59) at its lower end sized to prevent large rock debris from entering the internal passageways of the tool. Alternative actuation tools (94 of FIG. 104, 97 of FIG. 132, 98 of FIGS. 133 to 135) can be used and engaged by the catch basket (95) to remove said actuation tools from blocking the internal passageway.

Referring now to FIG. 90, a magnified elevation view of the section defined by detail line U of FIG. 89 is shown, depicting the sliding mandrel receptacle (114) and spring (118), of the internal multi-function tool and the orifice (59) facilitating passage of slurry to the check valve (121), that can be used for inflating the flexible membrane (76 of FIG. 89). In use, the flexible membrane can choke the first annular passageway between the slurry passageway tool (58M) and the passageway through subterranean strata. Once inflated the check valve (121) can prevent deflation of the membrane. If the flexible membrane (76) and check valve member parts are not used, the slurry passageway tool orifices (59) are usable for urging slurry from the internal passageway to the first annular passageway. Alternatively, the inner member subassembly (58J of FIG. 57) may be passed below the outer or external member subassembly (58K of FIG. 58) when disengaged to urge slurry to the first annular passageway with the flexible membrane present.

Referring now to FIG. 91, a cross section isometric view of the slurry passageway tool (58M) of FIG. 88 is shown, with the section defined by section line T-T removed. FIG. 91 includes detail lines V and W. The slurry passageway tool (58) is shown disposed within the passageway through subterranean strata (52) with its upper end disposed within a lining (51V) and at the lower end of the single or double walled drill string, and having the upper end of the single walled drill string connectable to the rotary connection (72) at its lower end, similar to the arrangements depicted in FIGS. 148 to 155. The slurry passageway tool is usable to urge the enlargement of a pilot bore passageway with first stage (61A) and additional stage (61B) bore enlargement tools, comprising an embodiment of a rock breaking tool similar to the tool (63) of FIGS. 5 to 7, as said single walled drill string bores said pilot passageway axially downward through subterranean strata, circulating fluid slurry axially downward through its internal bore (53) and axially upward in the first annular passageway between the tool and surrounding wall (52).

For dual walled drill strings, the radially-extending passageways (75) of the slurry passageway tool (58) can be used to connect slurry flow from an internal passageway (53) to either the additional annular passageway (54) or first annular passageway (55). The depicted internal selectable slurry passageway tool can function in a manner similar to that of the embodiment shown in FIGS. 60 to 64, with the exception that the radially-extending passageways (75) are oriented outward and upward rather than outward and downward, as shown in FIGS. 60 to 64.

Referring now to FIG. 92, a magnified isometric view of the portion of the slurry passageway tool (58M) of FIG. 91, defined by detail line V, is shown. The arrangement of the portion of the tool in FIG. 92 includes an internal member subassembly (58J of FIG. 57) engaged to an external member subassembly (58K of FIG. 58) additional wall (51T) with sliding mandrels (117A) within an exterior wall (51T) having orifices (59A) for slurry passage, with an outer additional wall protecting the flexible membrane (76) from significant contact with the passageway through subterranean strata (52). If the external member subassembly (58K of FIG. 58) is engaged with a protective lining or casing at its upper end, said external part can be placed with said casing, and cement slurry can be placed behind said casing and external member subassembly. Thereafter, the flexible membrane can be inflated against the passageway through subterranean strata to prevent said dense cement slurry from flowing downward, or u-tubing, with a check valve (121 of FIG. 90) preventing the flexible membrane (76) from deflating. The flexible membrane thereby acts as a drill-in casing shoe.

The internal member subassembly (58J of FIG. 57) can be disengaged from the external member subassembly (58K of FIG. 58), prior to cementing or inflating the flexible membrane through long orifice slots (59R of FIG. 58). Cementing can be performed in an axially downward direction using another slurry passageway tool (58G of FIGS. 94 to 103) disposed axially above, or said internal member subassembly could be lowered below said external member subassembly to cement axially upward, after which it could be retrieved into the external member subassembly to inflate the flexible membrane (76) through associated orifices (59R of FIG. 58).

Referring now to FIG. 93, a magnified isometric view of the portion of the slurry passageway tool (58M) of FIG. 91, defined by Detail line W, is shown, illustrating radially-extending passageways (75), manipulated by an associated multi-function tool (112 of FIG. 92), with a catch basket apparatus (95) axially below said radially-extending passageways of an internal slurry passageway tool (58H). An actuation (97) tool (97A) can be usable to actuate said multi-function tool and manipulate said radially-extending passageways (75), and can be removed from interference with the flow of slurry axially downward by said basket, wherein said slurry may flow around said catch basket apparatus through long radial orifice slots (59R) within the internal member part.

The external member subassembly (58K of FIG. 58) is shown having a surrounding wall (51T), having orifices (59A) for slurry passage, protecting the flexible membrane (76), and includes associated slots (89 of FIG. 58) for the second stage bore enlargement tools (61B) extended outwardly by the upward travel of the first stage bore enlargement tools (61A). The surrounding and protective wall may be rotated by the engagement with bore enlargement apparatus in associated slots using an optional thrust bearing (125) to prevent rotation of the flexible membrane from the remainder of the external member and associated casing string. The depicted thrust bearing (125) can be added or moved to the upper protective wall of FIG. 92 to prevent rotation of outer protective lining or casing strings. In an embodiment of the invention, if rotation of the casing string is desired, the thrust bearing (125) may be omitted.

Figures 94, 95, 96, 97, 98:
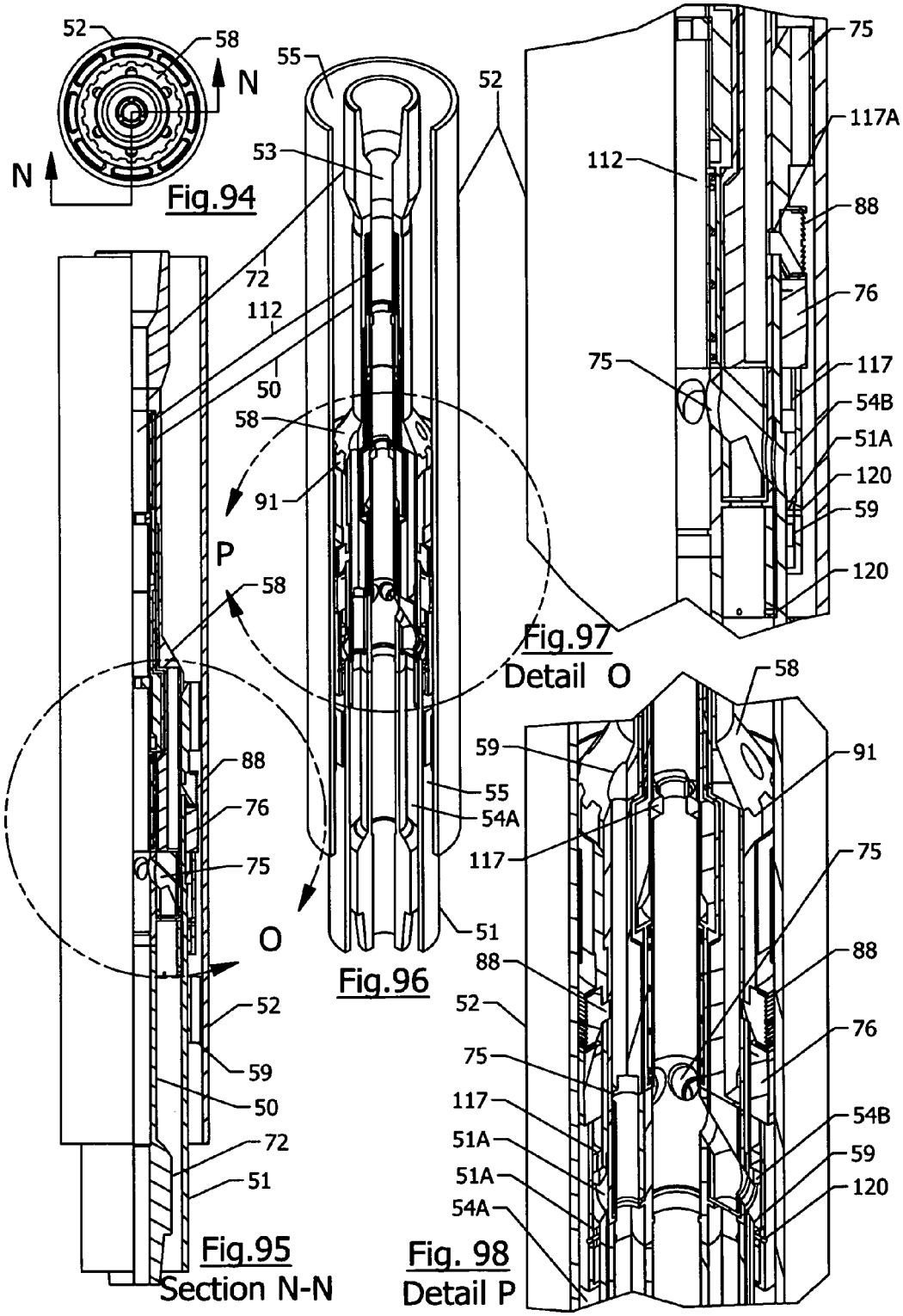
FIGS. 94 to 103 depict the tool of FIGS. 49 to 53 and FIGS. 60 to 87 disposed within the passageway through subterranean strata, with cross sectional views showing operational cooperation between member parts.

Referring now to FIGS. 94 and 95, FIG. 94 depicts a plan view of an embodiment of the slurry passageway tool (58G) of FIG. 53 including a sectional line N-N. FIG. 95 depicts an elevation view of the slurry passageway tool having the section defined by section line N-N removed. The slurry passageway tool (58G) of FIG. 53 is shown with an associated internal multi-function tool (112), of FIGS. 73 to 76, for rotating an internal slurry passageway tool (58D of FIG. 50) with orifices and passageways. Both tools can be disposed within the passageway through subterranean strata (52), having an upper end rotary connector (72) for a single walled string and lower end additional wall (51) for engagement to a liner, casing (51V) or single walled casing drilling string. Alternatively, if both the additional wall (51) and lower connection (72) are used, a dual walled string.

The internal member subassembly (58E of FIG. 51) of the slurry passageway tool (58G) is shown engaged to the external member subassembly (58F of FIG. 52) through engagement of an associated spline surface (91 of FIGS. 51 and 52) and mandrels (117A of FIG. 54) of the external member subassembly, engaged with receptacles (114 of FIG. 51) of the internal member subassembly. The internal member subassembly can include an internal slurry passageway tool (58D of FIGS. 60 to 64), having rotatable radially-extending passageways (75) for connecting between passageways and urging slurry.

A protective wall (51T) having orifices (59) for slurry flow between the tool and passageway through subterranean strata (52), protects engagement apparatus (88) and the flexible membrane (76) used to secure and differentially pressure seal the external member subassembly and protective casing secured at its lower end to said passageway wall (52) shown as a casing (51V).

Referring now to FIG. 96, an isometric view of the slurry passageway tool (58G) of FIG. 94 is shown within the passageway through subterranean strata (52), having the section defined by section line N-N removed. The Figure depicts the spline engagement (91) between internal member subassembly (58E of FIG. 51) and external member subassembly (58F of FIG. 52). Slurry may be circulated axially downward within the internal passageway (53, 54A if an internal string member is not engaged to the lower rotary connection 72) and axially upward or downward into the first annular passageway (55) for single strings, as illustrated in FIGS. 61, 62 and 64. For dual wall strings, where an internal string member is engaged to the lower rotary connection (72), an intermediate passageway (54 of FIG. 147) can be selected for axial upward or axial downward flow. Also, if an upper slurry passageway tool (58) is used and the intermediate passageway (54 of FIG. 147) is left open at the bottom of said dual string, conventional drilling strings can be emulated using a simple, non-selectable, lower slurry passageway tool (58T of FIGS. 136 to 139) or a conventional centralizing apparatus at the lower end. In cases where an upper slurry passageway tool (58) is used with an associated selectable slurry passageway tool (58M of FIGS. 88 to 93), positioned at the lower end of said dual walled strings, a conventional drilling or casing drilling string can be emulated. With use of a multi-function tool (112 of FIGS. 73 to 78), emulation between drilling and casing drilling can be selectively repeated.

Referring now to FIG. 97, a magnified elevation view of the portion of the slurry passageway tool (58G) of FIG. 95 defined by detail line O is shown, illustrating the mandrel (117A) of the securing apparatus (88) engaged in an associated receptacle (114 of FIG. 51). The slurry passageway is shown having a flexible membrane (76), wherein sliding mandrels held by an engagement ring (117 of FIG. 55) pass within recesses in said membrane for engagement with the securing apparatus (88), when the radially-extending passageways (75) are aligned to allow pressure from the internal passageway (53) to reach the intermediate passageway (54B), immediately below said engagement ring.

Referring now to FIG. 98, a magnified view of the portion of the slurry passageway tool of FIG. 96, defined by detail line P, is shown. The Figure depicts orifices (59) at the upper end of the tool for connecting the first annular passageway (55 of FIG. 96) above said tool with the additional annular passageway (54 of FIG. 147) below said tool, for a dual wall string, or with an enlarged internal passageway (54A), for a single walled string. The slurry passageway tool is shown having radially-extending passageways (75), securing apparatus (88) and flexible membrane (76), as described previously.

With regard to FIGS. 94 to 98, the internal arrangement of rotating sleeves of the internal passageway tool (58D of FIGS. 63 and 64) is shown in alignment for engaging the securing apparatus (88) and flexible membrane (76) to the wall of the passageway (52). Application of pressure through the internal passageway (53) pressurizes an annulus (54B) and axially moves the sliding mandrels secured to an engagement ring (117 of FIG. 55) upward, forcing the securing mandrels (88) outward and compressing the flexible membrane (76) to engage the passageway wall (52). The sliding mandrels (117A) of the securing apparatus (88) are subsequently removed from associated receptacles (114 of FIG.

51), releasing the internal member subassembly (58E of FIG. 51) from the external member subassembly (58F of FIG. 52).

An additional wall (51J) with a shear pin arrangement (120) disposed axially below said engagement ring secured to sliding mandrels (117A), can be sheared with pressure applied to the intermediate passageway (54B) to thereby expose a passageway between the internal passageway (53) and the first annular passageway (55), once said engagement ring secured to sliding mandrels (117A) has fully moved axially upward to engage said securing apparatus (88) and release its mandrels (117A) from the associated receptacles (114 of FIG. 51), allowing pressure to build in said intermediate passageway (54B).

Referring now to FIGS. 99 to 103, views of the slurry passageway tool (58G) of FIGS. 94 to 98 are shown, wherein the securing apparatus (88) and flexible membrane (76) have been engaged with the passageway wall (52), and the additional wall (51J), wherein a shear pin arrangement (120) has been sheared downward revealing a passageway connecting the internal passageway (53) with the first annular passageway (55), and an actuation apparatus (95 of FIG. 104) has been placed within the internal passageway (53) to prevent downward passage of slurry and pressure build-up within the internal passageway for moving and shearing apparatus.

Figures 99, 100, 101, 102, 103, 104:
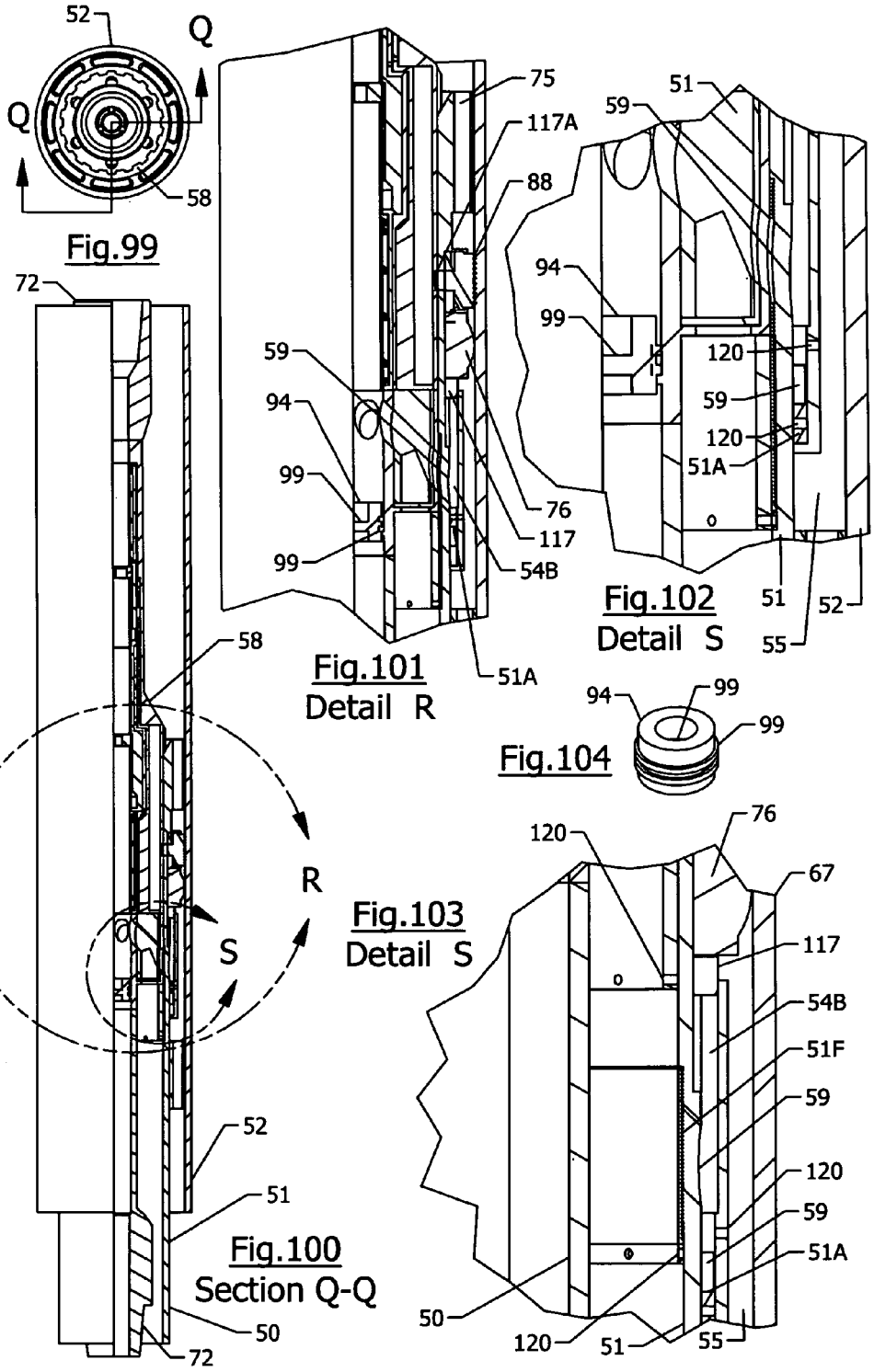
FIG. 104 illustrates an actuation tool for activating embodiments a multi-function tool and/or sealing the internal passageway of embodiments of a slurry passageway tool to divert flow.

Referring now to FIGS. 99 and 100, FIG. 99 depicts a plan view of the slurry passageway tool (58G) of FIG. 94 including sectional line Q-Q. FIG. 100 depicts an elevation view of the slurry passageway tool (58G) having the section defined by section line Q-Q removed, and including detail lines R and S. In FIGS. 99 and 100, the tool (58G) is disposed within the passageway through subterranean strata (52).

Referring now to FIGS. 101 and 102, magnified elevation views of the portion of the slurry passageway tool (58G) of FIG. 100 defined by detail lines R and S, respectively, are shown. The sliding mandrel (117A) of the securing apparatus (88) is depicted engaged to the passageway through subterranean strata (52), and retracted from associated receptacles (114 of FIG. 51), releasing the internal member subassembly (58E of FIG. 51) with the additional wall (51J unsheared in FIG. 101) sheared in FIG. 102 from its shear pin arrangement (120), to prevent exposure in FIG. 101, and to expose the orifice (59) in FIG. 102, to the first annular passageway (55). Using the depicted arrangement, slurry pumped through the internal passageway (53) is diverted to the first annular passageway (55) by the actuation tool (94) for axial downward flow through the radially-extending passageway (75) and an orifice (59) in the additional conduit wall (51R).

Referring now to FIGS. 102 and 103, FIG. 102 shows the internal member subassembly (58E of FIG. 51) and external member assembly (58F of FIG. 52) before said internal member is moved axially upward relative to said external member, and FIG. 103 illustrates the axial position of said internal member subassembly after having been moved axially upward relative to the external member subassembly secured to said passageway (52), after urging cement slurry axially downward from the internal passageway (53) to the first annular passageway (55). Axially upward movement of the internal member subassembly (58E of FIG. 51) subsequently moves a closing sleeve (51Q) having securing slip surface and shear pin arrangements (120) associated with the shear pin arrangement (120 of FIG. 51) of the internal member subassembly, to close the exposed passageway to the first annular passageway (55). Thereafter, said shear pin arrangement shears, fully releasing said internal member subassembly from said external member subassembly and closes the passageway for placement of cement axially downward.

Referring now to FIG. 104, an isometric view of an embodiment of an actuation tool (94) is shown, having a penetrable or pierceable internal differential pressure barrier (99) and exterior differential pressure seals (98) for engagement with the wall of the internal passageway (53 of FIGS. 99-103). The depicted embodiment can be usable to actuate the slurry passageway tool (58G) of FIGS. 94 to 102, which can be releasable with use of a spear dart (98 of FIGS. 133-135), catchable with a basket (95 of FIGS. 89 to 93 and FIGS. 119 to 120), or the internal barrier (99) can be pressure sheared to restore fluid flow through the internal passage (53 of FIGS. 99 to 103).

Figures 105, 107, 108:
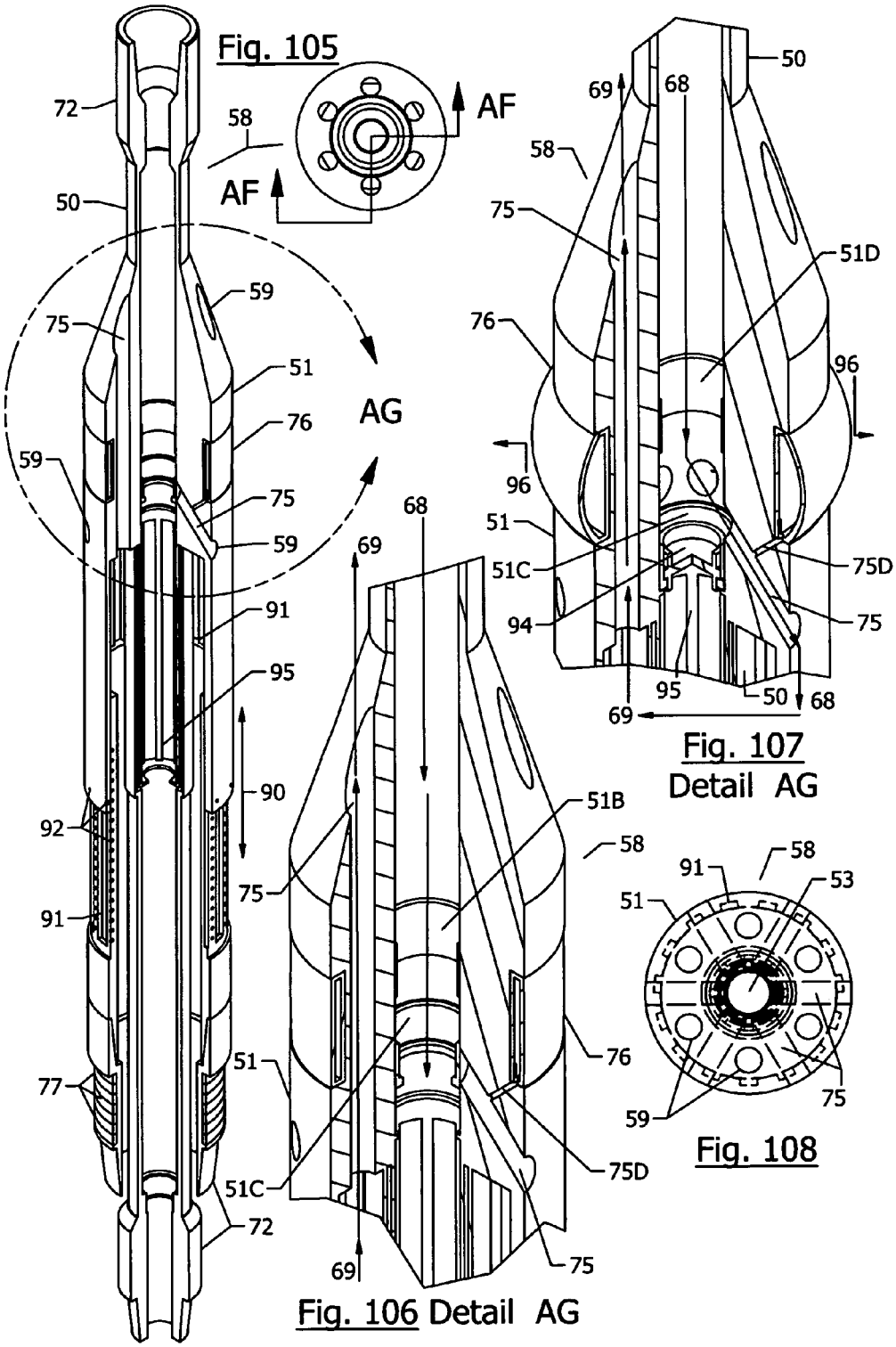

Referring now to FIG. 105, a right side plan view and associated left side isometric view, with the section defined by line AF-AF removed, of an embodiment of the slurry passageway tool (58N) is shown. The Figure depicts orifices (59) and radially-extending passageways (75) to facilitate a plurality of slurry circulation options while rotating a single wall string, or dual wall string arrangement, using a telescoping (90) spline arrangement (91) with a single wall string rotary connector (72) at its upper end. An additional wall (51) and rotary connections (72), at the lower end of the slurry passageway tool, can be connected to a single conduit or dual conduit string. A liner with an expandable liner hanger (77) can be carried and placed by the additional wall and, then, released and secured to the passageway through subterranean strata, using said expandable hanger to create a differential pressure barrier. Additionally, a pinning arrangement (92) can be used to secure the telescoping member parts at various extensions of the telescoping arrangements. Rotary connectors can be replaced with non-rotational connections if a non-rotating string, such as coiled tubing, is used.

Referring now to FIG. 106, a magnified isometric view of the embodiment of the portion of the slurry passageway tool (58N) of FIG. 105, defined by detail line AG, is shown. In the Figure, slurry flows axially downward (68) through the internal passageway (53) and axially upward (69) through a vertical (75A) radially extending passageway (75), with outward (75B) radially-extending passageways (75) covered by an additional wall (51M), which may also be covered by an additional wall (51P) if (51M) is moved axially downward.

Referring now to FIG. 107, a magnified isometric view of the embodiment of the portion of the slurry passageway tool (58N) of FIG. 105 defined by detail line AG is shown, wherein an actuation tool (94) has moved an additional wall (51M) axially downward exposing radially-extending passageways (75) and blocking the internal passageway (53). Slurry flows axially downward (68) through the internal passageway (53) to the first annular passageway (55), between said conduit strings and the passageway through subterranean strata (52), using said actuation tool (94). The slurry flow takes returned slurry circulation axially upward (69), through orifices and associated vertical radially-extending passageways (75) within the slurry passageway tool (58). The actuation tool (94) may be caught in a catch (95) basket tool (95B of FIG. 105) once the actuation tool is released. The slurry passageway tool (58N) can include passages (75D, shown in FIGS. 106 and 107) to an inflatable flexible membrane (76) used to choke the axially upward passageway between the tool and said passageway (52) to prevent axial upward flow.

Referring now to FIG. 108, a plan view with dashed lines showing hidden surfaces of an embodiment a slurry passageway tool (58O) is shown, having orifices (59) leading to vertical radially-extending passageways for urging slurry through passageways between the first conduit string and a nested additional conduit string (51), with outwardly radially-extending passageways (75) for urging slurry from the internal passageway (53) to the first annular passageway surrounding the tool, demonstrating the relationship between vertical and outwardly radially-extending passageways (75).

Referring now to FIGS. 109 to 114, views of an embodiment of a slurry passageway tool (58P) are shown, with member parts that include intermediate additional walls (51D) arrangements (51DXS, 51DXL) that can be rotatable and can include orifices (59) comprising vertical (59A) and outward (59R) oriented orifices for alignment with orifices (59R) leading to radially-extending passageways (75) comprising vertical (75A) and outward (75B) radial-extending passageways with associated vertical (59A) and vertical (59A) and outward (59R) orifices of an internal member to provide, or to block, fluid slurry flow between orifices, and a flexible membrane member (76). The first wall (50) at its upper end can be connected to a single rotating or non-rotating conduit string, while the lower end of the first wall (50) and nested additional wall (51), intermediate to the passageway (52) in which the tool is contained, can be connected to single wall string or dual wall strings, dependent on whether the first wall (50) at its lower end is continuous to a distal end of the string.

Figures 109, 110, 111, 112, 113, 114:
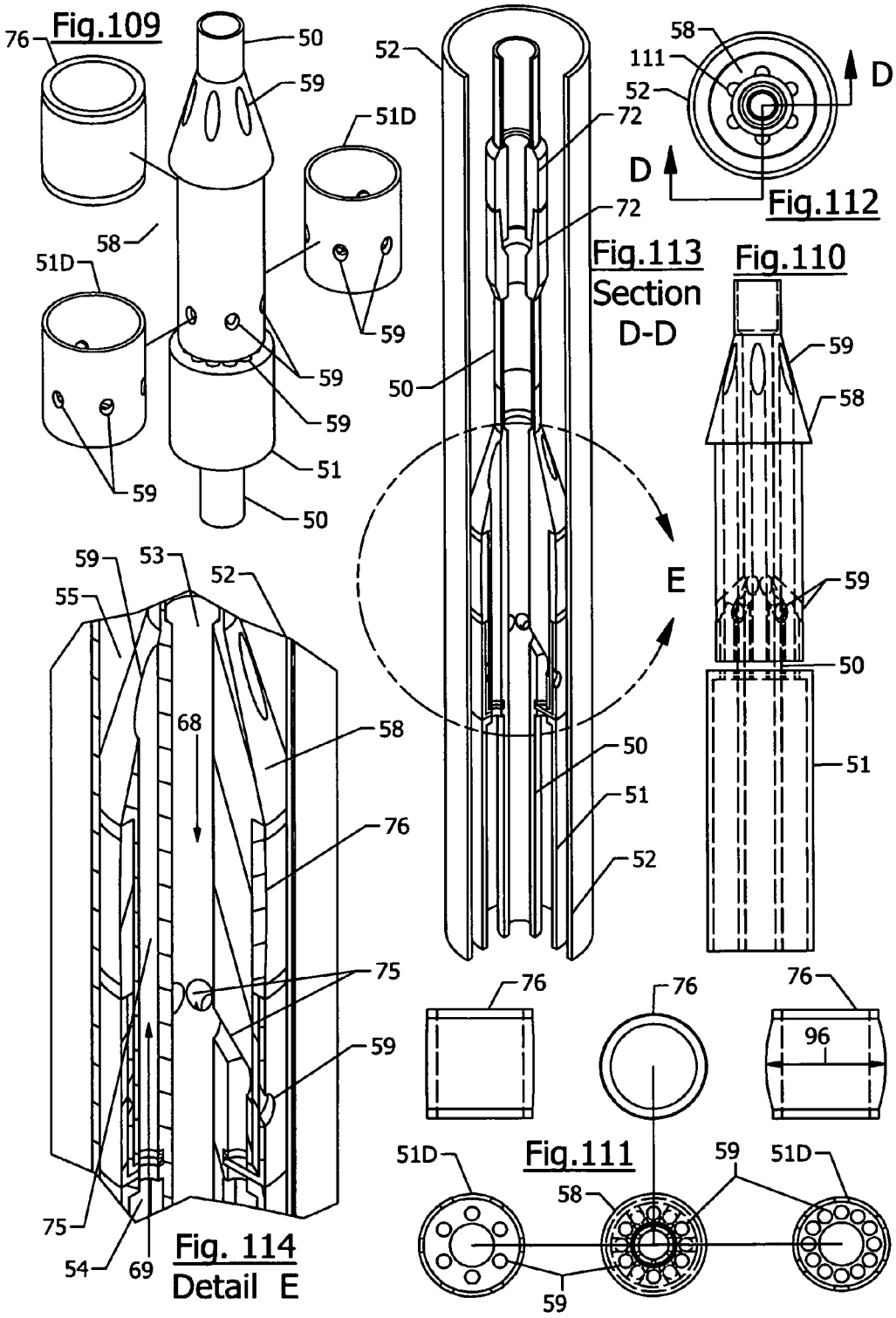
FIGS. 109 to 117 illustrate an embodiment of a slurry passageway tool, wherein rotatable walls with orifices and a flexible membrane for choking the first annular passageway may be used to control slurry flow, annular velocities and associated pressures emulating conventional drilling or casing drilling strings.

Referring now to FIG. 109, an isometric view of the member parts of the slurry passageway tool of FIG. 112 is shown. The Figure illustrates said separated member parts, smaller internal (51DSX) disposable within larger (51DLX) additional walls (51D) that can be including rotatable and can include vertical (59A) orifices (59) of radial-extending passageways (75A, 75B) and outward (59R) orifices (59) of radial-extending passageways (75B), and a flexible membrane (76) for engagement with the internal member. The sleeves can be rotatable to change the flow arrangement of passageways from the internal member other passageways and the passageway in which the tool is contained.

Referring now to FIG. 110, an elevation view of slurry passageway tool (58P) internal member of FIG. 112 is depicted, showing said internal member with vertical (59A) and outward (59R) orifices (59) associated with passageways (75A, 75B) extending to hidden surfaces depicted with dashed lines.

Referring now to FIG. 111, plan views of the member parts of FIG. 109, with hidden surfaces illustrated with dashed lines are shown, depicting vertical (59A) orifices (59) in rotatable wall (51DSX) which may be nested within rotatable wall (51DLX) also having vertical (59A) orifices (59), wherein said orifices are alignable between the additional walls (51D) and the orifices (59A, 59R) of the center member of the tool (58P) of FIG. 110, wherein the flexible membrane (76) is shown in a deflated state in the left elevation view and an inflated state (96) in the right elevation view.

Referring now to FIG. 112, a plan view of an embodiment of a slurry passageway tool (58Q) within the passageway through subterranean strata (52) comprising a casing conduit (51V) is shown, including a section line D-D.

Referring now to FIG. 113, an isometric view of the slurry passageway tool (58Q) of FIG. 112 is shown, with the section defined by section line D-D removed, illustrating a rotary connection (72) to a single walled string at its upper end. FIG. 113 also includes a detail line E, which defines a portion of the tool shown in FIG. 114.

Referring now to FIG. 114, a magnified isometric view of the portion of the slurry passageway tool (58Q) of FIG. 113 defined by detail line E, is depicted. The Figure shows the arrangement of radially-extending passageways (75) comprising vertical orifice (59A) radial-extending passageways (75A) and vertical (59A) and outward (59R) orifice radial-extending passageways (75B), and intermediate additional walls (51DLX, 51DSX) that can be rotatable and can include vertical (59A) and outward (59R) orifices (59) arranged for flow through the internal passageway (53) and first annular passageway (55) in an axially downward direction, and flow through the additional annular passageway (54) in an axially upward direction. The depicted arrangement is usable when significant slurry losses to the formation are occurring or the first annular passageway is choked with rock debris during drilling due to the large diameter string and small first annular space. If the lower end conduit is secured to a large diameter conduit having an open lower end of similar configuration to that shown in FIGS. 136 to 139, with a single walled string passing through its internal passageway, using one or more bits and/or hole openers to facilitate passage, slurry may be circulated axially downward in the internal passageway (53), while returns are flowed through the intermediate or additional annular passage (54) and first annular passageway (55), to reduce the loss of slurry until the large diameter casing (51) may be cemented in place. This arrangement for drilling with losses significantly reduces said losses by using frictional forces in the first annular passageway and reducing the flow of slurry and associated slurry loses in the first annular passageway while maintaining the hydrostatic head to ensure well control.

Figures 115, 116, 117, 118, 119, 120:
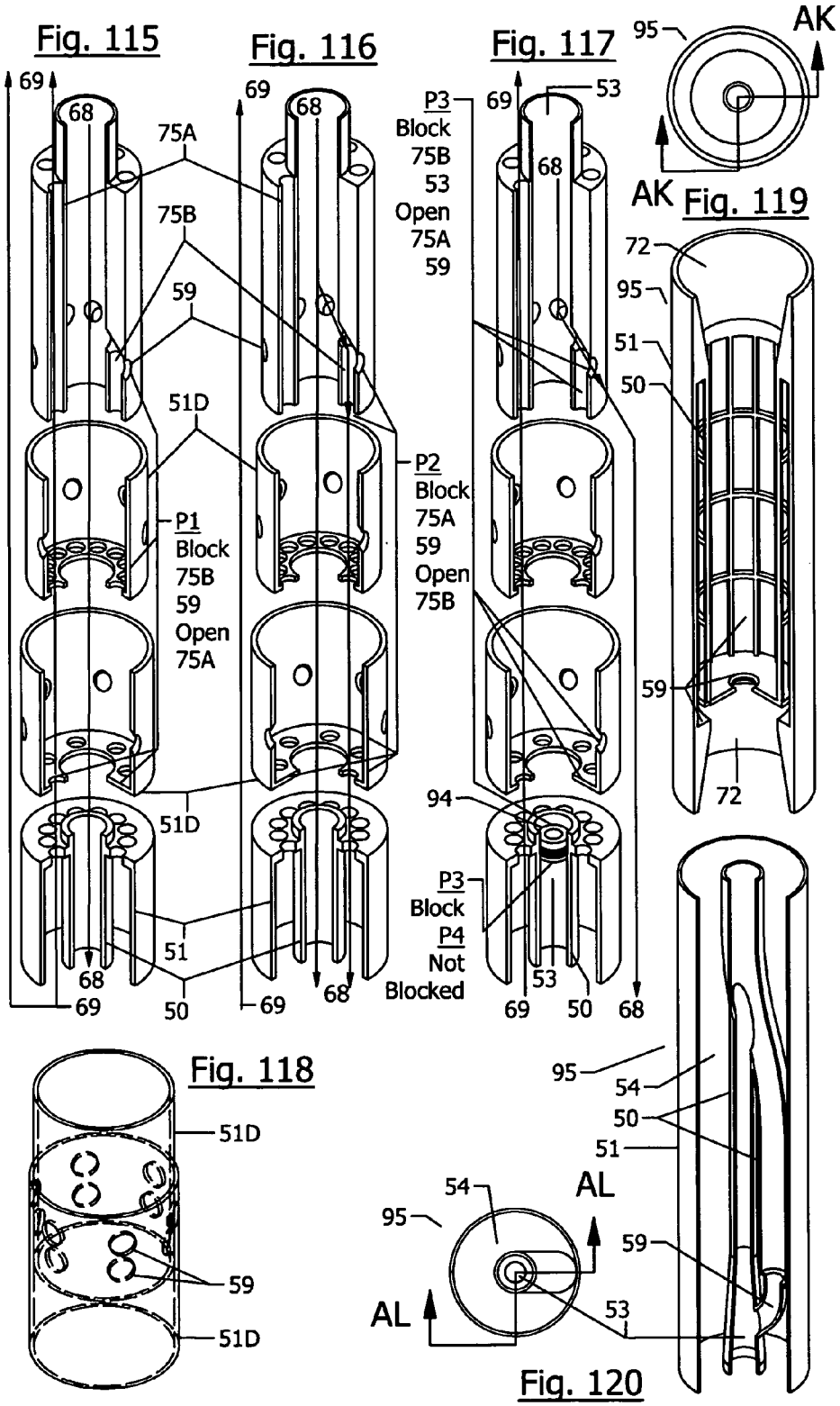
FIG. 118 depicts an embodiment of a slurry passageway tool member parts where two sliding walls having orifices are axially movable to align or block said orifices for urging or preventing slurry flow between the inside passageway and outside passageway of said sliding walls.
FIGS. 119 to 120 illustrate various embodiments of tools used to remove the blocking function of actuation apparatus placed within an internal passageway, allowing a plurality of apparatuses to be caught by a basket arrangement.

Referring now to FIGS. 115 to 117, isometric views of the slurry passageway (58) member parts of the slurry passageway tool (58) embodiment (58Z) usable with the slurry passageway tool (58Q) of FIG. 112 with cross section line D-D removed are shown, illustrating different orientations and alignments of additional wall (51DSX) insertable within additional wall (51DLX), that can be rotatable, wherein the internal member is split at its smallest diameter around which the additional walls (51DSX, 51DLX) with orifices (59) rotate to align with the orifices and passageways (75A, 75B) of the internal member, with the two nested additional walls (51D) with orifices (59) intermediate to said split.

Referring now to FIG. 115, a slurry passageway tool (58Z) with the additional walls (51D), orifices (59) and radial-extending passageways (75A, 75B) are shown in an orientation (P1) usable to emulate the velocity, flow capacity, and associated pressures of conventional drilling circulation in an axially upward direction through the first annular passageway. In FIG. 115, passageways (75B) vertical orifices (59A) are blocked by additional wall (51DLX) and passageways (75B) outward orifices (59R) are blocked by additional wall (51DSX) from circulating slurry, wherein another passageway's (75A) vertical orifices (59A) are open to slurry circulation through other vertical orifices (59A) in the additional walls (51D). Slurry is circulated in an axially downward direction (68) through the internal passageway, and it is circulated in an axially upward direction (69) through the first annular passageway and additional annular passageway. This arrangement can be termed as a lost circulation drilling arrangement where, unlike prior art conventional drilling, friction in the first annular passageway is used to limit slurry losses to a fracture or strata feature within the first annular passageway maintaining circulation through the additional annular passageway between the first conduit (50) and additional wall of the nested conduit (51), while hydrostatic head with said friction is maintained in the first annular passageway.

Referring now to FIG. 116, a slurry passageway tool (58Z) with the additional walls (51D), orifices (59) and passageways (75A, 75B) are depicted in an orientation (P2) usable to emulate the velocity, flow capacity, and associated pressures of casing drilling in an axially downward direction (68) and an axially upward direction (69), wherein passageway's (75A) vertical orifices (49A) and an orifice (59) are blocked by additional wall (51DLX) and passageways (75B) outward orifices (59R) are blocked by additional wall (51DSX) from circulating slurry, while other passageway's (75B) vertical orifices (59A) are open to slurry circulation. The slurry is circulated axially downward (68) through the internal passageway and additional annular passageway, and axially upward (69) through the first annular passageway.

Referring now to FIG. 117, a slurry passageway tool (58Z) with the walls, orifices (59) and passageways (75A, 75B) are shown in an orientation (P3) usable for top-down circulation for placing slurry or cement in an axially downward direction (68) and taking circulated returns in an axially upward direction (69), wherein passageway's (75B) vertical orifices (59A) are blocked by additional wall (51DLX) and the internal passageway (53) is blocked by an actuator (94) from circulating slurry, while passageway's (75A) vertical orifices (59A) and passageway's (75B) outward orifices (59R) are open to orifices (59) in the additional wall (51D) for slurry circulation. The slurry is circulated axially downward (68), through the internal passageway, until it reaches the orifice (59) where it exits and continues axially downward in the first annular passageway. The slurry returns axially upward (69) through the additional annular passageway and vertical radially extending passageways (75A). While the depicted arrangement is termed as a top down cementing position, it can be used to facilitate any axially downward slurry flow in the first annular passageway.

An additional arrangement (P4) can be used if the internal passageway (53) is not blocked by an actuating tool (94). The circulation through both the internal passageway (53) and first annular passageway can continue in an axially downward direction (68), with flow in an axially upward direction (69) through the additional annular passageway. This arrangement can be termed a tight tolerance drilling arrangement used to clear the first annular passage with pressurized slurry from the internal passageway when a small tolerance exists between the first annular passageway and conduit string if the gravity feed of a lost circulation orientation (P1) arrangement is insufficient to prevent blockages within the first annular passageway. A nozzled jetting arrangement can be used to control pressured slurry from the internal passageway to the first annular passageway. A flexible membrane, such as that shown in FIG. 107 with an associated radially-extending passageway (75D) for inflation, can be used to prevent axially upward flow to urge axially downward flow and maintain a clear first annular passageway in tight tolerance drilling situations.

Referring now to FIGS. 118 to 120, an isometric view of an embodiment of an alternative arrangement with two nested additional walls (51D) is shown. The additional walls (51U, 51W) include orifices (59), with hidden surfaces represented by dashed lines. A smaller diameter (51U) additional wall can be disposed within a larger diameter (51W) additional wall. The depicted walls can be axially movable, rather than rotated, to align said orifices (59). FIGS. 119 and 120 will be discussed with FIGS. 132 to 135.

Referring now to FIGS. 121 to 124, cross sectional elevation views of an embodiment (58R) of a slurry passageway tool (58) are shown, having different orifice arrangements, wherein the additional walls (51N, 51D) are moved axially to align orifices (59), as described above and depicted in FIG. 118. The depicted embodiment of the slurry passageway tool can be positioned at the lower end of a dual walled string for connecting passageways.

Figures 121, 122, 123, 124:
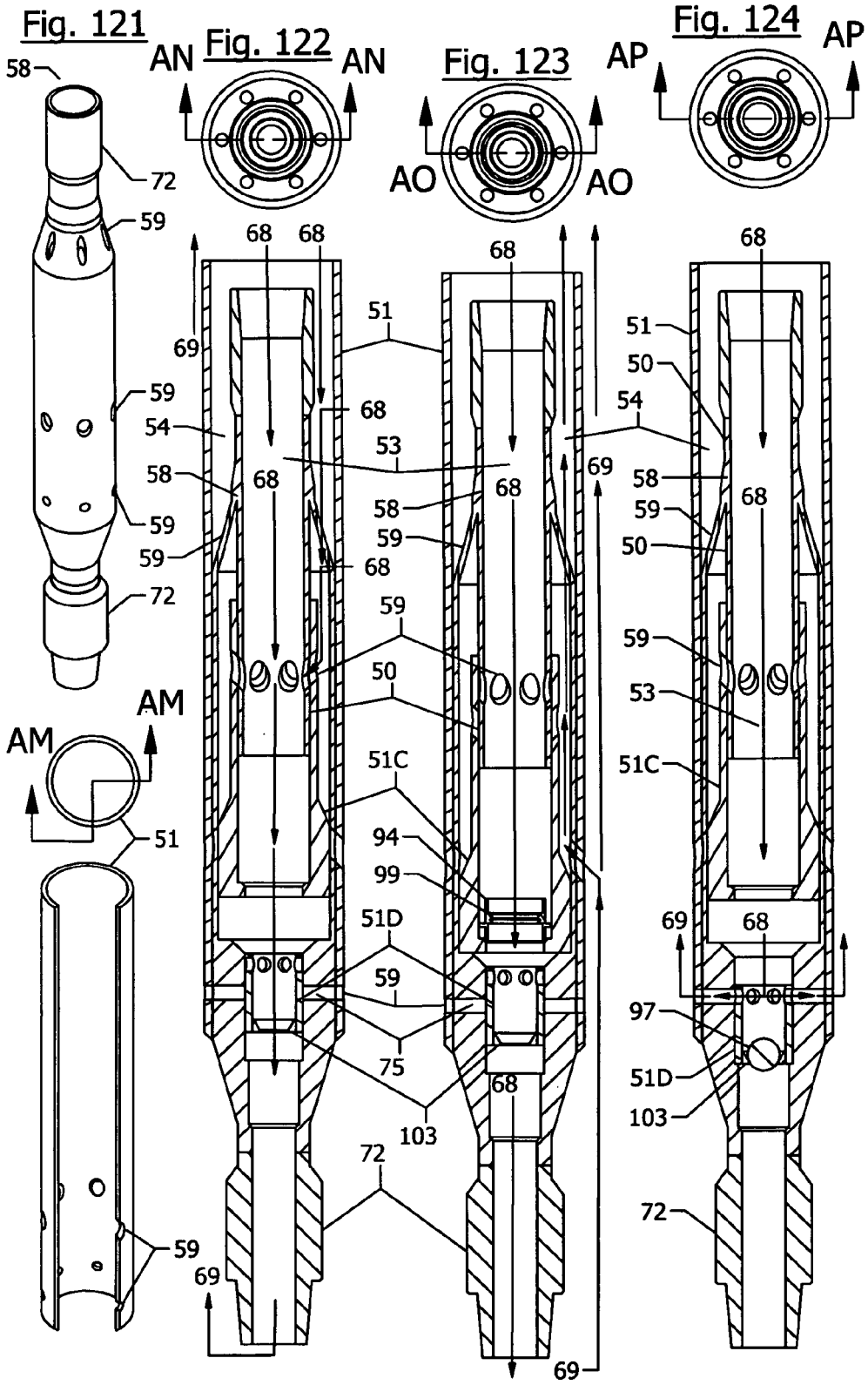
FIGS. 121 to 124 illustrate an embodiment of a slurry passageway tool, wherein axially sliding walls with orifices communicate with the first annular passageway and an additional annular passageway between the innermost passageway and first annular passageway, wherein the sliding walls with orifices are moved axially to emulate pressures and annular velocities of drilling and casing drilling strings.

Referring now to FIG. 121, an upper isometric view of a slurry passageway tool (58R) is shown above an associated intermediate plan view of an additional wall (51), that includes the section line AM-AM, which is shown above an associated lower isometric view of the additional wall (51) with the section defined by section line AM-AM removed. The lower view of the additional wall depicts associated orifices (59) in the contacting circumference. The slurry passageway tool (58R) can be insertable within the additional wall (51) and can be aligned with the associated orifices (59).

Referring now to FIG. 122, an upper plan view of an embodiment (58S) of a slurry passageway tool (58) is shown above an associated cross sectional view of the tool taken along line AN-AN. The slurry passageway tool (58S) is shown inserted into the additional wall (51) of FIG. 121, wherein slurry from the additional annular passageway (54), between the first wall (50) and additional wall (51), can be urged in an axially downward direction (68) to combine with slurry moving axially downward within the internal passageway (53) of the first wall (50). Slurry external to the tool moves in an axially upward direction (69) in the first annular passageway.

Referring now to FIG. 123, an upper plan view of an embodiment (58V) of a slurry passageway tool (58) is shown above an associated cross sectional view of the tool taken along line AO-AO. The slurry passageway tool (58V) is shown inserted into the additional wall (51) of FIG. 121, the tool having been actuated with a different arrangement of orifices. In the Figure, an actuation apparatus (94) was pushed by slurry to slide an additional wall (51Z) downward to close orifices for combining the internal passageway flow in an axially downward direction (68), and to open orifices for combining the additional annular passageway flow with the first annular passageway flow in an axially upward direction (69). After actuating the internal orifice arrangement, a differential pressure membrane (99), within the actuation tool apparatus (94), can be broken to allow flow through the internal passageway to continue.

Referring now to FIG. 124, an upper plan view of an embodiment (58W) of the slurry passageway tool (58) is shown above a cross-sectional elevation view of the slurry passageway tool (58W) taken along line AP-AP. The tool is shown inserted into the additional wall (51) of FIG. 121. An actuation tool (97), shown as a ball (97B), is depicted landed in a seat (103, as shown in FIGS. 123-124), having axially moved the internal orifice alignable (51D) additional wall (51W) to align the internal passageway with a radially-extending passageway (75, as shown in FIGS. 122-13) to the surrounding first annular passageway. After aligning the radially-extending passageway (75) to perform the selected function, another actuation tool, similar to the actuation apparatus (94) of FIG. 123, may be placed across the radially-extending passageway (75) to stop the urging of slurry therethrough until sufficient pressure is applied to the seat (103) to shear the seat and move the actuation tool (97), that is resting on the seat (103), in an axially downward direction, where it can be removed from flow interference by a catch basket.

Referring now to FIGS. 125 to 131, views of an embodiment of a multi-function tool (112A) are shown, which include a hydraulic pump (106) within a rotational housing arrangement (105). A spline surface (91) can be used to run said pump and hydraulically move additional walls containing orifices, or to move sliding mandrels (117A) axially engaged with a piston (109), to thereby align orifices or cause engagement with a receptacle, in a nested additional wall. The spline surface (91) engaged to the first wall (50) can be engaged with a spline receptacle (104) at distal ends for rotating the drill string. A spline receptacle (104) is located at upper and lower ends to facilitate drilling and back-reaming rotation under compression and tension of the first wall (50), while intermediate spline receptacle arrangements (91) facilitate actuation of a pump (106). The depicted multi-actuation tool can be used with a single walled string which crosses over between smaller and large diameters, such as when undertaking casing drilling, or using a dual walled string.

Figures 125, 126, 127, 128, 129, 130:
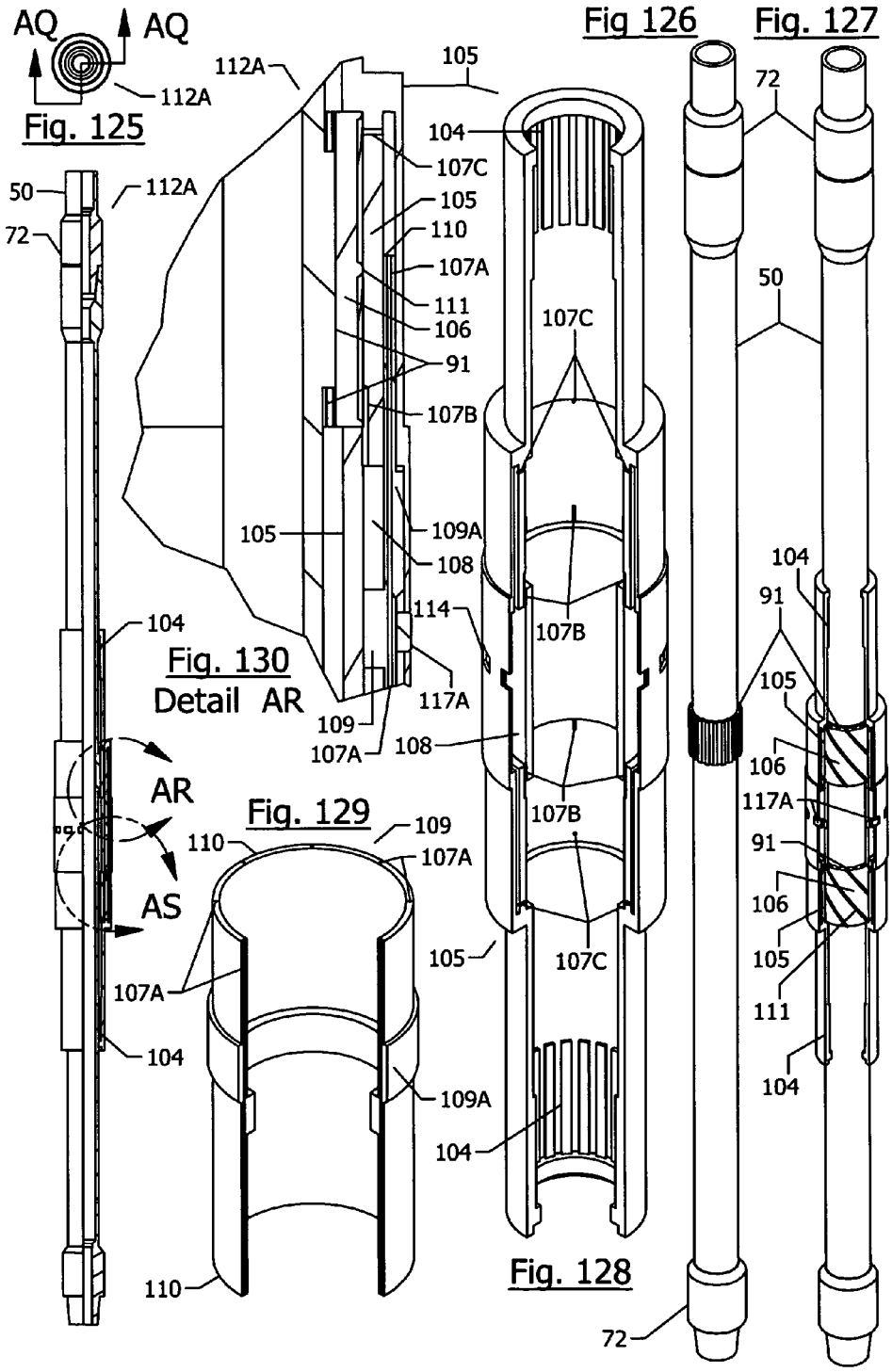
FIGS. 125 to 131 depict an embodiment of a multi-function tool usable to repeatedly and selectively rotate a string and axially move sliding walls with orifices or engage and disengage sliding mandrels within associated receptacles of a dual walled string using a hydraulic pump engaged and actuated by axially moving and rotating the inner conduit string.

Referring now to FIG. 125, an upper plan view of an embodiment of a multi-function tool (112A) is shown above a cross sectional elevation view of the tool taken along line AQ-AQ. The multi-function tool (112A) can allow drilling when engaging a spline surface (91) with an associated lower housing (104), or back-reaming when engaged with an associated upper housing (104). Engagement with intermediate spline arrangements enables operation of a hydraulic pump to actuate functions associated with a surrounding wall of another tool, wherein rotation of the spline surface (91 of FIG. 126) secured to the first wall (50) rotates a pump (106 of FIG. 127) used to hydraulically actuate a function.

Referring now to FIG. 126, an isometric view of a member part of the multifunction tool (112A) of FIG. 125 is shown. The depicted arrangement comprises a first wall with rotary connections (72), and an intermediate spline (91) arrangement for engagement within a housing (105 of FIG. 128) or pump (106 of FIG. 127), used to rotate the string when engaged to the upper or lower ends of the housing (105 of FIG. 128), or a pump if placed and rotated intermediate to said ends.

Referring now to FIG. 127, an isometric view of the multifunction tool (112A) of FIG. 125 is shown, with the section of the housing (105 of FIG. 128) defined by line AQ-AQ removed. Upper and lower hydraulic pumps (106) are shown comprising a rotatable wall with impellers (111) within said housing (105). Rotation of a spline arrangement (91 of FIG. 126) functions said pump within which it is engaged.

Referring now to FIG. 128, a cross sectional isometric view of the housing (105) member part of the multifunction tool (112A) of FIG. 125 is shown, taken along line AQ-AQ. In FIG. 128, the housing (105) can be disposed about a piston (109 of FIG. 129), with a central rotating and axially moving spline arrangement (91 of FIG. 126) for rotation of an associated splined wall that can have outer impellers (111 of FIG. 127) and can function in use as a hydraulic pump (106 of FIG. 127), when rotated. The housing (105) has splined arrangements within an associated housing (104) at distal ends for engagement with a central rotating and axially moving spline arrangement (91 of FIG. 126), wherein engagement and rotation within the splined associated housing (104) rotates the additional walls secured to said housing (105). The housing (105) can include hydraulic passageways (107A, 107B and 107C) to facilitate hydraulic movement of a piston (109 of FIG. 129), within the housing when the pump (106 of FIG. 127) is used.

Referring now to FIG. 129, a cross sectional isometric view of the piston (109) member part of the multifunction tool (112A) of FIG. 125 is shown, taken along line AQ-AQ. In FIG. 129, the piston has an internal hydraulic passageway (107A) and an actuating surface (109A) for engaging sliding mandrels (117A of FIGS. 127 and 117A of FIG. 130). The ends (110) of the piston are also denoted.

Figures 131, 132, 133, 134, 135, 136, 137, 138, 139:
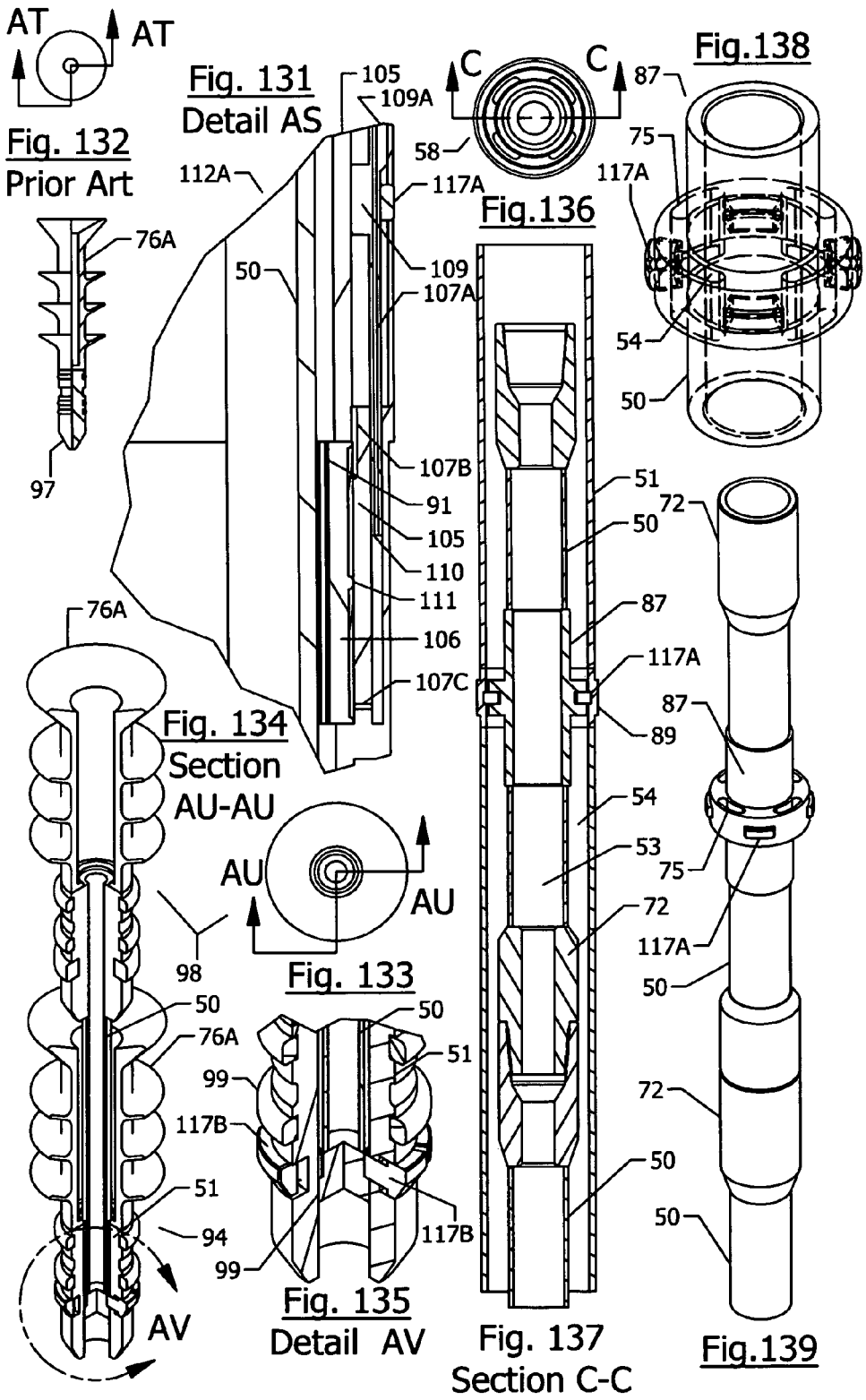
Fig. 132 Prior Art
FIG. 132 depicts a prior art actuation apparatus shown as a drill pipe dart.
FIGS. 133 to 135 depict an embodiment of a drill pipe dart having an internal differential pressure membrane punctured by a spearing dart to remove said differential pressure membrane and release said dart for continued passage through the internal passageway.
FIGS. 136 to 139 illustrate an embodiment of a slurry passageway tool for connecting two inner strings disposed within a larger outer string.

Referring now to FIGS. 130 and 131, magnified views of the portions of the multifunction tool (112A) of FIG. 125 defined by lines AR and AS, respectively, are shown. The upper and lower pump engagements and the operative cooperation of member parts of FIGS. 126 to 129 are shown. A spline arrangement (91) can be used to rotate a pump (106), forcing hydraulic fluid through a passageway (107B) to move a piston (109), located within a hydraulic chamber (108). The piston can subsequently engage a sliding (117A) mandrel (117A3) with an associated receptacle (114, 114J) in an additional wall within which said multifunction tool is disposed if said spline surface is engaged and rotated in said pump (106) within the housing (105). Hydraulic fluid below the piston (109) is returned through a second hydraulic passageway (107A) within the piston to supply said pump through a third hydraulic passageway (107C). The closed hydraulic arrangement moves pistons (109), returning hydraulic fluid through passageways (107A and 107C), until the end (110) of the piston (109) is exposed to the piston chamber (108). Further rotation recycles fluid between the chamber (108) and passageway (107C) of the housing for preventing over-pressuring of the system. Once the opposing pump moves and re-engages the piston end (110), separating its cavity from that of the piston chamber (108), the recycling arrangement is removed.

If the spline arrangement surface (91) is engaged within the lower pump (106 of FIG. 131), rotation of the pump can be used to cause disengagement of the sliding mandrel (117A) by moving the piston in an opposite direction. To actuate either function, hydraulic fluid is supplied to the upper end or lower end of a piston chamber (108) with a piston (109) intermediate to said upper and lower ends of said chamber.

If an additional wall (51D of FIG. 118) is secured to said piston, instead of a sliding mandrel (117A), the additional wall may be moved axially upward or downward when engaged to an associated piston and pump, located within the housings (105) respectively to align or block orifices (59 of FIG. 118).

Referring now to FIGS. 119 to 120 and FIGS. 132 to 135, embodiments of catch basket tools and associated actuation tools are shown, respectively, for engagement with one or more of the slurry passageway tools previously described.

With reference to FIG. 119, an upper plan view of an embodiment (95C) of a catch basket tool (95) is shown above a cross sectional isometric view of the catch basket tool (95), taken along line AK-AK. The catch basket tool (95) can be used to catch actuation tools, such as those previously described and those shown in FIGS. 132 to 135, to remove said tools from a position which would block slurry flow through the internal passageway of a tool. Orifices (59) within the wall of the catch basket allow slurry flow around actuation tools, which can be engaged within said basket.

Referring now to FIG. 120, a left side plan view of an embodiment (95D) of a catch basket tool (95) is shown having line AL-AL, and located adjacent is a right side isometric view of the tool (95) with the section defined by line AL-AL removed. FIG. 120 depicts a catch basket tool (95) in which darts, balls, plugs and/or other previously described actuation tools, and those of FIGS. 132 to 135, can be diverted to a side basket or passageway. Orifices (59), within the catch basket tool (95), permit slurry to flow past the tool and any engaged apparatuses in an axially downward direction.

Referring now to FIG. 132, an upper plan view of an embodiment of a drill pipe dart (97C) actuation tool (97) having line AT-AT, is shown above an associated elevation view of the drill pipe dart (97C) with the portion defined by line AT-AT removed. The drill pipe dart (97C) with flexible fins (76A) can be used as an actuation apparatus. Modifications of the dart with an internal barrier (99 of FIG. 135) and sliding mandrels (117B of FIG. 135), allow the dart to perform a function and, then, be removed from blocking the internal passageway.

Referring now to FIGS. 133 and 134, a right hand plan view of an embodiment of a spear dart tool (98) having line AU-AU is shown in FIG. 133. FIG. 134 depicts an associated isometric view of the spear dart tool (98) with the portion of the tool defined by line AU-AU removed, respectively. The spear dart tool (98) is usable for removing actuation (94) tools (94A) from blocking slurry flow through the internal passageway. The spear dart is shown engaged with a lower dart orifice, or actuation tool orifice, accepting the hollow spear end of the spear dart (98), with flexible fins (76A) for engaging pumped slurry and internal spear passageway walls through which slurry may pass to allow the spear dart to move through the internal passageway, which can be blocked by the lower dart.

Referring now to FIG. 135, a magnified detail view of the portion of the spear dart of FIG. 134 defined by Line AV is shown. In operation, an actuation tool (94) can be pushed by slurry to actuate a function of a slurry passageway tool at a pre-determined actuation tool receptacle. Thereafter, the spear dart (98), having flexible fins (76A) and internal spear passageway to allow its movement with slurry to flow through the blocked internal passageway, can be provided until its lower end conduit (50S) spears or penetrates the differential pressure barrier (99) within the additional wall (51X) of the lower actuation (94) tool (94A). This allows sliding mandrels (117B) to retract and thereby disengage from pre-defined receptacles, after which both the spear dart and actuation tool can move axially downward for engagement with an associated catch basket tool (95 of FIGS. 119 and 120).

Referring now to FIGS. 136 to 139, an embodiment (58T) of a simple slurry passageway tool (58) and its member parts are shown, wherein said slurry passageway tool includes a centrally locating member (87) for concentrically locating the first conduit string (50) within a nested additional conduit string (51). Passageways (75) are provided between the first conduit string (50) and nested additional conduit string (51) for passage of slurry. Optional sliding engagement mandrels (117A) may be used with the centrally locating member (87) to engage in an associated receptacle (89) of an additional wall.

Referring now to FIGS. 136 and 137, FIG. 136 depicts a plan view of an embodiment (58T) of a slurry passageway tool (58), which includes a sectional line C-C, while FIG. 137 depicts a cross sectional elevation view of the slurry passageway tool (58T) of FIG. 136 along section line C-C. The slurry passageway tool (58T) is shown having the centrally locating member (87) of FIG. 138 having sliding mandrels (117A), that are engaged within associated receptacles (89) and nested within an additional conduit string (51) of a managed pressure conduit assembly (49 of FIGS. 145 to 166), single walled string or dual walled string, wherein its lower connection can be engaged with the first string of said managed pressure conduit string and its upper connector (72) can be usable to engage an upper first conduit string.

Referring now to FIG. 138, an isometric view of an embodiment of a centrally locating member (87), that can be usable within a slurry passageway tool (58T of FIGS. 136-137), is shown. The slurry passageway tool can include sliding (117A) mandrels (117A4) for engagement with associated receptacles of a nested additional conduit string of a managed pressure conduit assembly (49 of FIGS. 145 to 166), a single walled string, or dual walled string, with four additional annular passageways (54) that can be intermediate to the first wall (50) and additional wall (51) of said centrally locating member.

Referring now to FIG. 139, an isometric view of an embodiment (58T) of a slurry passageway tool (58 of FIG. 136) is shown engaged to a first conduit string (50) of a managed pressure conduit assembly, with its nested additional conduit string removed to provide visibility of the centrally locating member (87) of the slurry passageway tool (58).

Having described embodiments of rock breaking, slurry passageway and multi-function tools, various embodiments of these tools can be combined with single or dual walled string arrangements to facilitate drilling, lining and/or completion of subterranean strata without requiring removal of a drill string.

Referring now to FIGS. 140 to 144, cross sectional elevation views depicting prior art drilling and prior art casing drilling of subterranean rock formations are shown, wherein a derrick (31) is used to hoist a single walled drill string (33, 40) (e.g. a drill string), bottom hole assembly (34, 42 to 48), boring tool (47) and boring bit (35) through a rotary table (32) to bore through strata (30). Prevalent prior art methods use single walled string apparatus to bore passageways in subterranean strata, while various embodiments described herein are usable with single and dual walled strings formed by placing single walled strings within one or more larger single walled strings to create a string having a plurality of walls and associated uses.

Referring now to FIGS. 141 and 142, a magnified detail view of the portion of the bottom hole assembly (BHA) of FIG. 140 defined by line AQ is shown to the left of FIG. 142, depicting an isometric view of a casing drilling arrangement. FIG. 141 depicts a large diameter BHA with drill collars (34) and a small diameter single walled drill string axially above, while FIG. 142 shows a single-walled smaller diameter casing drilling BHA below a larger diameter single walled drilling string (40) (e.g., a casing drilling string). FIG. 142 shows the use of a boring tool (47) in communication with a conduit string, where a rock breaking tool embodiment (63B) is usable. Both depicted arrangements, shown in FIGS. 141 and 142, use single wall strings (30, 40). Embodiments (56D, 56E, 57C, 57D, 63B, 65H, 65J) of rock breaking tools (56, 57, 63 and 65 of FIGS. 5 to 39) may form part of either the single walled string or bottom hole assembly. Application or smearing of LCM generated by these rock breaking tools or impact of the large diameter of a bottom hole assembly or single walled string against the strata wall is affected by the smaller annular space between a larger effective diameter string or BHA and the strata, compared to that of a smaller effective diameter string or BHA, where the friction, velocity and pressure affect the effective circulating density or ECD of fluid circulated axially upward, wherein it is significantly higher through a restricted annular passageway than that of less restricted annular passageway with equivalent flow rates for pressurized application of LCM.

Referring now to FIGS. 143 and 144, elevation views of a directional and straight hole casing drilling arrangement, respectively, are shown, in which FIG. 143 depicts a flexible or bent connection (44) and bottom hole assembly (43), attached (42) to a single walled string (40) prior to boring a directional hole. FIG. 144 depicts a bottom hole assembly usable when boring a straight hole section. The bottom hole assembly (46) of FIG. 143 below the flexible or bent connection (44) includes a motor used to turn a bit (35) for boring a directional hole, while FIG. 144 depicts an instance in which the string (40) is rotated and the motor turns a boring bit (35) in an opposite rotation below a swivel connection (48). Embodiments of rock breaking tools (56, 57, 63 and 65 of FIGS. 5 to 39) may be added to any configuration of subterranean boring strings, including those depicted in FIGS. 143 to 144 in a manner similar to that shown in FIG. 145.

Referring now to FIGS. 145 to 166, embodiments (49A to 49Z) of a managed pressure conduit assembly (49) are shown within a one-half cross sectional elevation view of the passageway through subterranean strata (52), employing various embodiments (56E, 57D, 57E, 63C, 65K, 65L) of rock breaking tools (56, 57, 63, 65 of FIGS. 5 to 39 and 63 of FIGS. 88 to 93) and various embodiments of slurry passageway tools (58 of FIGS. 42 to 64, FIGS. 88 to 118, FIGS. 121 to 124, and FIGS. 136 to 139), which can use embodiments of multi-function tools (112B of FIGS. 73 to 78 and 112A of FIGS. 125 to 131), and various embodiments of basket tools (95 of FIGS. 88 to 93 and FIGS. 119 to 120) to selectively manage circulating velocities and associated pressures to urge first conduit strings (50) and nested additional conduit strings (51) axially downward while boring said passageway through subterranean strata forming a fracturable region (17, 62, 64, 66), extending axially below a lining (51V) and cemented (30C) strata bore (17U). The slurry velocity and associated effective drilling density in the first annular passageway between the tools and the strata can be manipulated using slurry passageway tools (58) repeatedly with multi-function tools (112) using actuation tools, spear darts and baskets, while also managing slurry losses, and injecting and compacting LCM created by the rock breaking tools (56, 57, 63, 65) to inhibit the initiation or propagation of fractures within subterranean strata. Additionally, rock breaking tools (56, 57, 61, 63, 65) and the large diameter of the dual walled drill string can mechanically polish the bore through subterranean strata, thereby reducing rotational and axial friction. The tools and large diameter of the dual wall string also mechanically apply and compact LCM against the filter caked wall of strata into strata pore and fracture spaces to further inhibit the initiation or propagation of fractures within subterranean strata.

To urge the passageway through subterranean strata axially downward, the drill bit (35) is rotated with the first string (50) and/or a motor to create a pilot hole in the fracturable region (66) within which a bottom hole assembly that includes a rock breaking tool (65) with opposing impeller and/or eccentric blades for breaking rock debris particles generated from the drill bit (35), internally to said tools (65), or against the strata walls with said tools (56, 57, 63, 65), thereby smearing and polishing the walls of the passageway through subterranean strata.

The opposing blades of the rock breaking tools (63C, 65L) and eccentric blades of the rock breaking tools (56E, 57D, 57E, 65K) can be provided with rock cutting, breaking or crushing structures incorporated into the opposing or eccentric blades for impacting or removing rock protrusions from the wall of the passageway through subterranean strata or impacting rock debris internally and centrifugally. Additionally, when it is not necessary to utilize the rock breaking tool (65L) to further break or crush rock debris, or should the rock breaking tool (65L) become inoperable, the rock breaking tool (65L) also functions as a stabilizer along the depicted strings.

As the additional conduit string (51) of the managed pressure conduit assembly (49) is larger than the pilot hole (66), rock breaking tools (63) with first stage rock cutters (61A shown in FIGS. 5 and 6) can be used to enlarge the lower portion of the passageway through subterranean strata, e.g. fracturable region (62), and second and/or subsequent stage rock breaking cutters (61B and 61C shown in FIGS. 5 and 6) can further enlarge the passageway, shown as fracturable region (64), until the additional conduit string (51) with engaged equipment is able to pass through the enlarged fracturable passageway (17) through strata. Use of multiple stages of hole enlargement creates smaller rock particles that can be broken and/or crushed to form LCM more easily, while creating a tortuous path through which it is more difficult for larger rock debris particles to pass without being broken in the process of passing. Depending on subterranean strata formation strengths and the desired level of LCM generation, rock breaking tools can be provided above the staged passageway enlargement and rock breaking tools.

The rock breaking tools (56, 57, 63, 65) of bottom hole assembly (BHA) and additional conduit string (51) of the managed pressure conduit assembly (49) bottom hole assembly (BHA) increase the diameter of the drill string, and create a narrower outer annulus clearance or tolerance between the string and the circumference of the subterranean passageway, thereby increasing annular velocity of slurry moving through the passageway at equivalent flow rates, increasing annular friction and associated pressure of slurry moving through the passageway, and increasing the pressure applied to subterranean strata formations by the circulating system. The depicted managed pressure conduit assembly (49) also provides an additional annular passageway (54) nested between the first conduit string (50) and additional conduit string (51) with differential pressure bearing capabilities for diversion of circulating slurries and emulation of drilling or casing drilling technologies, wherein the tools and/or assembly fluid pressure coat of the strata wall of the fracturable regions (17, 62, 64, 66).

If lower frictional forces and associated effective circulating density applied to the subterranean strata are desired to inhibit fracture initiation or propagation, the slurry passageway tools (58) can be used to commingle the additional annular passageway (54) and the first annular passageway (55), to provide circulating pressures similar to conventional drilling technology.

If higher frictional forces and the associated effective circulating density applied to the subterranean strata are desired, such as when it is desirable to force slurry and LCM into fractures and pore spaces to perform well bore stress cage strengthening, the slurry passageway tool (58) can be used to commingle the additional annular passageway (54) and internal passageway (53) to enable flow of slurry in an axially downward direction, while increasing the velocity of slurry traveling in an axially upward direction and associated frictional losses and associated pressures in the first annular passageway (55), similar to conventional casing drilling technology.

Referring now to FIG. 145, an elevation view illustrating an embodiment (49A) of the managed pressure conduit assembly (49), disposed within a cross section of the strata passageway (52) is shown, usable for emulating conventional drilling or casing drilling annular velocities and associated pressures. The depicted managed pressure conduit assembly (49) can incorporate slurry passageway tools (58S comprising, e.g., 58 of FIGS. 42 to 64, 88 to 118, 121 to 124, and 136 to 139) with a simple orifice opening shown to represent said tools and multifunction tools (112B of FIGS. 73-87 and 112A of FIGS. 125-131 respectively), and rock breaking tools (56E, 57D, 57E, 63C, 65K, 65L, comprising, e.g., 56, 57, 63, 65 of FIGS. 5 to 39) for enlargement of a bore, urging a passageway axially downward through subterranean strata, and creation of LCM.

FIG. 145 depicts the lower end of the managed pressure conduit assembly (49) including an additional conduit string (51) disposed about a first conduit string (50), defining an additional annular passageway (54) between the internal passageway (53) of the first conduit string (50) and the wall of passageway through subterranean strata (52). Rock breaking tools (56E, 57D, 57E, 63C, 65K, 65L) are also shown, with a slurry passageway tool (58S) usable for diversion of slurry between the first annular passageway (55) intermediate to said managed pressure conduit assembly (49) and the subterranean strata, the additional annular passageway (54), the internal passageway (53), or combinations thereof.

Referring now to FIG. 146, an elevation view of the upper portion of an embodiment (49B) of the managed pressure conduit assembly (49) disposed within a cross-section of the passageway through strata (52) comprising an upper lined (51V) strata bore or upper fracturable region (17U) and lower fracturable region (17) with the first conduit (50) passing through the additional conduit string (51), is shown. The depicted lower portion of the managed pressure conduit assembly can be engaged with the upper portion of the managed pressure conduit assembly depicted in FIG. 145, wherein the additional conduit string (51) is usable to rotate (67) the managed pressure conduit assembly (49) in a manner similar to conventional casing drilling.

FIG. 146 illustrates: a slurry passageway tool (58T of FIGS. 136 to 139) engaged with the additional conduit string (51) and the first conduit string (50), wherein slurry travels in an axially downward direction (68) through the internal passageway (54A) of the additional conduit string (51) until reaching the slurry passageway tool (58T) after which slurry travels down the additional annular passageway (54) and within the internal passageway (53) of the first conduit string (50).

Slurry returns in an axially upward direction (69) within the first annular passageway (55), which includes an amalgamation of the first annular passageway through subterranean strata urged by the managed pressure conduit assembly (49), the first annular passageway through subterranean strata urged by the previous drill string and the annular space between the additional conduit string (51) and the previously placed protective lining (51V) cemented (30C) within part of the fracturable previous region (17U), which at least in part, forms the wall of the passageway through subterranean strata (52).

In the depicted embodiment, the managed pressure conduit assembly (49) emulates a conventional casing drilling string pressures due to the inside and outside diameter of the casing or additional conduit string (51), used as a single walled drill string at its upper end. While conventional casing drilling strings can incidentally generate LCM when its large diameter contacts the circumference of the passageway during rotation, much of the apparent generated LCM, seen at the shale shakers during casing drilling, will have been generated between said large diameter conduit string and the previously placed protective casing, where said generated LCM is of no use.

Referring now to FIG. 147, an elevation view of the upper portion of an embodiment (49C) of the managed pressure conduit assembly (49) disposed within a cross section of the passageway through subterranean strata (52), comprising an exposed lower fracturable region (17) and an upper fracturable region (17U) that is protected by a lining (51V) which is cemented (30C) into place and through which the first conduit string (50) and additional conduit string (51) are positioned below the slurry passageway tools (58A, 58N, 58R), is shown. The depicted lower portion of the managed pressure conduit assembly (49) is engageable with the upper portion of the managed pressure conduit assembly of FIG. 145. The first conduit string (50) is shown as a jointed drill pipe string engaged to a slurry passageway tool (58N, 58R) used to rotate the managed pressure conduit assembly (49) in a selected direction (67), wherein a connection is made between the inner (50) and outer (51) strings using to the slurry passageway tool (58T) described in FIG. 146. The depicted embodiment of the managed pressure conduit assembly emulates a liner drilling scenario externally, but is capable of emulating conventional drilling string velocities and associated pressures because fluid flow can occur axially upward between the inner (50) and outer (51) conduit strings, as shown in the depicted managed pressure conduit assembly using a dual walled drill string and slurry passageway tools (58T, 58N, 58R, 58A).

The managed pressure conduit assembly (49) of FIG. 147 illustrates: a first conduit string tool (50) with slurry flowing in an axially downward direction (68) through the internal passageway of the first conduit sting (50), with a slurry passageway tool (58T) engaging the first conduit sting (50) and nested additional conduit string (51), and with slurry urged in an axially upward direction (69) through the first annular passageway (55) and additional annular passageway (54).

In this embodiment of the managed pressure conduit assembly (49) the additional annular passageway flow capacity between the first conduit sting (50) and nested additional conduit string (51) may be added to the slurry urged in the axially upward direction (69) to selectively emulate conventional annular velocities and pressures associated with drilling.

Additionally, where prior casing drilling normally relies on wire line retrieval and replacement of BHA's with drill pipe retrieval used as a contingency option, the depicted embodiment enables use of the first conduit sting (50) as the primary option for retrieval, repair and replacement of internal member parts of the managed pressure conduit assembly (49), while enabling the option of drilling ahead after disengaging the protective casing.

Figure 160:
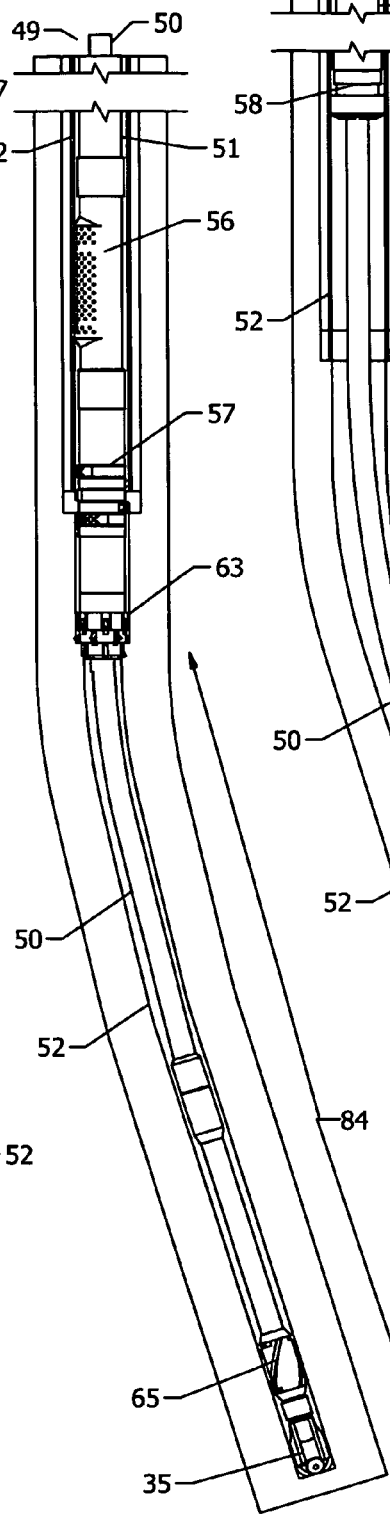
Figure 161:
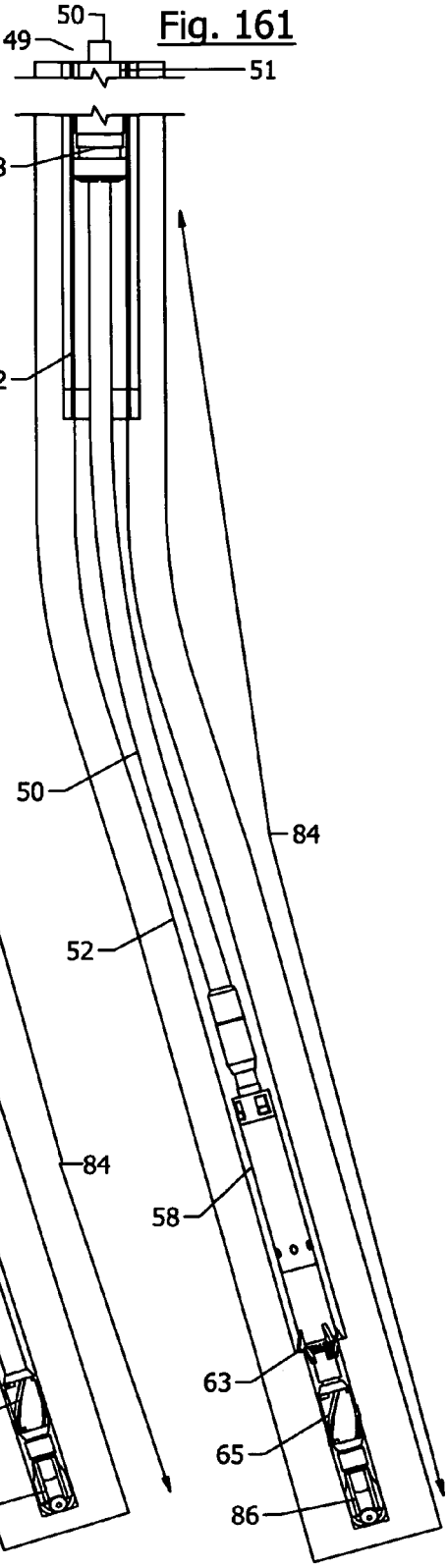

While wire line retrieval is generally efficient, the size of wire line units required to retrieve heavy BHA's is generally prohibitive for many operations with limited available space, such as offshore operations. Additionally the length of the a prior art casing drilling lower BHA is often limited due to weight restrictions associated with wire line retrieval, thus reducing the utility and efficiency of wire line retrieval, such as during situations when long and heavy BHA's are required, as shown in FIGS. 160 and 161.

As the conduits of a managed pressure conduit assembly (49) are stronger than wire line, the internal member conduit strings may be used to place one or more outer nested conduit strings serving as protective lining without first removing said drill string.

Referring now to FIGS. 148 to 155, the subterranean assembly and disassembly of an embodiments (49D to 49I) of a managed pressure conduit assembly (49) are shown, wherein member conduit strings are assembled sequentially to emulate a either a casing drilling assembly or conventional drilling assembly.

Figures 148, 149, 150, 151, 152, 153, 154:
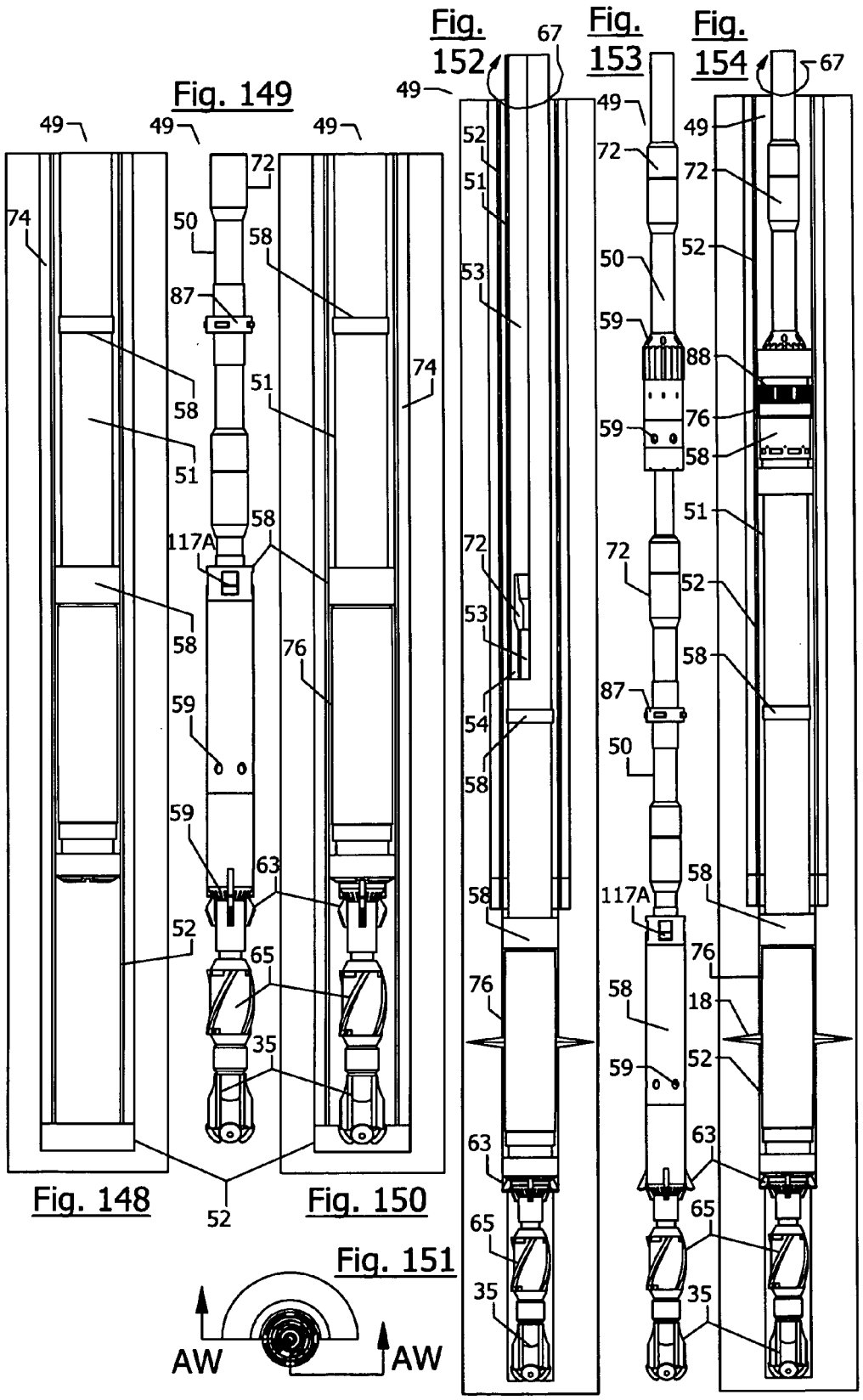
FIGS. 148 to 155 illustrate embodiments of engagement and disengagement of members usable to perform numerous aspects within the scope of the present invention, wherein said engagement and disengagement occurs within the passageway through subterranean strata.

Referring now to FIG. 148, an elevation view of a first step in construction of a managed pressure conduit string (49D), using an additional conduit string (51), is shown disposed within a cross section of the passageway through subterranean strata (52). The additional conduit string (51) is shown placed within the passageway through subterranean strata (52), having protective lining (51V) cemented and/or grouted (74) or hung within said bore through strata for subsequent engagement with the inner conduit string of FIG. 149, to create the assembly of FIG. 150 used to further urge the passageway axially downward. An additional conduit (51) can be placed within the passageway through strata (52) and can include upper and lower slurry passageway tools (58T and 58K of FIGS. 136 to 139 and FIG. 58 respectively).

Referring now to FIGS. 149 and 150, elevation views of a first conduit string (50), and internal members for insertion and the elevation view of said string and members inserted in the down hole arrangement of FIG. 148, respectively, and disposed within a cross section of the passageway through subterranean strata (52), are shown, depicting an additional step in using an arrangement (49F of FIG. 150) of the managed pressure conduit assembly (49) formed by the union of managed pressure conduit assembly arrangements (49D) of FIGS. 148 and (49E) of FIG. 149. The first conduit string (50) can be nested and engaged within the nested additional conduit string (51), with slurry passageway tools (58G and 58M of FIGS. 53 and 59, respectively) provided at the upper and lower ends of the dual walled portion of the string in preparation for urging a subterranean passageway axially downward. In other embodiments, a lower slurry passageway tool (58M) with valves may be omitted or replaced with a second lower tool (58T of FIGS. 136 to 137) leaving the lower end of the dual string open to flow, if an upper slurry passageway tool is added above the assembly to control flow.

Referring now to FIGS. 151 and 152, a left hand plan view of the additional conduit (51 of FIG. 152) is shown having line AW-AW is shown, while FIG. 152 depicts an associated right hand elevation view the portion defined by line AW-AW removed, disposed within a cross section of the passageway through subterranean strata (52). An optional additional step in using an embodiment (49G) of the managed pressure conduit assembly (49) is shown, in which the nested additional conduit string (51) is used to rotate the managed pressure conduit assembly (49) in a selected direction (67), while urging a subterranean passageway axially downward with a bit (35) and bore enlargement tools (63).

Referring now to FIGS. 153 and 154, FIG. 153 depicts an elevation view of the first conduit string (50) internal member part embodiment (49H), which forms the internal member part of the resulting elevation view shown in FIG. 154. FIG. 154 depicts an embodiment (49I) of the managed pressure conduit assembly (49) disposed within a cross section through subterranean strata. An optional additional step in use of the managed pressure conduit assembly (49) is thereby shown, in which the first conduit string (50) of FIG. 149 has been removed from the nested additional conduit string (51) of, for example, managed pressure conduit string (49F) or (49G) of FIG. 150 or 152 respectively, and replaced with a longer first conduit string (49H of FIG. 153) forming a slurry passageway tool (for example 58G of FIG. 53) at its upper end, after which continued boring of the subterranean passageway may continue axially downward. With the addition of the upper slurry passageway tool (58), slurry losses to the subterranean fractures (18 of FIG. 154) can be limited during the time taken to fill the fractures with LCM and an improved filter cake (26 of FIG. 4) containing said LCM, to ultimately inhibit the initiation or propagation of fractures, while taking circulation through the string's additional annular passageway as previously described.

The depicted embodiment (49I) of the managed pressure conduit assembly (49) emulates a liner running and/or drilling assembly. Once total depth has been reached, cement slurry (74) is circulated through either the upper or lower slurry passageway tool (shown for example as 58G of FIGS. 49-53 or 58M of FIGS. 56-59, respectively) in an axially downward or upward direction, respectively, through radially-extending passageways, to said nested additional conduit, casing or lining string (51) and to the wall of the passageway through subterranean strata (52). Thereafter, the inflatable membrane (76 as shown in FIG. 58), which can function as a casing shoe, and can be inflated to prevent u-tubing of cement slurry.

Figures 155, 156, 157, 158:
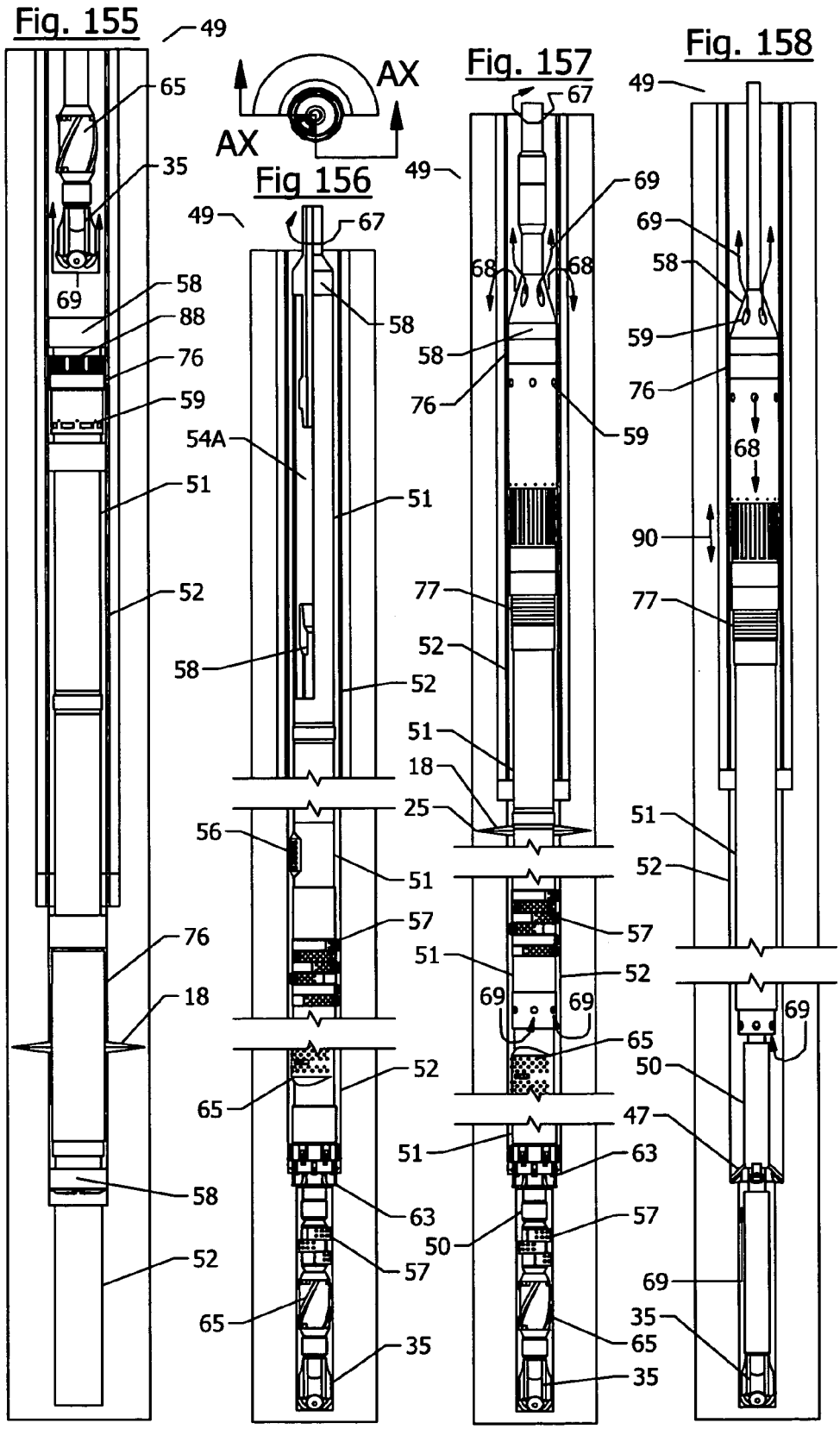
FIGS. 156 to 161 depict embodiments of tools and/or engagement members employing numerous aspects within the scope of the present invention while boring a passageway and placing protective linings within subterranean strata.

Referring now to FIG. 155, an elevation view of the managed pressure conduit assembly (49I) of FIG. 154 is shown, disposed within a cross section of the passageway through subterranean strata. In the Figure, the internal string member of FIG. 153 having been partially withdrawn after cementation, with the first conduit string (50) disengaged from the nested additional conduit string (51). The nested additional conduit string (51) can be engaged to protective casing (51V) within subterranean strata with a securing apparatus (88), such as a liner hanger, and a flexible membrane (76), such as a liner top packer, creating a differential pressure barrier. Slurry is circulated through the first conduit string (50) to clean excess cement slurry from the well bore after cementing and/or grouting of the nested additional conduit string (51), thereby isolating the fracture (18) and cased or lined strata from further fracture initiation or propagation.

Referring now to FIG. 156, an upper plan view of the additional conduit string (51) is shown, having line AX-AX. FIG. 156 depicts a partial sectional elevation view of the additional conduit string (51) having a portion of the section defined by line AX-AX removed. An embodiment (49K) of the managed pressure conduit assembly (49) is shown disposed within a cross section of the passageway through subterranean strata, with break lines used to represent an extensive string length. An embodiment (58X) of a slurry passageway tool (58) is depicted as engaged to the upper end of the nested additional conduit string (51), wherein a discontinuous first conduit string (50) is used to rotate the drill string in a selected direction (67). The partial cross section extends to just above the first break line, showing the discontinuous first conduit string (50). The depicted arrangement is advantageous in offshore drilling operations from a floating drilling unit where the ability to hang the string off of the BOP(s) at seabed is desirable, and in situations when a single drill pipe diameter conduit string is used between the rotary table and the seabed level. Breaks in the elevation view indicate that the assemblies may have extensive lengths, and additional rock breaking tools may be spaced over said lengths to create LCM for inhibiting the initiation and propagation of fractures.

Referring now to FIG. 157, an elevation view of an embodiment (49L) of the managed pressure conduit assembly (49) is shown, wherein boring of the subterranean strata is shown causing slurry losses to fractures (18) in the strata, and points of fracture propagation (25) are not yet sealed from pressures of the circulating system. The additional annular passageway between the first conduit string (50) and nested additional conduit string (51) can be usable to circulate slurry in an axially upward direction (69), entering orifices (59) at the lower end of the string to reduce pressures and associated slurry losses to said fractures until sufficient LCM can be placed to differentially pressure seal the points of fracture propagation (25). Orifices (59), in an embodiment of the telescopically extending upper slurry passageway tool (shown for example as 58N of FIGS. 105-107) allow slurry flow in the axially upward direction (69), then permit the slurry to fall in an axially downward direction (68), through the first annular passageway, using fluid flow frictional resistance to slow slurry losses to fractures (18), while maintaining both circulation and hydrostatic pressure for well control purposes. The lower slurry passageway tool (58), shown for example as 58V of FIG. 123, can include a centralizing apparatus, similar to that shown in FIG. 139, to concentrically locate the first conduit string (50) with an open passageway to said additional annular passageway from the first annular passageway. Alternatively, said lower slurry passageway tool can include a tool such as that depicted FIGS. 88-93, to provide additional functionality.

Referring now to FIG. 158, an elevation view depicting of an embodiment (49M) of the managed pressure conduit assembly (49) with a non-rotating first conduit string (50), such as coiled tubing, is shown disposed within a cross section of the passageway through subterranean strata. A motor is depicted at the lower end of the managed pressure conduit assembly (49M), which can use all or a portion of its additional annular passageway for buoyancy to reduce the effective weight of the managed pressure conduit assembly (49), compensating for the tension bearing capability of the non-rotating string. Multiple slurry passageway tools with groups of radially-extending passageways can be used to divide and control portions of the additional annular passageway to allow both circulation and buoyancy within the resulting additional annular passageways. The depicted upper slurry passageway tool (58) is shown, for example as 58N of FIGS. 105-107, engaging a flexible membrane (76) to the wall of the passageway through subterranean strata (52), wherein circulation occurs through radially-extending passageways (75), of the upper slurry passageway tool (58) to allow circulation in an axially downward direction (68). The downward directional circulation can occur continuously in the first annulus during periods of releasing buoyancy, slurry losses to fractures, tight tolerances, sticking of the outer string, can occur temporarily to clear cuttings, blockages or pack-offs in said first annular passageway by closure of the BOPs and/or use of said flexible membrane (76). In other circumstances, flow within the first annular passageway can be provided in an axially upward direction (69). After reaching the desired depth for placement of the additional conduit string (51), for use as a protective lining with an expandable liner hanger (77), cementation may occur in an axially downward direction, after which the buoyancy of the additional annular passageway, the non-rotated first conduit string (50), and the motor can be removed. Such arrangements enable placement of strings without requiring use of a derrick due to the supporting buoyancy of the string and use of multiple and repeatedly selectable slurry passageway tools to adjust the buoyancy.

Figure 159:
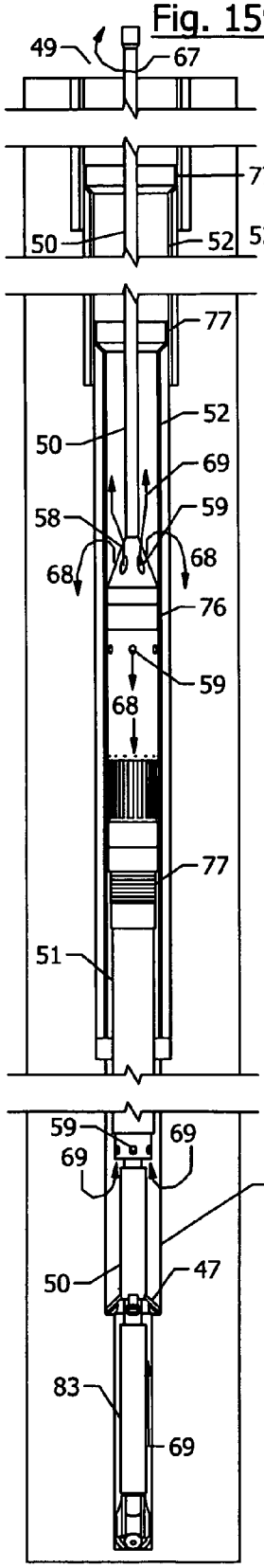

Referring now to FIG. 159, an elevation view of an embodiment (49N) of the managed pressure conduit assembly (49) is shown disposed within a cross section of the passageway through subterranean strata. In FIG. 159, the arrangement of the tool (49N) is depicted as having a close tolerance first annular passageway between the strata and the string, while the first conduit string (50) is used to provide flow in an axially downward direction (68) below the unexpanded flexible membrane (76), exiting orifices (59) in its internal passageway and first annular passageway from a slurry passageway tool (58), shown for example as (58N) of FIGS. 105-107. The managed pressure conduit assembly (49N) can be usable to return circulated slurry through the additional annular passageway in an axially upward direction (69) from the lower end slurry passageway tool (58), shown for example as (58V) of FIG. 123, to reduce forces in the first annular passageway with gravity feed around the tool and pressurized feed within the internal passageway axially downward (68). Multiple nested non-rotated protective casings with less robust flush joint connections and close tolerances between each string can be used to define the non-rotated nested additional conduit strings (51), usable with a rotated first conduit string (50), accepting the majority of forces caused while urging a subterranean bore axially downward. FIG. 159 shows a motor (83) that can be used in urging a subterranean bore axially downward. The multiple nested close tolerance, non-rotated flush joint linings can be sequentially placed with expandable liner hangers (77), and can incorporate the use of telescopically extending technology, for enabling multiple protective linings to be placed without requiring removal of the drill string from the passageway through subterranean strata (52).

Referring now to FIG. 160, an elevation view of an embodiment (49J) of the managed pressure conduit assembly (49) is shown disposed within a cross section of the passageway through subterranean strata, whereby a pendulum bottom hole assembly and a drill bit (35), having a flexible length (84), are usable to directionally steer the managed pressure conduit assembly (49J).

Referring now to FIG. 161, an elevation view of an embodiment (49P) of the managed pressure conduit assembly (49) is shown disposed within a cross section of the passageway through subterranean strata. In FIG. 161, a pendulum bottom hole assembly and eccentric bit (86) are usable to directionally steer the managed pressure conduit assembly (49P), and provide additional flexural length (84) of the bottom hole assembly while the nested additional conduit string remains in place. In an embodiment of the invention, this can be accomplished by disengaging the internal member slurry passageway tool (58J of FIG. 57) and continuing to bore, after which said tool may be reengaged to urge the additional conduit string (51) into the directional strata bore.

Embodiments of the managed pressure conduit assembly can include at least one slurry passageway tool usable to control connections between conduits and passageways. In further embodiments of the managed pressure conduit assembly, a second slurry passageway tool (58T of FIGS. 136 to 139) and/or a centralizing apparatus can be provided to disengage and reengage the first conduit string (50), if a hole opener (47 of 158) is used.

Referring now to FIGS. 167 to 171, cross sectional elevation views of the upper portions of managed pressure conduit assemblies associated with the tools depicted in FIGS. 162 to 166 are shown disposed within a cross section of the passageway through subterranean strata (52).

Figures 162, 163, 164, 165, 166, 167, 168, 169, 170, 171:
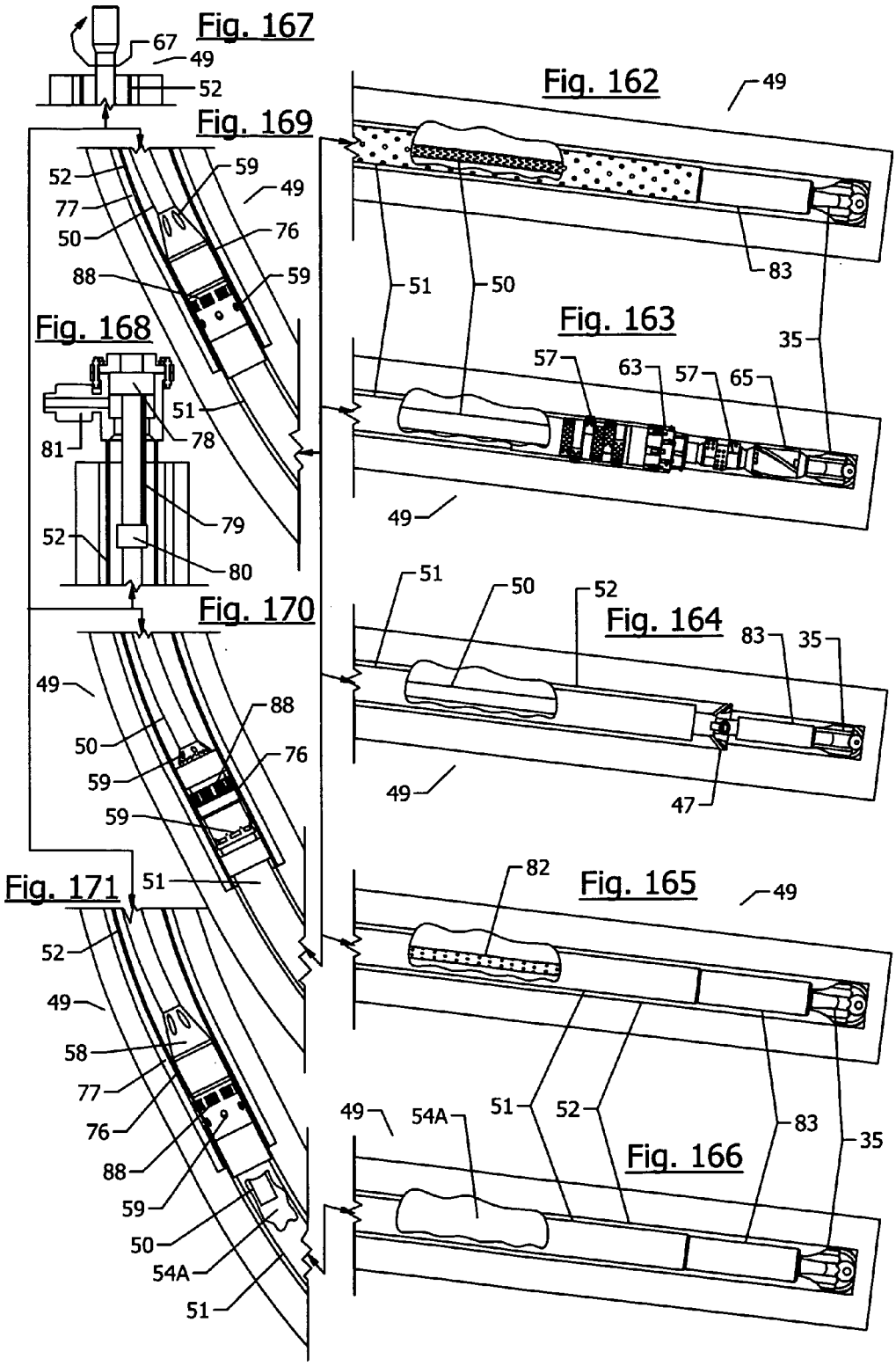
Figures 162 to 166 depict embodiments of the lower end of a managed pressure conduit assembly for engagement with the upper ends of FIGS. 167 to 171.
FIGS. 167 to 171 depict embodiments of the upper end of a managed pressure conduit assembly used during placement of protective linings or completions.

Referring now to FIG. 167, an elevation view of an embodiment (49Y) of the upper end of a managed pressure conduit assembly (49) with a first conduit string, disposed within a cross section of the passageway through strata, is shown. The depicted embodiment is rotated in a selected direction (67), wherein its lower end may be associated with upper ends of the strings shown in FIGS. 169, 179 or 171.

Referring now to FIG. 168, an elevation view of an embodiment (49Z) of the upper end of a managed pressure conduit assembly with a first conduit string disposed within a cross section of a wellhead and the passageway through strata, is shown. The depicted embodiment includes a tubing hanger (78) and subsurface safety valve (80), with intermediate control line (79) placed within a wellhead having an annular outlet (81) for circulation. The lower end of the first conduit string may be associated with the upper end of the strings shown in FIGS. 170 or 171. The depicted arrangement of FIG. 168 can be used in a manner similar to that of the arrangement of FIG. 167 once rotation is no longer needed.

Referring now to FIG. 169, an elevation view of an embodiment (58U) of a slurry passageway tool (58) disposed at the upper end of the nested additional conduit string (51) of an intermediate section embodiment (49Q) of a managed pressure conduit assembly (49) is shown, within a cross section of a wellhead and the passageway through strata. The depicted slurry passageway tool (58U) is usable to facilitate urging slurry within passageways and can engage the nested additional conduit strings (51) to the passageway through subterranean strata using one or more securing apparatus (88) and/or sealing apparatus (76), after which the first conduit string (50) can be removed. Cement slurry (74) for engagement of the nested additional conduit string (51) to the passageway through subterranean strata (52) may be placed in an axially downward direction, or in an axially upward direction within the first annular passageway between the nested additional conduit string (51) and the passageway through subterranean strata (52).

Referring now to FIG. 170, an elevation view of an embodiment (49R) of a managed pressure conduit assembly (49) with a slurry passageway tool (58), shown for example as (58G) of FIG. 53, within a cross section of a wellhead and the passageway through strata is shown disposed at the upper end of the nested additional conduit string (51). The slurry passageway tool (58) shown, is usable to facilitate urging slurry within passageways and can act as a production packer to engage the nested additional conduit string (51) to the wall of the passageway through subterranean strata with a securing apparatus (88) and/or a differential pressure sealing (76) apparatus. Thereafter the first conduit string (50) can be useable as a production or injection string.

Referring now to FIGS. 171, an elevation view of an embodiment (58Y) of a slurry passageway tool (58) of an intermediate section embodiment (49S) of a managed pressure conduit assembly (49) is shown having a portion of the nested additional conduit string (51) removed to enable visualization of the first conduit string, and disposed within a cross section of a wellhead and the passageway through strata. The short first conduit string (50) can be removed or retained as a tail pipe for production or injection, wherein the slurry passageway tool (58) can act as a production packer, or alternatively, can be removed after engaging securing apparatus (88) to the passageway through subterranean strata.

Referring now to FIG. 162, an elevation view of an embodiment (49T) of the managed pressure conduit assembly (49) is shown, disposed within a cross section of the passageway through subterranean strata and having a portion of the nested additional conduit string (51) removed to enable visualization of the first conduit string (50). The depicted managed pressure conduit assembly (49T) is usable in a near horizontal application with a first conduit string (50), including sand screens nested within a second nested additional conduit string (51) that can include a slotted liner, which accepts the forces caused by urging the managed pressure conduit assembly (49T) axially downward with a sacrificial motor (83). A slurry passageway tool can be used to secure the additional conduit strings in a manner similar to that shown in FIG. 169. Alternatively, the slurry passageway tool can be used as a production packer, as shown in FIGS. 170 or 171, engaging the first conduit string (50) with a tubing hanger and wellhead as shown in FIG. 168. Gravel packing can be circulated axially downward when placing the sand screens, using gravity to assist the placement.

Referring now to FIG. 163, an elevation view of an embodiment (49U) of the managed pressure conduit assembly (49) is shown disposed within a cross section of the passageway through subterranean strata. The depicted embodiment includes an arrangement of LCM generation apparatus, usable as a completion string within a near horizontal application, after which cementation, perforation and/or fracture stimulation completion techniques can be used to bypass skin damage, using a slurry passageway tool to secure the additional conduit string (51), as shown in FIG. 169. The slurry passageway tool (58) can be used as a production packer, as shown in FIGS. 170 or 171, engaging the first conduit string (50) with a tubing hanger and wellhead, as shown in FIG. 168. FIG. 163 depicts a portion of the nested additional conduit string (51) that is removed to enable visualization of the first conduit string (50) and its engagement, as described above.

Referring now to FIG. 164, an elevation view of an embodiment (49V) of the managed pressure conduit assembly (49) is shown engaged with a motor (83), and disposed within a cross section of the passageway through subterranean strata. The depicted embodiment is usable within a near horizontal application, with flush joint conduits optionally using annular passageways for floatation of a non-rotated first conduit string, such as coiled tubing. The slurry passageway tool (58) can be used to secure the additional conduit string (51) as shown in FIG. 169. Alternatively, the slurry passageway tool (58) can be used as a production packer as shown in FIGS. 170 or 171, for engaging the first conduit string (50) with a tubing hanger and wellhead as shown in FIG. 168. FIG. 164 depicts a portion of the nested additional conduit string (51) that is removed to enable visualization of the first conduit string (50) and its engagement, as described above.

Referring now to FIG. 165, an elevation view of an embodiment (49W) of the managed pressure conduit assembly (49) is shown. The depicted embodiment includes a portion of the nested additional conduit string (51) removed to show the first conduit string having one or more perforating guns (82), and is disposed within a cross section of the passageway through subterranean strata. The depicted embodiment is usable within a near horizontal application. The slurry passageway tool (58) is usable to place cement in an axially downward direction and secure the additional conduit string (51), as shown in FIG. 169. Alternatively, the slurry passageway tool (58) can be used as a production packer as shown in FIGS. 170 or 171, for engaging the first conduit string with a tubing hanger and wellhead as shown in FIG. 168. Thereafter, firing said perforating guns can permit production or injection from or to the strata formation.

Referring now to FIG. 166, an elevation view of an embodiment (49X) of the managed pressure conduit assembly (49) and a sacrificial motor (83) are shown disposed within a cross section of the passageway through subterranean. The depicted embodiment is shown in use within a near horizontal reservoir application with a short first conduit string having a dart basket tool or open conduit end below the slurry passageway tool. The nested additional conduit string (51) can be used to supply slurry to the motor (83) and urge cement axially downward through the first annular passageway, after which the slurry passageway tool (58) can be used to secure the additional conduit string as shown in FIG. 171. The slurry passageway tool (58) can also be removed, as shown in FIGS 171. The slurry passageway tool can be usable as a production packer engaged with a tubing hanger and wellhead, as shown in FIG. 168.

Improvements represented by the embodiments of the present invention described and depicted herein provide significant benefit for drilling and completing wells where formation fracture pressures are challenging, or under circumstances when it is advantageous to urge protective lining strings deeper than is presently the convention or practice using conventional technology.

LCM generated using one or more embodiments of the present invention can be applied to subterranean strata, fractures and faulted fractures, and/or used to supplement surface additions of LCM, increasing the total available LCM available to inhibit the initiation or propagation of said fractures.

Subterranean generation of LCM uses the inventory of rock debris within the passageway through subterranean strata, reducing the amount and size of debris which must be removed from a well bore, thereby facilitating improved removal and transport of unused debris from the subterranean bore. As formations become exposed to the pressures and forces of boring and the slurry circulating system, LCM generated in the vicinity of the newly exposed subterranean formations and features can quickly act upon a slurry theft zone in a timely manner, as detection is not necessary due to said proximity and relatively short transport time associated with subterranean generation of LCM.

Subterranean generation of LCM also avoids potential conflicts with down hole tools such as mud motors and logging while drilling tools, by generating larger particle sizes after slurry has passed said tools.

Subterranean generation of larger LCM particles in proximity to the fracturable region increases the ability to use the available carrying capacity of the slurry for smaller LCM particles, and/or other materials and chemicals added to the drilling slurry at surface, thus increasing the total amount of LCM sized particles and potentially improving the properties of the circulated slurry.

Embodiments of the present invention also provide means for application and compaction of LCM through pressure injection and/or mechanical means.

Embodiments of the present invention also provide the ability to manage pressure in the first annular passageway between apparatus and the passageway through subterranean strata to inhibit the initiation and propagation of fractures and limit slurry losses associated with fractures. The application of these pressure altering tools and methods is removable and re-selectable without retrieval of the drilling or completion conduit string used to urge a passageway through subterranean strata.

Embodiments of the present invention also provide for reverse slurry circulation and for urging fluid slurry and cement slurry axially downward into the first annular passageway between a conduit string and the passageway through subterranean strata, wherein gravity may be used to aid said urging.

In circumstances where unwanted substances from the subterranean strata have the potential to enter the drilling slurry, typically hydrocarbon fluids or gases, reverse circulating may also be used to perform a dynamic kill and/or reduce slurry losses, when drilling with losses and urging a passageway through subterranean strata axially downward until a protective lining may be used to isolate said formations containing said unwanted contaminants of the drilling or completion fluids or slurries.

Embodiments of the present invention enable maintenance of a hydrostatic head, wherein an additional annular passageway may circulate slurry returns axially upward while clearing blockages and/or limiting slurry lost to fractures in the strata by circulating either axially upwards or downward in close tolerance and high frictional loss conditions in the first annular passageway through pressurized or gravity assisted flow between a conduit string and the passageway through subterranean strata.

Embodiments of the present invention may use a plurality of pressure bearing and non-pressure bearing conduits to urge a passageway through the subterranean strata and undertake completion within said passageway for production or injection during drilling or urging without removing the internal conduit strings.

In summary, embodiments of the present invention both inhibit the initiation or propagation of fractures within subterranean strata and carry protective casings, linings and completion apparatus with the boring or conduit string used to urge said linings and completion equipment into place without removing the internal rotating, non-rotating and/or circulating string to target deeper subterranean depths that is currently the practice of prior art.

Embodiments of the present invention thereby provide systems and methods that enable any configuration or orientation of single or dual conduit strings using a passageway through subterranean strata to generate subterranean LCM while placing protective casings and managing circulating pressures to achieve depths greater than is currently practical with existing technology.

While various embodiments of the present invention have been described with emphasis, it should be understood that within the scope of the appended claims, the present invention might be practiced other than as specifically described herein.

What is claimed is:

1. A system for using a wall of a passageway through subterranean strata to generate a lost circulation material (LCM) and inhibit strata fracture initiation or propagation therein, the system comprising:

at least one boring tool in communication with at least one conduit string, wherein said at least one boring tool generates rock debris at an end of said at least one conduit string;

at least one apparatus comprising at least one mechanical and fluid pressure coating member adapted for breaking the rock debris, wherein at least a portion of said at least one mechanical and fluid pressure coating member is movable to transport, impel, break, or combinations thereof, the rock debris is against an impact surface of said at least one apparatus or said subterranean strata to form said LCM, wherein the rock debris and LCM are carried by a circulated fluid slurry for coating a strata wall within a fracturable region of the passageway through subterranean strata, wherein said at least one conduit string extends through said fracturable region of said passageway through subterranean strata and protrudes axially downward within a bored strata wall from an outermost protective conduit string lining an upper end of said passageway through subterranean strata, and wherein said at least one mechanical and fluid pressure coating member of said at least one apparatus is carried by said at least one conduit string and located in said fracturable region, and wherein said at least one mechanical and fluid pressure coating member engages the rock debris to perform said breaking or impelling of said rock debris against said impact surface to form said LCM and apply said LCM between said boring tool and an upper end of said fracturable region by reducing a particle size of said rock debris urged axially upward by said circulated fluid slurry for coating said bored strata wall with said at least one mechanical and fluid pressure coating member to, in use, inhibit said strata fracture initiation or propagation to increase a pressure bearing capacity of said fracturable region, formed by said bored strata wall, with said LCM.

2. The system according to claim 1, wherein said at least one apparatus comprises at least one blade carried on said at least one conduit string and arranged to break or impel the rock debris radially outwardly toward impact surfaces within an inside circumference of a surrounding wall, and wherein said surrounding wall engages the wall of said passageway through subterranean strata.

3. The system according to claim 2, wherein said at least one conduit string carries a movable additional inner wall rotating about said at least one conduit string and disposed between said at least one conduit string and the surrounding wall, wherein said at least one blade, the impact surfaces, or combinations thereof, are secured to said at least one conduit string, said movable additional inner wall, or combinations thereof.

4. The system according to claim 3, further comprising at least one motor, at least one gear assembly, or combinations thereof, for increasing a relative rotational speed between said at least one conduit string, said movable additional inner wall, said surrounding wall, or combinations thereof, to increase said breaking or impelling of the rock debris toward said impact surfaces.

5. The system according to claim 3, wherein said at least one blade, a bushing, said movable additional inner wall, or combinations thereof, comprises a movable portion with an impact surface having a smooth surface, a stepped profile, a series of irregular impact surfaces comprising projections extending radially outward or inward from said impact surface, or combinations thereof.

6. The system according to claim 2, wherein said at least one blade comprises one or more blades extending radially outward eccentrically, vertically, at an inclination, or combinations thereof, relative to an axis of rotation of said at least one conduit string.

7. The system according to claim 1, wherein said at least one conduit string rotates in use and said at least one mechanical and fluid pressure coating member adapted for breaking the rock debris comprises a rock-grinding tool and at least one blade or said bushing projecting radially outwardly from an outer surface of said at least one conduit string and wherein said at least one apparatus grinds said rock debris against the wall of said passageway through subterranean strata.

8. The system according to claim 7, wherein said rock-grinding tool comprises at least one eccentric milling bushing blade.

9. The system according to claim 8, wherein said rock-grinding tool comprises a stack of eccentric milling bushing blades, thrust bearings, impact surfaces, or combinations thereof, wherein said eccentric milling bushing blades become successively angularly offset during rotation of a first wall of said at least one conduit string, contact with said rock debris, contact with said wall of said passageway through subterranean strata, or combinations thereof.

10. The system according to claim 1, wherein said at least one conduit string comprises an inner conduit string disposed within a surrounding conduit string, wherein the surrounding conduit string rotates in use, and wherein said at least one mechanical and fluid pressure coating member comprises an eccentric blade rock-grinding tool with impact surface projections extending radially outward from an eccentric outer surface secured to said surrounding conduit string arranged to grind said rock debris against the wall of said passageway through subterranean strata.

11. The system according to claim 1, wherein said at least one conduit string rotates in use, and wherein said at least one mechanical and fluid pressure coating member comprises a hole enlargement tool with a plurality of staged bore enlargement impact surface projections extending radially outward and upward from said at least one conduit string arranged to grind said rock debris against two or more stages formed by stepwise enlargement of the wall of said passageway through subterranean strata.

12. The system according to claim 11, wherein said two or more stages formed by said bore enlargement impact surface projections are secured to a wall engaged with and surrounding said at least one conduit string, wherein axial movement between said wall and said at least one conduit string extends or retracts said bore enlargement impact surface projections.

13. A method of using a wall of a subterranean passageway to generate lost circulation material (LCM) and inhibit strata fracture initiation or propagation, the method comprising the steps of:

providing at least one boring tool in communication with at least one conduit string, through a fracturable proximal region below an outermost protective conduit string lining said subterranean passageway;

operating said at least one boring tool to produce rock debris;

circulating a fluid slurry to urge the rock debris upward within said slurry within said fracturable region; and contacting the rock debris with at least one apparatus comprising at least one mechanical and fluid pressure coating member with a movable portion that the rock debris against an impact surface or said subterranean strata to reduce a size of the rock debris to form said LCM, wherein circulation of the rock debris applies said LCM to the wall of the subterranean passageway for inhibiting said fracture initiation or propagation in the fracturable region to increase a pressure bearing capacity of the strata wall of the subterranean passageway with an LCM coating.

14. The method according to claim 13, wherein the rock debris comprises particles of a size engageable with said at least one apparatus, the method comprising the step of repeatedly engaging the particles with the movable portion comprising a blade of said at least one mechanical and fluid pressure coating member, a bushing, or combinations thereof, aiding carriage of said particles within circulated fluid slurry urged by the wall of said subterranean passageway in a direction of a circulation of the fluid slurry.

15. The method according to claim 14, wherein the step of circulating the rock debris within said subterranean passageway comprises circulating the rock debris through a contorted pathway of reduced particle size capacity past projections of said at least one apparatus for breaking the rock debris to reduce the size of the rock debris from larger particles to smaller particles, thereby increasing large particle size retention time, by changing a velocity and an associated large particle carrying capacity of fluid slurry passing said at least one apparatus through said contorted pathway, thus increasing the propensity to repeatedly engage and break larger particles into smaller particles that are able to aid passage through said contorted pathway.

16. The method according to claim 15, further comprising the step of arranging said at least one apparatus to increase large particle retention time in the contorted pathways to reduce the particle size of a major fraction of said larger particles to smaller particles comprising a size ranging from 250 microns to 600 microns to, in use, aid said passage through said contorted pathway, provide said LCM coating, or combinations thereof.

17. The method according to claim 16, further comprising the step of targeting deeper subterranean strata using the fluid slurry carrying capacity freed by close proximity generation of said smaller particles for additions of further surface added LCM to said fluid slurry, wherein said mechanical and fluid pressure coating member of said further surface added LCM and said proximally generated LCM is used to bore an extended passageway through subterranean strata and engage a deeper outermost protective conduit string lining therein.

18. A system for controlling subterranean slurry circulating, velocities and pressures when using a wall to urge slurry and to place an apparatus within or to extend a passageway through subterranean strata, the system comprising:

a conduit assembly comprising at least one slurry passageway apparatus member, and conduit string members comprising a first conduit string member and at least one larger diameter additional conduit string member;

wherein said first conduit string member comprises a bore and extends longitudinally through a proximal region of said passageway through subterranean strata and defines an internal passageway member through the bore;

wherein said at least one larger diameter additional conduit string member extends longitudinally through said proximal region of said passageway through subterranean strata and protrudes axially downward from an outermost protective conduit string lining said proximal region, thereby defining a first annular passageway member between a wall thereof and a surrounding wall of a subterranean passageway;

wherein said first conduit string member extends at least partially within a first end and a second end of said at least one larger diameter additional conduit string member to define an intermediate enlarged internal passageway member, at least one additional annular passageway member, or combinations thereof;

wherein said at least one slurry passageway apparatus member connects said first conduit string member to said at least one larger diameter additional conduit string member, said at least one slurry passageway apparatus member comprising at least one radially-extending passageway member communicating between said internal passageway member, said intermediate enlarged internal passageway member, said at least one additional annular passageway member, said first annular passageway member, or combinations thereof, such that fluid slurry flowing in at least one of said passageway members is diverted through said at least one radially-extending passageway member to another of said passageway members to, in use, control subterranean slurry circulating velocities and pressure to place the apparatus within or to extend said passageway through subterranean strata.

19. The system according to claim 18, wherein said at least one larger diameter additional conduit string member is provided with a flexible membrane, a differential sealing apparatus, or combinations thereof, for sealing said at least one larger diameter additional conduit string member to said wall of the passageway through subterranean strata to choke said first annular passageway member during use.

20. The system according to claim 18, wherein said at least one larger diameter additional conduit string member further comprises a securing apparatus to secure said at least one larger diameter additional conduit string member to said wall of the passageway through subterranean strata to extend said outermost protective conduit string passageway.

21. The system according to claim 18, wherein at least one of said conduit string members, at least one slurry passageway member, or combinations thereof, further comprises a bore extension or enlargement apparatus to extend or enlarge the diameter of said passageway through subterranean strata.

22. The system according to claim 18, further comprising an engagement or multi-function apparatus for changing connecting engagements between said conduit string members, said passageway members, or combinations thereof, wherein use of said first conduit string member and said engagement or multi-function apparatus affects said change of connecting engagements.

23. The system according to claim 22, wherein said at least one slurry passageway apparatus member is engaged to at least one of the conduit string members with at least one rotary drive coupling, and wherein sliding mandrels are disposed between said conduit string members for actuating engagement or disengagement from associated receptacles and carrying or placing said at least one larger diameter additional conduit string member within said passageway.

24. The system according to claim 22, wherein said engagement or multi-function apparatus comprises an engagement apparatus provided and urged through said internal passageway member of said first conduit string member with circulated slurry to engage the multi-function apparatus, a wall of said first conduit string member, or combinations thereof, to effect a change of said connecting engagements.

25. The system according to claim 24, wherein said engagement apparatus engages a multi-function apparatus to axially or rotatably move members of said multi-function apparatus, wherein said multi-function apparatus comprises an additional wall member, at least one further additional wall member, an additional surrounding wall member, or combinations thereof, wherein said engagement apparatus engages mandrels, receptacles, springs, ratchet teeth, orifices, radially-extending passageways, or combinations thereof, disposed about or within associated walls of said conduit string members, wherein said conduit string members comprise orifices, radially-extending passageways, or combinations thereof, and wherein said orifices, radially-extending passageways, or combinations thereof are axially movable or rotatable relative to other orifices or radially-extending passageways to repeatedly or singularly change fluid slurry communication between said passageway members.

26. The system according to claim 24, further comprising at least a second engagement or multi-function apparatus, wherein said at least a second engagement or multi-function apparatus is provided and urged through said internal passageway member of said first conduit string member with circulated slurry to engage a blocking apparatus and pierce a differential pressure barrier of said blocking apparatus to release an associated engagement mandrel with said wall of the first conduit string, wherein a union of said at least a second engagement or multi-function apparatus and said engagement apparatus is further urged through said internal passageway member.

27. The system according to claim 24, further comprising a basket for removing said engagement or multifunction apparatus from blocking said internal passageway member and providing fluid communication past said engagement or multifunction apparatus.

28. The system according to claim 22, wherein said first conduit string member is axially moveable and rotatable to engage and actuate said engagement or multi-function apparatus, with rotary drive couplings rotating associated distal end engagements secured to said first conduit string member and at least two associated intermediate hydraulic pumps within a housing arranged to axially move at least one piston disposed within an associated piston chamber of one of the at least two associated intermediate hydraulic pumps to effect a change of said connecting engagements via an associated fluid external to fluid flowing within said first conduit string member.

29. The system of claim 28, wherein engaging member features comprising one or more sliding mandrels, one or more orifices, one or more radially-extending passageways, or combinations thereof, are provided in an additional wall member, one or more further additional walls, or combinations thereof, engaged to said piston and disposed about or within associated walls of said conduit string members, and wherein said associated walls comprise associated member features comprising receptacles, orifices, radially-extending passageways, or combinations thereof, arranged to axially align with said engaging member features.

30. A method of selectively controlling subterranean slurry circulating velocities and pressures when using a wall to urge slurry and to place an apparatus or to extend a subterranean passageway, the method comprising the steps of:

providing a conduit assembly within the subterranean passageway, wherein the conduit assembly comprises a first conduit string member in fluid communication with at least one larger diameter additional conduit string member via connection through at least one slurry passageway apparatus member, wherein said at least one slurry passageway apparatus member comprises at least one radially-extending passageway member in fluid communication between an internal passageway member defined through a bore of the first conduit string member and at least one additional passageway member disposed radially external to the internal passageway member;

diverting at least a portion of a fluid slurry flowing within the internal passageway member, said at least one additional passageway member, another additional passageway member comprising a first annular passageway between said conduit assembly and said subterranean passageway, or combinations thereof, to another of the internal passageway member, said at least one additional passageway member, said another additional passageway member, or combinations thereof, wherein said at least a portion of the fluid slurry flows through said at least one radially-extending passageway member of said at least one slurry passageway apparatus member to selectively control said subterranean slurry circulating velocities and pressures by diverting between flow capacities of said passageway members to urge said slurry and to place said apparatus within said subterranean passageway or to extend said subterranean passageway.

31. The method according to claim 30, wherein the step of diverting at least a portion of the fluid slurry comprises flowing the fluid slurry through at least one additional radial-extending passageway member within said at least one slurry passageway apparatus member, and wherein said at least a portion of the fluid slurry is urged axially upward, axially downward, or combinations thereof, between said internal passageway member and said at least one additional passageway member to affect circulated fluid slurry pressure, facilitate LCM application, or combinations thereof, to inhibit initiation or propagation of strata fractures.

32. The method according to claim 30, further comprising the step of providing to said at least one larger diameter additional conduit string member, a flexible membrane, a differential sealing apparatus, or combinations thereof, and engaging said at least one larger diameter additional conduit string member to said wall of the subterranean passageway to choke said at least one additional passageway member in use.

33. The method according to claim 30, further comprising the step of providing to said at least one larger diameter additional conduit string member a securing apparatus to secure said at least one larger diameter additional conduit string member to said wall of the subterranean passageway to extend a protective conduit string lining said subterranean passageway.

34. The method according to claim 30, further comprising the step of providing to said at least one larger diameter additional conduit string member a bore extension or enlargement apparatus to extend or enlarge a diameter of said wall of the subterranean passageway.

35. The method according to claim 30, wherein said at least one slurry passageway apparatus member comprises an engaging or multi-function apparatus, and wherein the method further comprises the step of changing a connecting engagement between said conduit string members, said passageway members, or combinations thereof, using the engaging or multi-function apparatus.

36. A system for selectively controlling subterranean slurry circulating velocities and pressures when extending or using a wall of a passageway through subterranean strata, the system comprising:

a conduit assembly comprising at least one slurry passageway apparatus, a first conduit string and at least one outer additional conduit string, wherein the first conduit string comprises a bore which defines an internal passageway therethrough, and wherein connection between said first conduit string and said at least one outer additional conduit string defines a first annular passageway between a wall thereof and said passageway through subterranean strata and at least one additional annular passageway between an outer wall of said first annular passageway thereof and a wall of said first conduit string;

at least one rock boring apparatus disposed at an end of the conduit assembly, wherein said at least one rock boring apparatus generates rock debris within said passageway through subterranean strata;

a circulating apparatus for circulating fluid slurry axially downward within at least one of said passageways to a distal end of said conduit assembly and axially upward within at least one other of said passageways; and at least one slurry passageway tool disposed between two or more of said conduit strings and said passageways, wherein said at least one slurry passageway tool connects a conduit string to said conduit assembly, disconnects a conduit string from said conduit assembly, connects a conduit string to said passageway through subterranean strata, changes a connection and associated fluid slurry circulation pressure between said passageways, or combinations thereof, to selectively control subterranean slurry circulating velocities and pressures when extending or using the wall of the passageway through subterranean strata.

37. The system according to claim 36, wherein said conduit assembly is usable to extend the passageway through subterranean strata using the boring apparatus at the end thereof, and connecting said conduit strings and outer protective linings between the passageway through subterranean strata and at least one other of said passageways.

38. The system according to claim 36, further comprising a completion apparatus carried by said conduit assembly and engaged with the wall of the passageway through subterranean strata, and wherein said at least one slurry passageway tool functions as a production packer and said first conduit string functions as a production or injection string.

39. The system according to claim 36, further comprising at least one apparatus for reducing a size of the rock debris in said conduit assembly to form lost circulation material comprising particles having a size ranging from 250 microns to 600 microns for circulating with the fluid slurry coating the strata wall of said subterranean passageway to inhibit initiation or propagation of fractures in said wall.

40. The system according to claim 39, wherein said at least one apparatus is adapted for a pressurized fluid slurry application, a mechanical large diameter string wall application, a mechanical blade application, an impact surface application, or combinations thereof, for further applying lost circulation material carried within said circulated fluid slurry coating the wall of said passageway through subterranean strata to further inhibit the initiation or propagation of fractures in said wall.

41. A method of selectively controlling subterranean slurry circulating velocities and pressures when extending or using a wall of a subterranean passageway, the method comprising the steps of:

providing a conduit assembly into the subterranean passageway, wherein the conduit assembly comprises a first conduit string having an internal passageway in fluid communication with at least one additional conduit string via connection through at least one slurry passageway apparatus, wherein at least one additional annular passageway is defined between said first conduit string and said at least one additional conduit string, and wherein a first annular passageway is defined between a wall of said at least one additional annular passageway and the wall of the subterranean passageway;

circulating fluid slurry axially downward, upward, or combinations thereof within at least one of the passageways;

using said at least one slurry passageway apparatus to engage or disengage connections between said conduit strings, said passageways, or combinations thereof, and selectively control velocity and pressure of the circulated fluid slurry when extending or using the wall of the subterranean passageway.

42. The method according to claim 41, further comprising the steps of using a boring apparatus secured to an end of said conduit assembly to extend the passageway through subterranean strata and connect said conduit strings and outer protective linings between one of said passageways and the wall of the subterranean passageway.

43. The method according to claim 41, further comprising the steps of providing a completion apparatus carried by said conduit assembly and engaging the completion apparatus with the wall of the subterranean passageway, and using said at least one slurry passageway apparatus as a production packer while producing or injecting through said first conduit string.

44. The method according to claim 41, further comprising the step of adding lost circulation material comprising particles ranging in size from 250 microns to 600 microns to said fluid slurry to inhibit initiation or propagation of fractures in said wall, wherein the lost circulation material is provided using surface additions, at least one apparatus in said conduit assembly to reduce the size of rock debris within said subterranean passageway, or combinations thereof.

45. The method according to claim 41, wherein the step of adding lost circulation material comprises applying the lost circulation material within the subterranean passageway using a pressurized fluid slurry application, a mechanical large diameter string wall application, a mechanical blade application, an impact surface application, or combinations thereof, to further inhibit the initiation or propagation of fractures in said wall.

* * * * *